US007015438B2

(12) United States Patent
Hirota et al.

(10) Patent No.: US 7,015,438 B2
(45) Date of Patent: Mar. 21, 2006

(54) INDUCTION HEATER

(75) Inventors: Izuo Hirota, Toyonaka (JP); Yuji Fujii, Kobe (JP); Koji Niiyama, Kobe (JP); Takahiro Miyauchi, Kobe (JP); Atsushi Fujita, Minoo (JP); Manabu Takahashi, Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/502,139

(22) PCT Filed: Jan. 24, 2003

(86) PCT No.: PCT/JP03/00695

§ 371 (c)(1),
(2), (4) Date: Jul. 19, 2004

(87) PCT Pub. No.: WO03/063552

PCT Pub. Date: Jul. 31, 2003

(65) Prior Publication Data

US 2005/0121438 A1 Jun. 9, 2005

(30) Foreign Application Priority Data

| | | |
|---|---|---|
| Jan. 25, 2002 | (JP) | 2002-016561 |
| Jul. 15, 2002 | (JP) | 2002-205234 |
| Sep. 17, 2002 | (JP) | 2002-269564 |
| Oct. 8, 2002 | (JP) | 2002-294768 |

(51) Int. Cl.
*H05B 6/06* (2006.01)

(52) U.S. Cl. ..... 219/663; 219/601

(58) Field of Classification Search ..... 219/663, 219/619, 601, 625, 664, 667, 627, 626, 665, 219/661, 497; 399/33, 329, 69; 164/155.6, 164/164.1

See application file for complete search history.

(56) References Cited

U.S. PATENT DOCUMENTS

| | | | | |
|---|---|---|---|---|
| 4,900,884 | A * | 2/1990 | Aoki | 219/601 |
| 6,505,675 | B1 * | 1/2003 | Komuro et al. | 164/155.6 |
| 6,900,419 | B1 * | 5/2005 | Takagi et al. | 219/619 |

FOREIGN PATENT DOCUMENTS

| | | |
|---|---|---|
| JP | 10-241850 | 9/1988 |
| JP | 5-343177 | 12/1993 |
| JP | 7-282967 | 10/1995 |
| JP | 9-199268 | 7/1997 |
| JP | 11-2412 | 6/1999 |
| JP | 11-185948 | 7/1999 |
| JP | 2000-82578 | 3/2000 |
| JP | 2001-257067 | 9/2001 |
| JP | 2002-299024 | 10/2002 |
| JP | 2003-45637 | 2/2003 |

* cited by examiner

*Primary Examiner*—Quang Van
(74) *Attorney, Agent, or Firm*—Pearne & Gordon LLP

(57) ABSTRACT

An induction heater having a safety function of lowering or stopping the heating power when an object to be heated moves, the safety function hardly interfering with the cooking activities of a user is provided. The induction heater includes an inverter circuit, an output detection section for detecting the magnitude of the inverter circuit, a first movement detection section, and a storage section for storing a control value before the first movement detection section detects a movement of the object. In a reach control mode, the output of the inverter circuit is gradually increased to a target. In a stable control mode, the output of the inverter circuit is maintained at the target. When the first movement detection section detects a movement of the object, a control section shifts to a first output mode in which a control value derived from the stored control value is output.

35 Claims, 60 Drawing Sheets

(a)

(b)

INDUCTION HEATER

TECHNICAL FIELD

The present invention relates to an induction heater.

BACKGROUND ART

An induction heater to which induction heating is applied and which is using an inverter, has an excellent heating responsiveness and controllability by being equipped with a temperature detecting element or the like in the vicinity of a thing such as a pot, which is a load, to detect the temperature of the pot or the like and adjust heating power and cooking time accordingly. Besides realizing elaborate cooking, the induction heater has the following characteristics: it hardly pollutes the air in a room because of not using an open flame; it has high heat efficiency; and it is safe and clean. In recent years, these characteristics have received attention and the demand for induction heaters has been growing rapidly.

When an object to be heated (hereinafter may be referred to as "object") is cooked via a non-magnetic and low-resistant metal load (a container such as an pan or a frying pan made of aluminum) on the induction heater, a great floating up or buoyant force is exerted on the load by the action of a magnetic field of a heating coil on an eddy current induced in the load, and/or the load is lightweight, so that the load may move (including slipping sideways and floating) while cooking is done.

In Official Gazette of Japanese Unexamined Patent Publication 2001-332375, an induction heating cooker in accordance with the prior-art example 1 therein is disclosed which, at the start of heating, increases the heating output gradually from a low state to a set output, detects that the gradient of the change in the power source current varies to recognize the float or the movement of the load, and when the recognition is made, exercises control such as stopping the heating or lowering input power (the specific method is not described).

With reference to FIG. 56 to FIG. 60, an induction heating cooker, which is an induction heater in accordance with prior art example 2, will be described. FIG. 56 is a schematic block diagram of the induction heater in accordance with prior art example 2. FIG. 57 is a block diagram of the induction heater in accordance with prior art example 2. In FIG. 56 and FIG. 57, the numeral 110 represents an object to be heated (a metal container such as a pan or a frying pan), the numeral 101 represents an induction heating coil which produces a high-frequency magnetic field to heat the object 110, the numeral 109 represents a commercial AC power source input, the numeral 108 represents a rectifying-smoothing section comprising a bridge and a smoothing capacitor for rectifying commercial AC power source, the numeral 102 represents an inverter circuit for converting the power source rectified by the rectifying-smoothing section 108 into high-frequency power to supply a high-frequency current to the induction heating coil 101, the numeral 103 represents an output detection section for detecting the magnitude of the output of the inverter circuit 102 (specifically, a current transformer for detecting the power source current of the inverter circuit 102), the numeral 5612 represents a microcomputer, the numeral 5605 represents a setting input section having a plurality of key switches (including a key switch for inputting an output level setting command to set a target output of the induction heater), and the numeral 5601 represents a ceramic top plate which is placed on the top of a housing and on which the object 110 is to be placed. The microcomputer 5612 has a control section 5704 and a movement detection section 5706.

The movement detection section 5706 detects a movement (including slipping and floating) of the object 110 by the method which is similar to that in prior art example 1.

The control section 5704 controls the output of the inverter circuit 102 in response to an output signal from the output detection section 103 and an output signal from the movement detection section 5706. The heating output is varied by controlling the driving frequency of switching elements.

When the movement detection section 5706 does not detect the movement of the object 110, the control section 5704 exercises control so that the output (detection current) of the output detection section 103 reaches a set target current value. When the movement detection section 5706 detects the movement of the object 110, in order to stop the movement of the object 110, the control section 5704 exercises control so as to reduce the output power of the inverter circuit 102 sharply to a predetermined small value at which neither a slippage nor a float thereof is caused. Alternatively, the control section 5704 may stop the inverter circuit 102. As a result, it is possible to reduce floats and movements of the load and thereby secure the safety of the induction heater.

In FIG. 58, one example of the relationship between the input power and the buoyant force when a pan, which is an object to be heated, made of non-magnetic metal (for example, aluminum) is heated is provided. In FIG. 58, the horizontal axis indicates the input power to the inverter circuit 102, while the vertical axis indicates the buoyant force acting on the object 110. As shown in FIG. 58, the buoyant force increases as the input power grows. When this buoyant force exceeds the weight of the object, a slippage and/or a float of the object are/is caused.

The dashed line in FIG. 59 indicates a state of the change in the input current of the inverter circuit 102 until the heating output is gradually increased from a low state to a set output (target value) after startup of the inverter circuit 102 (the start of heating) and the output of the inverter circuit 102 reaches a set level of power. The solid line in FIG. 59 indicates a state of the change of the input current of the inverter circuit 102 in the case where the movement detection section 5706 detects a slippage or a float of the object 110 before the heating output is gradually increased from the low state to the set output (target value) after startup of the inverter circuit 102 (the start of heating) and the output of the inverter circuit 102 reaches the set level of power (target value). In FIG. 59, the horizontal axis indicates time, while the vertical axis indicates the input power source current of the inverter circuit 102. The induction heater in accordance with prior art example 2 shown in FIG. 59 performs the operation done after startup of the inverter circuit 102 from the beginning when the movement detection section 5706 detects a movement (a slippage or a float) of the object 110. Namely, the heating output is gradually increased until the output of the inverter circuit 102 reaches from a small output value at startup (a small output value at the start of heating) to the set output or until the movement detection section 5706 detects a movement of the object 110 again. This operation is repeated.

With reference to FIG. 60, the detection operation of the movement detection section 5706 in accordance with prior art example 2 will be described. The induction heater in accordance with prior art example 2, after startup of the inverter circuit 102 (the start of heating), gradually increases the heating output from a low state to a set output (target value) and raises the output of the inverter circuit 102 to a set level of power. Part (a) of FIG. 60 indicates the change of the input power with time in the case where a slippage or a float of the object 110 is caused before the output of the inverter circuit 102 reaches the set level of power. In part (a) of FIG. 60, the horizontal axis indicates time, while the vertical axis indicates the input power of the induction heating coil 101. Part (b) of FIG. 60 indicates the change of the power source current (the input current of the inverter circuit 102) with time in such a case. In part (b) of FIG. 60, the horizontal axis indicates time, while the vertical axis indicates the input power source current of the inverter circuit 102.

In FIG. 60, during the time the heating output is being gradually increased at the start of heating, if a buoyant force acts on the object 110, so that the object 110 moves (floats, or floats to move sideways and so on), the object 110 moves away from the induction heating coil 101. The input power of the induction heating coil 101 lowers in proportion as the object 110 moves away therefrom. When the object 110 moves, as shown in FIG. 60, the gradient of the change in the power source current (and the input power of the induction heating coil 101) gets lower. The movement detection section 5706 detects a movement of the object 110 based on the change in the gradient (time differential value) of the power source current detected by the output detection section 103.

If a user moves an object to be cooked when carrying out cooking by the use of the induction heating cooker in accordance with prior art example 2, the movement detection section erroneously determines that the object to be heated has moved by buoyant force, whereby the control section can lower the heating output or stop heating. (In prior art example 2, the operation shown in FIG. 59 is performed. In another prior art example, when a movement of the object to be heated is detected, the inverter is stopped, or the output of the inverter is limited to a predetermined low output (such a low output that a pan, of whatever kind, does not move.). In such a case, there is a problem that heating power is insufficient, whereby it is substantially impossible to carry out cooking. The induction heating cooker in accordance with prior art example 2 operates safely, but when the safety function is activated, it can be substantially impossible to carry out cooking.

The present invention intends to solve the prior art problem mentioned above and provides an induction heater having a safety function of lowering or stopping the heating power when the object to be heated moves, the safety function hardly interfering with cooking activities of the user.

The present invention provides an induction heater having the safety function of lowering or stopping the heating power when the object to be heated moves, wherein even when the safety function is activated, an induction heating coil maintains high heating power, whereby it is possible for the user to carry out cooking.

The present invention provides an induction heater which has a safety function of lowering or stopping the heating power when the object to be heated is moved by a high-frequency magnetic field produced by an induction heating coil, the safety function not being activated in any case other than mentioned above so that the situation where cooking activities of a user are hindered by the safety function is prevented.

The present invention provides an induction heater having the safety function of lowering or stopping the heating power when the object to be heated moves, wherein the safety function is not activated when a user moves a pan which is the object to be heated, or even when the safety function is activated, it is possible to heat the object with stability (for example, it is possible to carry out the cooking such as frying).

DISCLOSURE OF INVENTION

In order to attain the above mentioned object, an induction heater of the present invention comprises an induction heating coil which produces a high-frequency magnetic field to heat an object to be heated, an inverter circuit which supplies a high-frequency current to the induction heating coil, an output detection section for detecting the magnitude of the output of the inverter circuit, a control section for controlling the output of the inverter circuit in response to the output of the output detection section, a setting input section for setting a target output to be controlled by the control section, a first movement detection section for detecting a movement of the object, and a storage section for storing a control value output by the control section or an output value of the output detection section before the first movement detection section detects the movement of the object, wherein the control section has a reach control mode where the output of the inverter circuit is increased from a low output to the target output gradually, a stable control mode where the inverter circuit is controlled so that the output of the inverter circuit agrees with the target output, and a first output mode where a control value derived from the control value or the output value of the output detection section stored in the storage section is output, or an output value derived from the control value or the output value of the output detection section stored in the storage section is set as a new target output, and the inverter circuit is controlled so that the output of the inverter circuit agrees with the new target output, and when the first movement detection section detects a movement of the object, the control section shifts to the first output mode.

The present invention can realizes an induction heater which has a safety function of lowering or stopping the heating power when the object to be heated moves, and prevents the situation where the safety function is activated to make it impossible for a user to carry out cooking. The present invention realizes a user-friendly and safe induction heater.

While the novel features of the invention are set forth particularly in the appended claims, the invention, both as to organization and content, will be better understood and appreciated, along with other objects and features thereof, from the following detailed description taken in conjunction with the drawings.

Figure 1:
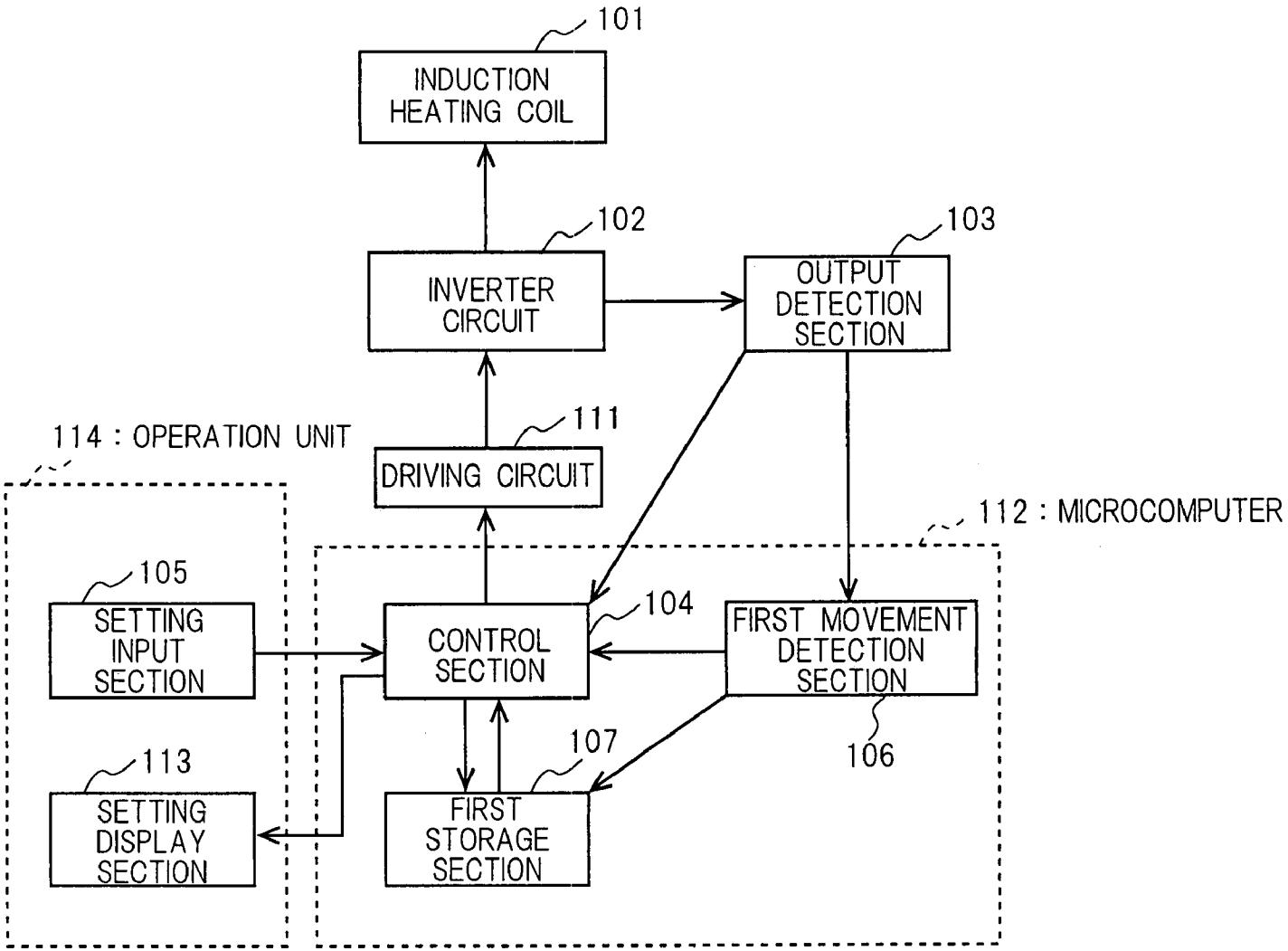
FIG. 1 is a block diagram showing a configuration of an induction heater in accordance with Embodiments 1 and 2 of the present invention.

It will be recognized that some or all of the Figures are schematic representations for purposes of illustration and do not necessarily depict the actual relative sizes or locations of the elements shown.

BEST MODE FOR CARRYING OUT THE INVENTION

An induction heater in accordance with one aspect of the present invention comprises an induction heating coil which produces a high-frequency magnetic field to heat an object to be heated, an inverter circuit which supplies a high-frequency current to the induction heating coil, an output detection section for detecting the magnitude of the output of the inverter circuit, a control section for controlling the output of the inverter circuit in response to the output of the output detection section, a setting input section for setting a target output to be controlled by the control section, a first movement detection section for detecting a movement of the object, and a storage section for storing a control value output by the control section or an output value of the output detection section before the first movement detection section detects the movement of the object, wherein the control section has a reach control mode where the output of the inverter circuit is increased from a low output to the target output gradually, a stable control mode where the inverter circuit is controlled so that the output of the inverter circuit agrees with the target output, and a first output mode where a control value derived from the control value or the output value of the output detection section stored in the storage section is output, or an output value derived from the control value or the output value of the output detection section stored in the storage section is set as a new target output, and the inverter circuit is controlled so that the output of the inverter circuit agrees with the new target output, and when the first movement detection section detects a movement of the object, the control section shifts to the first output mode.

In the present invention, when a user carries out cooking using a lightweight load pan made of non-magnetic metal such as aluminum or copper and the first output detection section detects a movement (a slippage or a float) of the pan, the heating output is controlled based on the information regarding the output of the inverter circuit (the control value output by the control section or the output value of the output detection section) which is stored in the storage section before the movement of the object is detected. As a result, neither a slippage nor a float of the object (load) is caused, while heating can be carried out with high heating power (with the maximum heating power in the range of the heating power with which the object does not move or at a value obtained by subtracting a predetermined value from the value of the maximum heating power). According to the present invention, an induction heater can be obtained which provides a substantially large supply of power to the object even when the first movement detection section detects the movement of the pan and thereby permits short-time cooking.

For example, it is assumed that a user carries out cooking moving the pan (object to be heated). As in prior art induction heaters, when it is detected that the object has moved, the inverter is stopped, or when the output of the inverter is limited to a predetermined low output (such a low output that the pan, of whatever kind, does not move), the power substantially consumed by the object (average power) gets lower. According to such a control method, in the cooking such as frying cooking which requires high heating power (high heating output), the object cannot be sufficiently heated, whereby the unfavorable situation can be caused. The induction heater of the present invention is much more user-friendly than the prior art induction heaters.

The output detection section may detect the magnitude of the output of the inverter circuit directly (for example, detect the current flowing through the induction heating coil), and may detect indirectly (for example, detect the input current of the inverter circuit).

The detection method of the first movement detection section is arbitrary (the same goes for the embodiments). For example, as in the prior art examples, at the start of heating, while the heating output is gradually increased, a movement of the object is detected based on the change in the gradient (time differential value) of the power source current input by the inverter circuit. For example, at the start of heating, while the heating output is gradually increased, the movement of the object is detected based on the change in the gradient of the coil current flowing through the induction heating coil.

For example, it is also possible to provide a weight sensor for detecting the weight of the object. As in the prior art examples, the heating output is gradually increased at the start of heating. The weight of the load detected by the weight sensor decreases with increasing buoyant force. When the weight detected by the weight sensor falls below a predetermined threshold value (typically, the threshold value is 0 g), the control section determines that the object has moved. When the weight detected by the weight sensor is equal to or greater than the predetermined threshold value, the control section determines that the object has not moved.

In the above mentioned induction heater in accordance with another aspect of the present invention, when a predetermined time period elapses in the first output mode, the control section shifts to the reach control mode. By again storing the output value at which neither a slippage nor a float of the object is detected, the error in the detection can be corrected in response to the change in the weight of the object in the first output mode. For example, it is possible to prevent the float of the pan reduced in weight by evaporation of water in the stew or by eating the stew therein in the first output mode. The safety and the reliability of the induction heater is improved.

In the above mentioned induction heater in accordance with another aspect of the present invention, in the first output mode where the control section outputs the control value derived from the control value or the output value of the output detection section stored in the storage section, when the difference between the output value of the output detection section stored in the storage section at the previous time and the output value of the output detection section newly stored therein is within a predetermined range, and a predetermined time period has elapsed since the shift to the first output mode, the control section changes the target output value set by the setting input section into the value derived based on the output value of the output detection section stored in the storage section, or in the first output mode where the control section sets the output value derived from the control value or the output value of the output detection section stored in the storage section as the new target output and controls the inverter circuit so that the output of the inverter circuit agrees with the new target output, when the difference between the control value or the output value of the output detection section stored in the storage section at the previous time, and the control value or the output value of the output detection section newly stored in the storage section is within a predetermined range, and a predetermined time period has elapsed since the shift to the first output mode, the target output value set by the setting input section is changed into the value derived based on the control value or the output value of the output detection section stored in the storage section.

If the target output value set at the setting input section is output as it is, the pan may move (slip or float) because of being lightweight. In the present invention, the control value or the target output value is automatically changed to the value at which a movement of the pan is not caused. The induction heater for heating the object to be heated with safety and with stable power can be obtained.

If the power source voltage changes, even when the control value or the power source current remains the same, the heating output of the inverter changes. According to the present invention, the output (for example, the power source current) or the control value at which the pan moves is recognized, and based on the result thereby obtained, the target output value is automatically changed to the value at which the pan does not move. As a result, the heating power which is stable relative to the change in the power source voltage and so on can be obtained.

The above mentioned induction heater in accordance with another aspect of the present invention has a setting display section for displaying the target output value set by the setting input section, wherein the setting display section changes the display in response to the control value output by the control section or the output value of the output detection section which have been stored in the storage section.

Since the user can find that the voltage actually applied to the pan have the value less than the set target output value, the induction heater is convenient for use. Based on the display, the user sees that a movement of the pan has occurred, and can take measures such as changing the weight of the pan (including the ingredients to be cooked which are placed therein) so as not to cause a float of the pan.

The display of the output value may be the absolute display of the output value or the relative display thereof. The absolute display of the output value is, for example, to display the output current value or the set output power. The relative display of the output value is, for example, to display that the output is at the fifth of seven levels by lighting five out of seven LEDs.

The above-mentioned induction heater in accordance with another aspect of the present invention has a second movement detection section which determines that the object has moved when the first movement detection section detects movements of the object successively in the fist output mode, wherein, when the second movement detection section detects the movement of the object, the control section changes the output of the inverter circuit in the first output mode into a value lower than before.

For example, when the weight of the object, which is a load, is distributed off-center, at the output value stored in the first storage section, the object can slip on the induction heater little by little. With this configuration, in the case mentioned above, it is possible to detect the movement of the object, lower the output value to the value less than before, and stop the slippage thereof. The safety of the induction heater is improved.

In the above mentioned induction heater in accordance with another aspect of the present invention, in lowering the output of the inverter circuit in the first output mode, the control section gradually reduces the output. With this configuration, even in the case where the pan has moved, the power does not rapidly change so that, for example, the user is not hindered from carrying out cooking activities. The induction heater is free from the trouble that an abrupt change in power occurs to surprise the user, so that the usability of the induction heater is improved.

In the above mentioned induction heater in accordance with another aspect of the present invention, when the target output value set by the setting input section exceeds a predetermined value, the control section corrects a threshold value with which the first movement detection section or the second movement detection section determines that the object has moved with a predetermined value.

In general, when using the induction heater with high heating power (the set output value is high), the user carries out cooking moving the object. When using the induction heater with low heating power (the set output value is low), the user mostly carries out cooking with the object left untouched (without moving the object). In the present invention, for example, when fry cooking is carried out with high heating power, the threshold value which determines a movement of the object is raised (the detection sensitivity is decreased), or the detection is not performed. For example, when stew is gently simmered with low heating power, the induction heater detects a movement of the object resulting from a repelling magnetic field with the high sensitivity as usual. As a result, an induction heater can be obtained which is suitable for the usage, safe, and makes it possible for the user to, for example, carry out fry cooking moving a frying pan, thereby providing ease of use.

Correcting the threshold value with the predetermined value involves not performing the detection (making the threshold value infinite).

In the above mentioned induction heater in accordance with another aspect of the present invention, when the value derived based on the control value output by the control section or the output value of the output detection section which have been stored in the storage section is less than a predetermined value, the control section stops heating.

If the user tries to heat a very lightweight object to be heated (for example, a thin and small plate made of aluminum), the output value of the induction heating coil can be limited to a considerably low value by the safety function. If the output value of the induction heating coil is too low, the inverter circuit may not operate appropriately. With this configuration, in such a case, it is determined that the object is not suited for being heated, so that the heating is stopped. The safety of the induction heater is improved.

In the above mentioned induction heater in accordance with another aspect of the invention, when the difference between the set output value and the output value of the output detection section is within a predetermined range in the stable control mode, the control section fixes a control value as a second output mode for at least a predetermined time period.

When the output with which the object is heated reaches almost the target value, typically, by fixing the output in such a state, the induction heater hardly becomes susceptible to the adverse influence of the disturbance, thereby supplying more stable power to the object.

The above mentioned induction heater in accordance with another aspect of the present invention has a movement state detection section for determining whether the object has been moved by the outside force or the movement thereof has been caused by the repelling magnetic field in the stable control mode, wherein when the movement state detection section determines that the movement thereof has been caused by the repelling magnetic field, the shift to the first output mode is made.

When the movement of the object resulting from the repelling magnetic field is detected in the stable control mode, the output is automatically reduced to a proper level, and heating can be continued.

In the above mentioned induction heater in accordance another aspect of the present invention, in the stable control mode, according to whether or not the periods of the change in the output value of the output detection section, the control value of the control section, or the weight of the object are within a predetermined range, it is checked whether the movement of the object has been caused by the repelling magnetic field or the object has been moved by the outside force.

The inventor of the present invention has found out that when one carries out cooking moving the object to be heated (for example, a frying pan), a float of the object occurs with irregularity, whereas a movement of the object resulting from the repelling magnetic field occurs with relative regularity. The induction heater of the present invention makes use of this to detect only a movement of the object resulting from the repelling magnetic field (the word "only" in the description is not used in its strict sense, but means that it is difficult to detect the movement the object when one actually carries out cooking moving the object). The present invention realizes a safe and user-friendly induction heater wherein, when one carries out cooking moving the frying pan, the situation where the safety function is erroneously activated to interfere with cooking does not occur, whereas, when the object is moved by the repelling magnetic field, the safety function is appropriately activated.

The word "period" refers to a time period from when it changes form a certain state until it returns to almost the same state as mentioned above. The wording "almost the same state" means that the dynamic states of the change on the time axis at two points are almost the same (for example, the state in which the change is maximum), the static states of the change at two points are almost the same (for, example, the level reaches a predetermined value), or the dynamic states of the change and the static states of the change at two points are the same (for example, the level is on the increase and at the same time, the level reaches the predetermined value). The sameness of the dynamic states of the change and the static states of the change is determined based on whether or not the qualitative states or the quantitative values of one or more parameters are almost the same. To give a specific example, "period" refers to the time period from the time the input current value reaches the maximum until it reaches the maximum the next time (the period based on the qualitative state). "Period", for example refers to the time period from the time the control value increases to a certain value until it increases to the same value as mentioned above (the period based on the quantitative value).

The above mentioned induction heater in accordance with another aspect of the present invention further has a third movement detection section for detecting a movement of the object based on the fact that the control section has increased the control value continuously so as to increase the output of the inverter circuit in the stable control mode, wherein when the third movement detection section detects the movement of the object, the shift to the first output mode is made.

As for the movement of the object resulting from the repelling magnetic field, the object moves away from the induction heating coil little by little without returning to the original position. In the stable control mode, if the control section outputs a fixed control value (for example, if the coil current with a fixed frequency is supplied to the induction heating coil for a fixed conduction period), as the object moves away from the induction heating coil, the currents actually flowing into the induction heating coil decreases monotonously. In the stable control mode where the control section controls the inverter circuit so that the output of the inverter circuit agrees with a target output, as the object is moved away from the induction heating coil by the repelling magnetic field, the control value to be output by the output section is changed so as to monotonously increase the output of the inverter circuit. The inventor of the present invention found out this phenomenon, and has invented an induction heater which makes use of this phenomenon to detect only the movement of the object resulting from the repelling magnetic field. The present invention realizes a safe and user-friendly induction heater wherein, when one carries out cooking moving a frying pan, the situation where the safety function is erroneously activated to interfere with cooking does not occur, whereas when the object is moved by the repelling magnetic field, the safety function is appropriately activated.

In the above mentioned induction heater in accordance with in another aspect of the present invention, when shifting from the reach control mode or the stable control mode to the first output mode, the control section outputs a correction value obtained by correcting the control value stored in the storage section with a first correction value or a correction value such that the output value obtained by correcting the output value of the output detection section stored in the storage section with a first correction value can be gained, whereas when shifting from the first output mode to the reach control mode, the control section outputs a control value obtained by correcting the control value stored in the storage section with a second correction value or a correction value such that the output value obtained by correcting the output value of the output detection section stored in the storage section with a second correction value can be gained, and the first correction value is set greater than the second correction value.

In the first output mode, the control value such obtained by subtracting the first correction value from the control value stored in the first storage section or the control value such that the output value obtained by subtracting the first correction value from the output value of the output detection section can be gained is output, whereby the movement of the object can be stopped reliably, and heating can be continued without unnecessarily lowering the output of the inverter circuit. When the shift from the first output mode to the reach control mode is made, the control value obtained by subtracting the second correction value from the control value stored in the first storage section or the control value such that the output value calculated by subtracting the second correction value from the output value of the output detection section can be gained is output, whereby the time until a movement of the object is detected the next time can be shortened. As a result, a user-friendly and safe induction heater can be obtained.

The method of outputting the control value derived by adding a predetermined correction value to the control value and the output value of the output detection section output in the first output mode when the shift from the first output mode to the reach control mode is made can be conceived. When the control value obtained by this method eventually becomes the same as the control value obtained by subtracting the second correction value from the control value stored in the storage section or the correction value such that the output value obtained by correcting the output value of the output detection section stored in the storage section with the second correction value can be gained, the induction heater which carries out such a method falls within the technical scope of the present invention.

In the above mentioned induction heater in accordance with another aspect of the present invention, in the case where the set target output value is greater than a predetermined value, the control section does not lower the output even when the first movement detection section or the second movement detection section detects the movement of the object.

For example, in the case of carrying out fry cooking with high heating power (the set output value is high), even when a movement of the object is detected, the induction heater of the present invention carries on the usual operation. For example, in the case of simmering stew gently with low heating power (the set output value is low), when a movement of the object resulting from the repelling magnetic field is detected, the safety function is activated as usual. As a result, induction heater which is suitable for the usage, safe, and makes it possible for the user to, for example, carry out frying cooking moving the frying pan, thereby providing the ease of use can be obtained.

An induction heater in another aspect of the present invention comprises an inverter including an induction heating coil which produces a high-frequency magnetic field to heat an object to be heated, a control section for controlling the output of the inverter, and a movement detection section which detects a state of operation of the inverter or a state of the object until the output of the induction heating coil increases gradually from a low output to a predetermined output to detect a movement of the object, wherein when the movement detection section performs the movement detection operation for detecting the movement of the object, the control section performs the output limiting operation for limiting the output of the induction heating coil to a value lower than the value when the movement thereof has been detected or stopping the heating, afterwards, repeats at least once the process of canceling the output limiting operation, increasing the output gradually again, performing the movement detection operation, and performing the output limiting operation, and when detecting that the movement detection operation is repeated with approximately the same output changes, the control section determines that the movement of the object has been caused by the high-frequency magnetic field produced by the induction heating coil, thereby limiting the output of the induction heating coil thereafter to the output lower than the output when the movement detection section has detected the movement of the object to carry out heating.

For example, when the object left untouched on the top of the induction heating coil starts to move by the action of the magnetic field produced by the induction heating coil while it is being heated, power to be supplied to the object and the induction heating coil should be limited. For example, when the user carries out cooking moving the object up and down or from side to side slightly and quickly, with his/her hand, power to be supplied to the object and the induction heating coil should not be limited. The inventor of the present invention has found out that, when one carries out cooking moving the object, a float of the object occurs irregularly, while a movement thereof resulting from the repelling magnetic field occurs relatively regularly. The induction heater of the present invention makes use of this phenomenon to detect only the movement of the object resulting from the repelling magnetic field. The present invention realizes a safe and user-friendly induction heater wherein, when one carries out cooking moving a frying pan, the situation where the safety function is erroneously activated to interfere with cooking does not occur, whereas when the object is moved by the repelling magnetic field, the safety function is appropriately activated.

According to the present invention, an appropriate distinction can be made between the case where one moves the object during cooking and the case where the object moves by the action of the magnetic field produced by the induction heating coil. In the case where one moves the object, the output of the induction heating coil is not limited, so that the inconvenience when the user carries out cooking is eliminated or mitigated.

In addition, when the movement detection operation is performed, even the slightest movement of the object is caused, so that if this operation is continued without limitation, the object can move little by little. In the configuration mentioned above, when determining that the object left untouched is moving, the control section stops the movement detection, so that such a situation can be avoided. The present invention realizes an induction heater which accurately detects a critical value at which the object starts to move. The specific movement detection method of the movement detection section is arbitrary.

In the above mentioned induction heater in accordance with another aspect of the present invention, the control section samples the output values of the inverter, the control values output by the control section, or the weight of the object when the movement detection section detected a movement of the object a plurality of times, and based on a plurality of values obtained through the sampling, determines whether or not the movement of the object has been caused by the high-frequency magnetic field produced by the induction heating coil.

It is possible to detect accurately and easily that the repetition of the movement detection operation is made with approximately the same output variation.

In the induction heater of the present invention having the movement detection section for detecting a movement of the object based on the output value of the inverter (for example, the output value of the detection section for detecting the input current of the inverter or the current flowing into the induction heating coil) or the control value output by the control section, the control section detects the movement of the object based on the result of the detection (output) of the movement detection section used for another control operation. The present invention realizes an inexpensive, safe and user-friendly induction heater.

In the above mentioned induction heater in accordance with another aspect of the present invention, the control section compares a plurality of values obtained through sampling or performs the calculation thereamong, and when determining that a plurality of these values are approximately the same, the control section determines that the object has been moved by the high-frequency magnetic field produced by the induction heating coil.

For example, by using a microcomputer, an inexpensive, safe and user-friendly induction heater can be obtained.

In the above mentioned induction heater in accordance with another aspect of the present invention, the control section detects the time required for the repetition of the movement detection operation and, according to the change of the time, determines whether or not a movement of the object has been caused by the high-frequency magnetic field produced by the induction heating coil. It is possible to detect by an accurate, easy, and inexpensive method that the repetition of the movement detection operation is made with approximately the same output variation.

For example, by measuring input and output waveshapes, the time required for the repetition may be measured.

In the above mentioned induction heater in accordance with another aspect of the present invention, the control section measures the repetition period of the movement detection operation a plurality of times, compares a plurality of values obtained by measurement or performs the calculation thereamong, and when a plurality of values are approximately the same, the control section determines that the object has been moved by the high-frequency magnetic field produced by the induction heating coil.

For example, by using a microcomputer, an inexpensive, safe and user-friendly induction heater can be obtained.

In the above mentioned induction heater in accordance with another aspect of the present invention, when detecting that the movement of the object has been caused by the user's operation after having performed the output limiting operation based on the result of the detection done by the movement detection section, the control section cancels the output limiting operation to increase the output of the induction heating coil to a predetermined output.

When the object left untouched is moved by the magnetic field produced by the induction heating coil, the voltage to be applied to the induction heating coil is limited, whereby the object is prevented from continuing to move as much as possible. When the user moves the object, the limited power for stopping the movement of the object is changed into the high power, the setting of which is input by the user. As a result, a safe and user-friendly induction heater which fully exercises the heating ability when the user is moving the object can be obtained. When the user moves the object in the cooking such as fry cooking, it is possible to secure the sufficient output of the heating coil. When a movement resulting from the magnetic field produced by the heating induction coil is further caused while the user is moving the object, the user holds the object (for example, a frying pan), so that a safety problem hardly arises.

The above mentioned induction heater in accordance with another aspect of the present invention has a display section for providing a display corresponding to the output set by a user, wherein even when the control section starts the output limiting operation based on the result of the detection done by the movement detection section, the display section maintains the display corresponding to the set output, whereas after determining that the movement of the object has been caused by the high-frequency magnetic field produced by the induction heating coil, the control section reduces the output to be displayed to the output lower than the displayed output corresponding to the output.

Generally, a certain amount of time is required from when a movement of the object is detected until it is determined whether the movement results from the magnetic field produced by the induction heating coil or the user is moving the object. In the present invention, only when it is determined that the movement of the object has been caused by the high frequency magnetic field, the display is changed (for example, the displayed output level is lowered), whereas until the determination is made, the display is not changed. A user-friendly induction heater can be obtained which is free from the trouble that the output display corresponding to the inverter output set by the user (which corresponds to the heating coil output or power consumption) is unnecessarily changed so that the user is unnecessarily given a sense of unease.

In the above mentioned induction heater in accordance with another aspect of the present invention, according to the change of the output of the inverter, the control value output by the control section or the weight of the object with time, the movement detection section detects a movement of the object resulting from the high-frequency magnetic field produced by the induction heating coil.

The present invention realizes an inexpensive induction heater which detects a movement of the object with the simple configuration. Especially, in the induction heater of the present invention which detects a movement of the object resulting from the high frequency magnetic field in response to the change in the output value of the inverter (for example, the output value of the detection section for detecting the input current of the inverter or the current flowing into the induction heating coil) or the control value output by the control section with time, the movement of the object is detected based on the result of the detection (output) of the movement detection section used for another control operation, so that a dedicated detection section is not required.

An induction heater in accordance with another aspect of the present invention comprises an induction heating coil which produces a high-frequency magnetic field to heat an object to be heated, an inverter circuit which supplies a high-frequency current to the induction heating coil; an input section for making a setting of the heating, a movement detection section for detecting a movement of the object and a control section which controls the output of the inverter circuit, and when the movement detection section detects a movement of the object, performs the limiting operation to stop or limit the output of the inverter circuit, wherein according to the settings at the input section, the detection sensitivity of the movement detection section is decreased or the detection thereof is stopped, or the limiting operation of the control section is weakened or is not performed.

In the present invention, for example, when the setting where the object (the load) can frequently be moved by the user is made, or when the setting where the movement detection section for detecting a movement of the object can often makes an erroneous determination is made, the function of the movement detection section for detecting a movement of the object is automatically suppressed or disabled. The present invention realizes a user-friendly induction heater wherein the safety function against the movement of the load is provided, whereas for example, when the cooking such as fry cooking where the load can frequently be moved is carried out, there never or hardly occurs a reduction or a stop of the heating power so that the user can carry out cooking appropriately.

Alternatively, in the present invention, by making a specific setting as needed, the function of the movement detection section for detecting a movement of the object can be suppressed or disabled.

As a result, the inconvenience that the safety function based on the detection of a movements of the object is activated where inappropriate to interfere with cooking is eliminated or mitigated. A user-friendly induction heater can be obtained.

In the case wherein induction heating is carried out by using a non-magnetic and low-resident load such as a pan, a frying pan or a heating plate made of aluminum, the load is light in weight, so that when the item to be cooked is small in amount, a buoyant force is exerted on the load by the repelling magnetic field against the induction heating, the load floats or floats to move sideways. If such a phenomenon occurs during cooking, the load is moved from the center of the source of heating, whereby the heating efficiency can be reduced or that the load can move to hit another object, thereby doing a damage thereto. In order to prevent this, for such a load, the movement detection section for detecting a movement of the load is provided, and when the movement detection section detects a float thereof, control is exerted so as to stop the output of the source of induction heating or lessen the float.

However, the required heating output varies according to the cooking menu (for example, fry cooking or stew cooking). The frequency with which the load (pan) is moved and the amount of movement thereof when the user carries out cooking vary.

The movement detection section for the load can automatically make a distinction whether the load has floated spontaneously or the user standing in front of the induction heater has moved the load to some extent, but there is a limit thereto. The movement detection section for the load may make an erroneous detection. Therefore, in the present invention, when the user sets the output at a high output level or makes the setting for the cooking menu involving the human-caused movements of the load (for example, fry cooking), the movement detection section for the load is disabled and the source of heating is allowed to output the heating power necessary for the cooking regardless of the movements of the load.

For example, the case where cooking is performed by the use of a 2 KW induction heating cooker intended for home use will be described. It is assumed that the cooking menu is Chinese fried rice prepared by using a frying pan. For the preparation of the Chinese fried rice in this cooker, heating at approximately 1500 W is appropriate. Therefore, the heating output is set to 1500 W.

Alternatively, when there is a key such as "fry cooking" appropriate to the Chinese fried rice, by operating the key, the heating output is set to 1500 W. It is a matter of course that, when the induction heating cooker does not have the heating output equivalent to 1500 W, the heating output in the vicinity of 1500 W will suffice. When the cooking proceeds and the user moves a frying pan in order to turn over the item being cooked, the load movement detection operates, thereby reducing the heating output, for example, to 500 W. It is impossible to finish up the Chinese fried rice with 500 W of heating output. In the present invention, however, when the output setting of 1500 W or "fry cooking" is made, the function of the load movement detection is deactivated. As a result, even when the user carries out cooking moving the frying pan, 1500 W of heating power is secured, whereby the Chinese fried rice is successfully completed. Alternatively, when the output setting of 1500 W or "fry cooking" is made, the degree to which the heating output is limited based on the load movement detection is made smaller than in the usual setting (the setting other than mentioned above). For example, when a movement of the load is detected, the heating output is reduced from 1500 W to 1300 W. Even after the movement of the load is detected, the heating power necessary for preparation of the Chinese fried rice is secured.

The cooker may be configured so that it is difficult to detect the movement of the load, for example, that the detection of the load movement is not be carried out unless the movement of the frying pan is exceptionally big, whereby the heating power practically necessary for preparation of the Chinese fried rice is secured.

The settings in the operation unit (the input section) according to the present invention includes the cooking menu (such as fry cooking, stew cooking or boiling water) selected to carry out cooking, or the heating power selected (set) to carry out cooking or time-series combination of predetermined levels of heating power when automatic cooking is carried out.

In the above mentioned induction heater in accordance with another aspect of the present invention, the input section has a heating output setting section for setting heating output, and according to the heating output set at the heating output setting section, the detection sensitivity of the movement detection section is decreased or the detection thereof is stopped, or the limiting operation of the control section is weakened or is not performed.

According to the magnitude of the heating output, the probability that the movement detection section for the object makes an erroneous determination may vary or the frequency with which the load is moved by the user may vary. With the configuration mentioned above, the inconvenience that the safety function based on the detection of a movement of the object is activated where inappropriate, thereby interfering with the cooking is eliminated or mitigated. The user-friendly induction heating is obtained.

In the above mentioned induction heater in accordance with another aspect of the present invention, when the set value of the heating output at the heating output setting section becomes equal to or greater than a predetermined value, the detection sensitivity of the movement detection section is decreased or the detection thereof is stopped, or the limiting operation of the control section is weakened or is not performed.

With this configuration, when one carries out cooking with low heating power as in stew cooking, if the object moves, the safety function of lowering the heating power is activated, whereas, when one carries out cooking moving the object with high heating power, for example, as in the fry cooking, the safety function based on a movement of the object is reduced or disabled so that cooking can always be done with high heating power.

In the above mentioned induction heater in accordance with another aspect of the present invention, when the movement detection section detects a movement of a load, according to the settings of the input section, selection between the continuation of the heating output and the stop thereof is made.

With this configuration, according to the settings of the input section, for example, in the cooking required to be done with high heating power, the heating power is preferentially maintained, whereas, when cooking is done with low heating power, priority is given to the safety. A user-friendly induction heater can be obtained.

In the above mentioned induction heater in accordance with another aspect of the present invention, when a setting section which the input section has in addition to the heating output setting section is used, the detection sensitivity of the movement detection section is decreased or the detection thereof is stopped, or the limiting operation of the control section is weakened or is not performed.

At the setting section except the heating output setting section (the setting input section related to the item irrelevant to the heating output), the operation to suppress or disable the safety function based on the detection of a movement of the object (load) is performed. The operation to suppress or disable the safety function based on the detection of a movement of the object (load) is easy to understand for users. The user can perform the operation arbitrarily as needed.

In the above mentioned induction heater in accordance with another aspect of the present invention, when a change input section provided independently in the input section is used, the detection sensitivity of the movement detection section is decreased or the detection thereof is stopped, or the limiting operation of the control section is weakened or is not performed.

The change input section is independently provided, so that the operation to suppress or disable the safety function based on the detection of a movement of the object (load) becomes easy to understand, whereby ease-of-use is provided.

In the above mentioned induction heater in accordance with another aspect of the present invention, the change input section has a fry cooking selection section for carrying out fry cooking, and when the "fry cooking" is selected, the detection sensitivity of the movement detection section is decreased or the detection thereof is stopped, or the limiting operation of the control section is weakened or is not performed.

Generally speaking, the frequency with which the user carries out fry cooking is high, and in the fry cooking, the user carries out cooking moving the object. In the fry cooking, by suppressing or disabling the safety function based on the detection of a movement of the object, the user-friendly induction heater can be obtained.

An induction heater in accordance with another aspect of the present invention comprises an induction heating coil which produces a high-frequency magnetic field to heat an object to be heated, an inverter circuit which supplies a high-frequency current to the induction heating coil, an output detection section for detecting the magnitude of the output of the inverter circuit, a movement detection section for detecting a movement of the object, a control section for controlling the output of the inverter circuit in response to the output of the output detection section and the output of the movement detection section, and a movement detection stop input section for inputting a stop command to stop the detection operation of the movement detection section or to make the control section stop controlling the output in response to the output of the movement detection section.

The induction heater is configured so as not to detect a slippage or a float of the item being cooked when the user carries out cooking moving the object such as a frying pan. As a result, the average power applied to the induction heating coil increases as compared with that in the case where the safety function based on a movement of the object is activated. The present invention realizes a user-friendly and safe induction heater which makes it possible to complete cooking properly in a short time when the user carries out the cooking moving the object. When the user, for example, carries out cooking moving a light weight frying pan made of non-magnetic material such as aluminum, the safety function based on a movement of the object can be stopped. As a result, the user can carry out cooking moving the frying pan without reducing the heating power.

The above mentioned induction heater in accordance with another aspect of the present invention has a first timer section which starts timing in association with the input operation to the movement detection stop input section, wherein until a predetermined time period elapses after the first timer section starts timing, the control section performs control regardless of whether the object has moved or not.

Only when the user consciously performs an input operation to the movement detection stop input section (for example, pushes a key switch), in other words, only when the user is in front of the induction heater, the safety function based on a movement of the object is stopped. After the lapse of a predetermined time period, the safety function based on a movement of the object automatically becomes operative again, so that, when the user is not in front of the induction heater, the safety function is operative again. Since the user does not have to perform the operation to enable the safety function again, the trouble that the user forgets to restore the setting (enable the safety function again) so that the object left untouched is moved by the magnetic field of the induction heating coil (for example, stew spills) hardly occurs. The induction heater which is safe and is capable of stopping the safety function as needed to thereby provide ease of use can be obtained.

The first timer section starts timing, for example, when the input operation is performed or when predetermined processing is performed after the input operation and the processing is completed.

An induction heater in accordance with another aspect of the present invention comprises an induction heating coil which produces a high-frequency magnetic field to heat an object to be heated, an inverter circuit which supplies a high-frequency current to the induction heating coil, an output detection section for detecting the magnitude of the output of the inverter circuit, a movement detection section for detecting a movement of the object, a control section for controlling the output of the inverter circuit in response to the output of the output detection section and the output of the movement detection section, and an output fixation input section for inputting an output fixation command, wherein when the output fixation command is input, the control section fixes the output of the inverter circuit regardless of whether the object has moved or not.

When the user carries out cooking moving the light-weight object to be heated such as a frying pan, the situation where the safety function based on a movement of the object is inappropriately activated to interfere with the cooking activity does not occur, whereby the user can carry out cooking with the fixed power. When the object is heated with the power fixed, as compared with when the safety function based on a movement of the object is activated, the average power applied to the induction heating coil increases. The present invention realizes a user-friendly and safe induction heating which makes it possible to complete cooking properly in a short time when the user carries out cooking moving the object.

The above mentioned induction heater in accordance with another aspect of the present invention has a second timer section which starts timing in association with the input of the output fixation command to the output fixation input section, wherein when the time measured by the second timer section becomes equal to or longer than a predetermined time period, the control section cancels the fixation of the output of the inverter circuit.

Only when the user consciously performs the input operation to the output fixation input section (for example, when the user pushes a key switch), in other words, only when the user is in front of the induction heater, the safety function based on a movement of the object is stopped, and the fixed power is output. After the lapse of a predetermined time period, the safety function based on a movement of the object becomes operative again, so that the induction heater is highly safe. The induction heater which is safe and is capable of stopping the safety function as needed to thereby provide ease of use can be obtained.

In the above mentioned induction heater in accordance with another aspect of the present invention, the control section fixes the output of the inverter circuit only while the output fixation input section inputs the output fixation command. When the user stops the input operation to the output fixation input section (for example, stops pushing the key switch,) (which inevitably occurs when the user moves away from the front of the induction heater), the safety function which works based on the movement of the object is stopped, so that the induction heater configured as mentioned above is highly safe.

The above mentioned induction heater in accordance with another aspect of the present invention has an fixed output setting section for adjusting the output of the inverter circuit to be fixed at the output fixation input section. When the fixed output is output, the user can adjust the heating power. A user-friendly and safe induction heater is obtained.

Each embodiment of the present invention will be described below with reference to the drawings.

<<Embodiment 1>>

Figure 2:
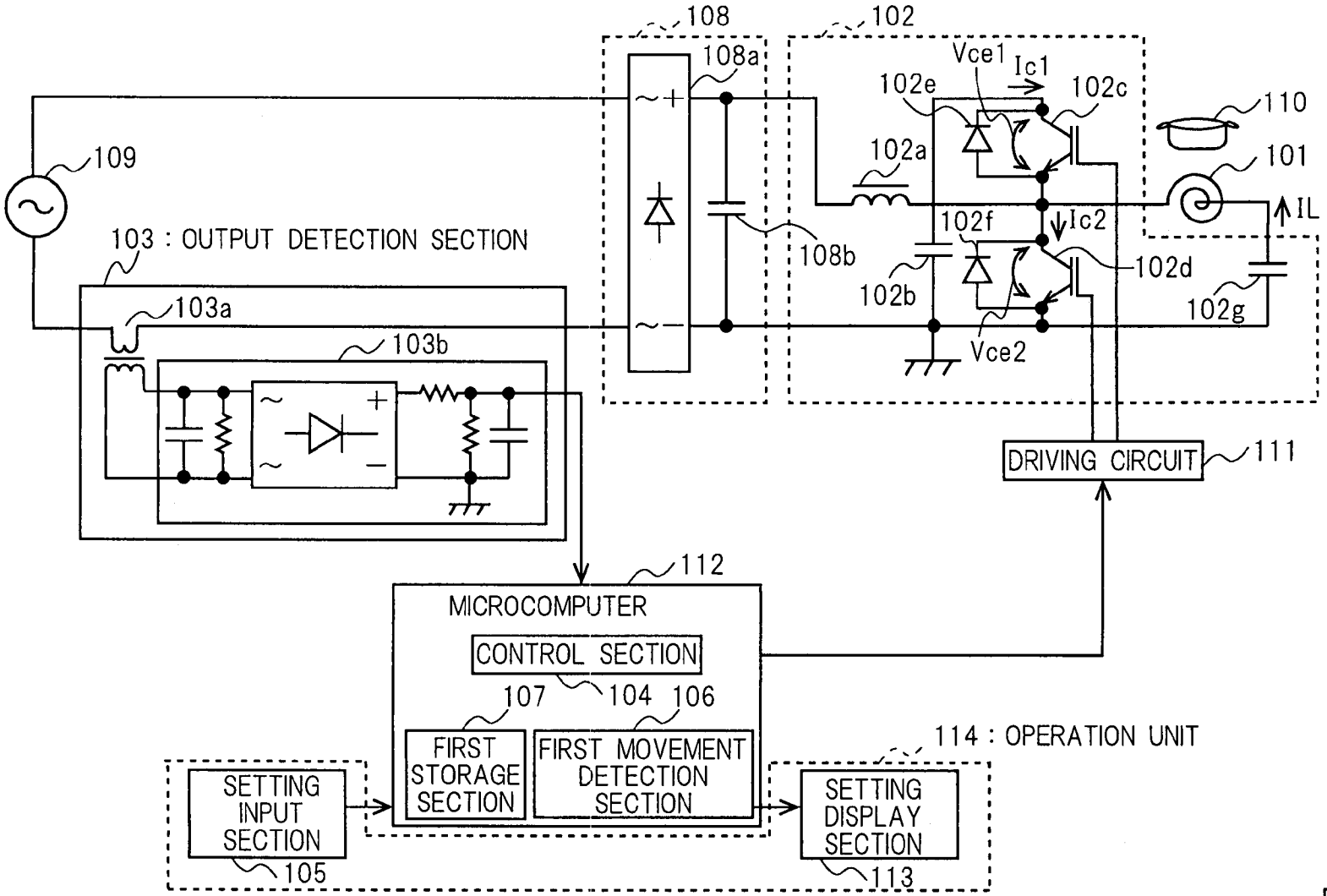
FIG. 2 is a specific circuit diagram of the induction heater in accordance with Embodiments 1 and 2 of the present invention.

With reference to FIG. 1 to FIG. 6, an induction heater (induction heating cooker) in accordance with Embodiment 1 of the present invention will be described. The induction heater in accordance with the present embodiment can heat containers made of non-magnetic metal such as aluminum or copper. FIG. 1 shows a block diagram of the induction heater in accordance with Embodiment 1. FIG. 2 shows a circuit diagram specifically showing the principal part thereof. In FIG. 1 and FIG. 2 in accordance with Embodiment 1, the numeral 110 represents an object to be heated (a load which is a metal container such as a pan or a frying pan), the numeral 101 represents an induction heating coil which generates a high frequency magnetic field to heat the object 110, the numeral 109 represents a commercial AC power source, the numeral 108 represents a rectifying-smoothing section for rectifying the commercial AC power source, the numeral 102 represents an inverter circuit for converting the power source rectified by the rectifying smoothing section 108 into high-frequency power to supply a high-frequency current to the induction heating coil 101, the numeral 111 represents a driving circuit for driving the inverter circuit 102, the numeral 103 represents an output detection section for detecting the magnitude of the output of the inverter circuit 102, the numeral 112 represents a microcomputer, and the numeral 114 represents an operation unit.

The microcomputer 112 has a control section 104, a first movement detection section 106, and a first storage section 107, and the functions of these blocks are carried out by software. The first storage section 107 is internal RAM of the microcomputer 112(Random Access Memory).

The operation unit 114 has a setting input section 105, and a setting display section 113 for displaying the set output of the induction heater.

Figure 56:
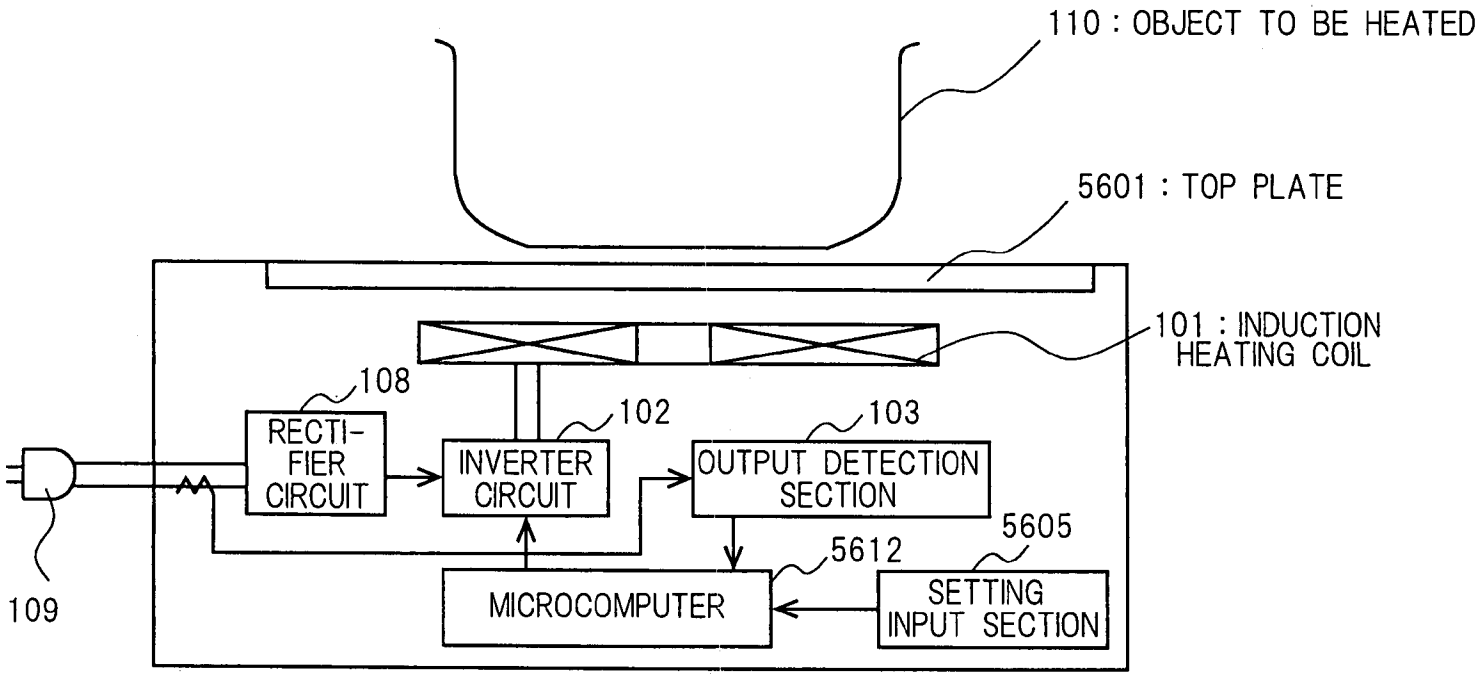
FIG. 56 is a view showing a configuration of an induction heater in accordance with prior art example 2.
Figure 57:
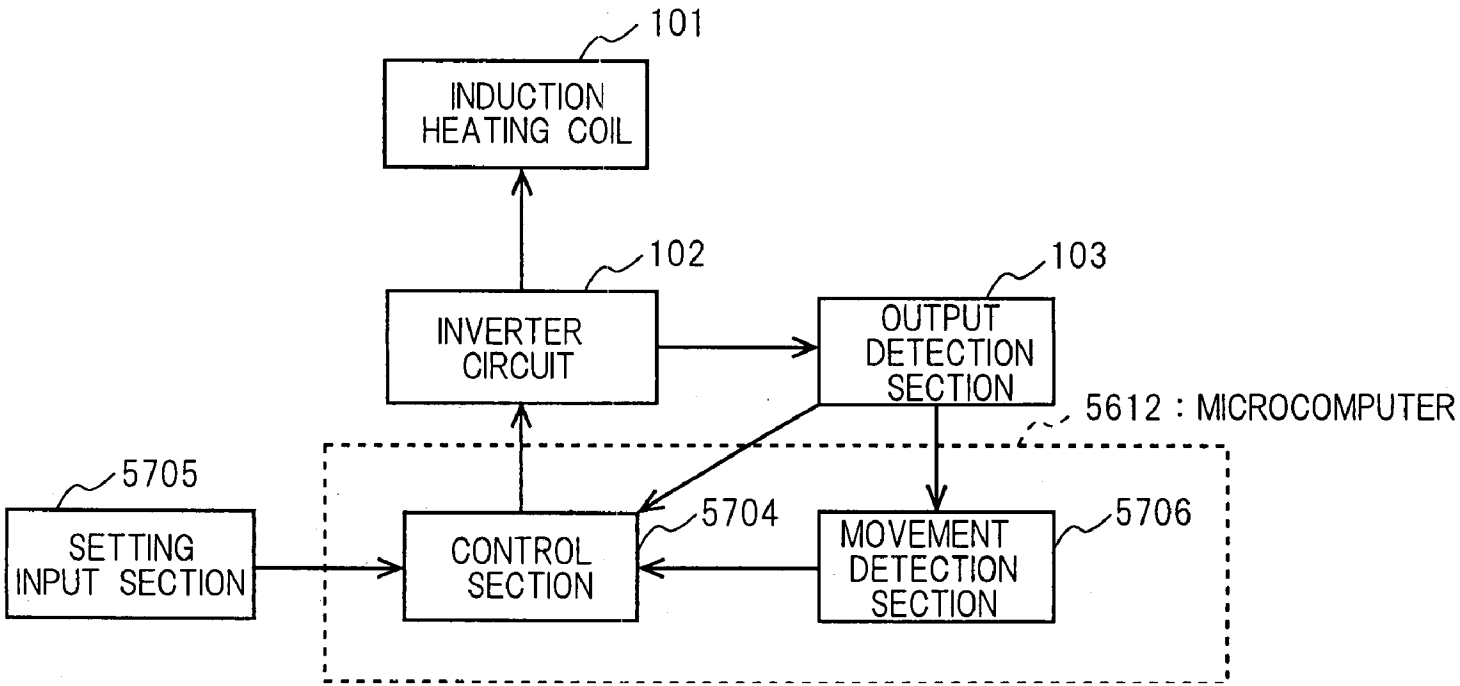
FIG. 57 is a block diagram showing a configuration of the induction heater in accordance with prior art example 2.
Figure 58:
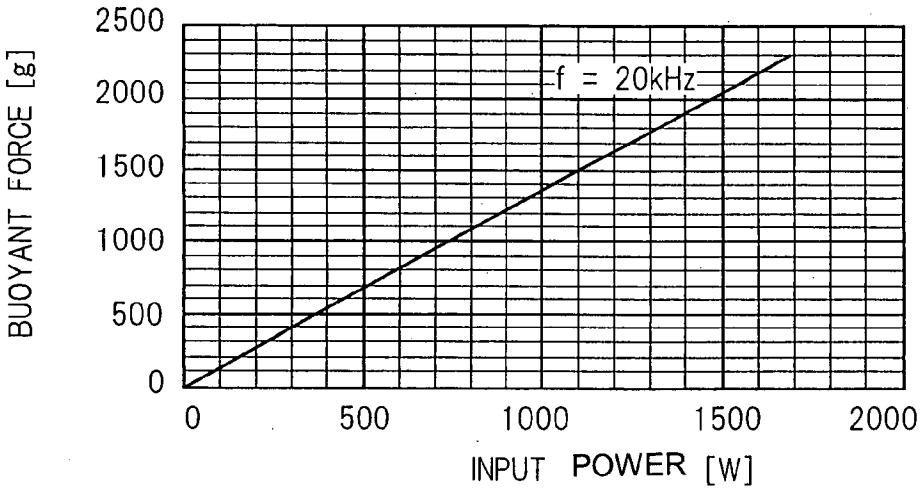
FIG. 58 is a view showing a correlation between input power and buoyant force in the induction heater.

The induction heater in accordance with Embodiment 1 has a similar structure (shown in FIG. 56) to that of the induction heater in accordance with prior art example 2. The operation unit 114 is provided on the front of a housing. Each of the other blocks is stored in the housing. The object 110 is put on a ceramic top plate having a thickness of 4 mm placed on the top of the housing.

The setting input section 105 has a plurality of input key switches which a user operates in order to input a command to set a heating output, or a command to start or stop heating. In the heating output setting, a target output of the control section 104 is set. In the embodiment, the target output is an input current value of the inverter circuit 102. The setting input section 105 is connected to the control section 104. The command input by the setting input section 105 is input to the control section 104.

The setting display section 113 is connected to the control section 104. The control section 104 controls the setting display section 113. The setting display section 113 displays the heating output settings and so on set through the setting input section 105 toward the user.

Figure 4:
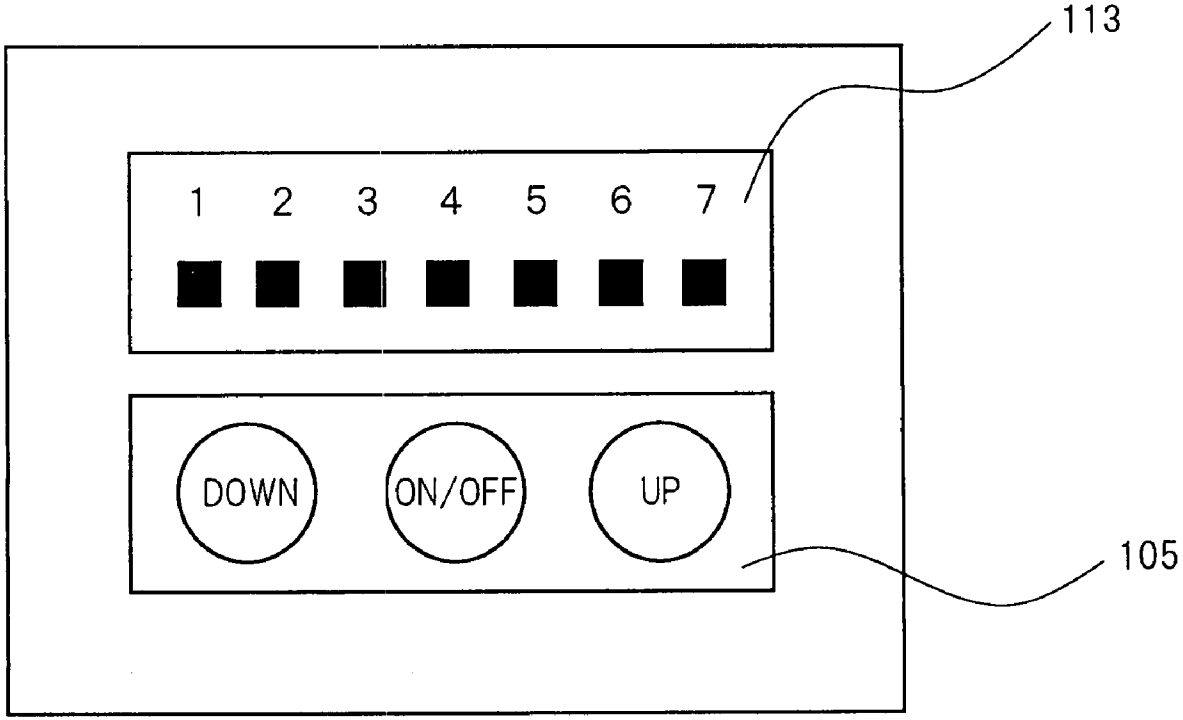
FIG. 4 is a plan view of the principal part of an operation unit of the induction heater in accordance with Embodiments 1 and 2 of the present invention.

FIG. 4 is a plan view of the principal part showing a configuration of the operation unit 114 of the induction heater in accordance with the present embodiment. The setting input section 105 has an ON/OFF key switch for inputting an inverter start/stop command, a DOWN key switch and an UP key switch for setting the heating power of the inverter (for making the output level of the heating power go down and up). The setting display section 113 has seven visible LEDs (light-emitting diodes) in one-to-one correspondence with the number markings from 1 to 7. Upon start-up of the inverter, the LEDs corresponding to the set output level of the heating power light up. In the embodiment, when the output level of the heating power is the i level ($1 \leqq i \leqq 7$), i LEDs in one-to-one correspondence with the numbers 1 to i light up.

The first movement detection section 106 detects a movement (including slipping and floating) of the object 110.

The control section 104 controls the output of the inverter circuit 102 through the driving circuit 111 in response to the various commands input from the setting input section 105, an output signal from the output detection section 103 (a signal corresponding to the power source current of the inverter circuit 102), and an output signal from the first movement detection section 106. The heating output is varied by controlling the driving frequency of switching elements.

When the first movement detection section 106 does not detect the movement of the object 110, the control section 104 exercises control so that the output of the output detection section 103 (power source current) becomes equal to a set target current value (referred to as a stable control mode).

When the first movement detection section 106 detects the movement of the object 110, the control section 104 outputs the control value stored by the first storage section 107 (referred to as a first output fixation mode).

The commercial power source 109 is input to the rectifying-smoothing section 108. The rectifying-smoothing section 108 has a full-wave rectifier 108*a* comprising bridge diodes and a first smoothing capacitor 108*b* connected between DC output terminals thereof.

The input terminals of the inverter circuit 102 are connected one to either end of the first smoothing capacitor 108*b* (output terminals of the rectifying-smoothing section 108). The induction heating coil 101 is connected to output terminals of the inverter circuit 102. The inverter circuit 102 and the induction heating coil 101 constitutes a high frequency inverter. The inverter circuit 102 is provided with a series connection of a first switching element 102*c* (in the present embodiment, IGBT (Insulated Gate Bipolar Transistor)) and a second switching element 102*d* (in the present Embodiment IGBT) (referred to as a series-connection of 102*c* and 102*d*). A first diode 102*e* is connected with the first switching element 102*c* in the opposite direction and in parallel, while a second diode 102*f* is connected with the second switching element 102*d* in the opposite direction and in parallel. A smoothing capacitor 102*b* is connected to each end of the series connection of 102*c* and 102*d*.

A choke coil 102*a* is connected between the point of connection of the first switching element 102*c* to the second switching element 102*d* (referred to as "the midpoint of the series connection of 102*c* and 102*d*") and the positive terminal of the full-wave rectifier 108*a*. The low potential terminal of series connection of 102*c* and 102*d* is connected to the negative terminal of the full-wave rectifier 108*a* (in the embodiment, the ground terminal). A series connection of the induction heating coil 101 and a resonant capacitor 102*g* is connected between the midpoint of the series connection of 102*c* and 102*d* and the negative terminal of the full-wave rectifier 108*a*.

The output detection section 103 has a current transformer 103*a* and a power source current detection section 103*b*. The current transformer 103*a* detects the current which the inverter circuit 102 inputs from the commercial power source 109 (input power source current) and outputs a detection current to the power source current detection section 103*b*. The power source current detection section 103*b* outputs the detection signal proportional to the magnitude of the power source current (which is equivalent to the output value of the inverter circuit 102, and detection signal is abbreviated as "power source current") to the control section 104 and the first movement detection section 106.

The first movement detection section 106 detects a movement (including slipping and floating) of the object 110 based on the change in the power source input current of the inverter circuit 102 to transmit the movement detection information to the control section 104. The method by which the first movement detection section 106 detects the movement (including slipping and floating) of the object 110 is the same as the detection method of the movement detection section 5706 in accordance with prior art example 2.

The control section 104 drives the first switching element 102*c* and the second switching element 102*d* through the driving circuit 111.

The operation of the induction heating; cooker configured as mentioned above will be described. The full-wave rectifier 108*a* rectifies the commercial AC power source 109. The first smoothing capacitor 108*b* supplies power to the high frequency inverter having the inverter circuit 102 and the induction heating coil 101.

Figure 3:
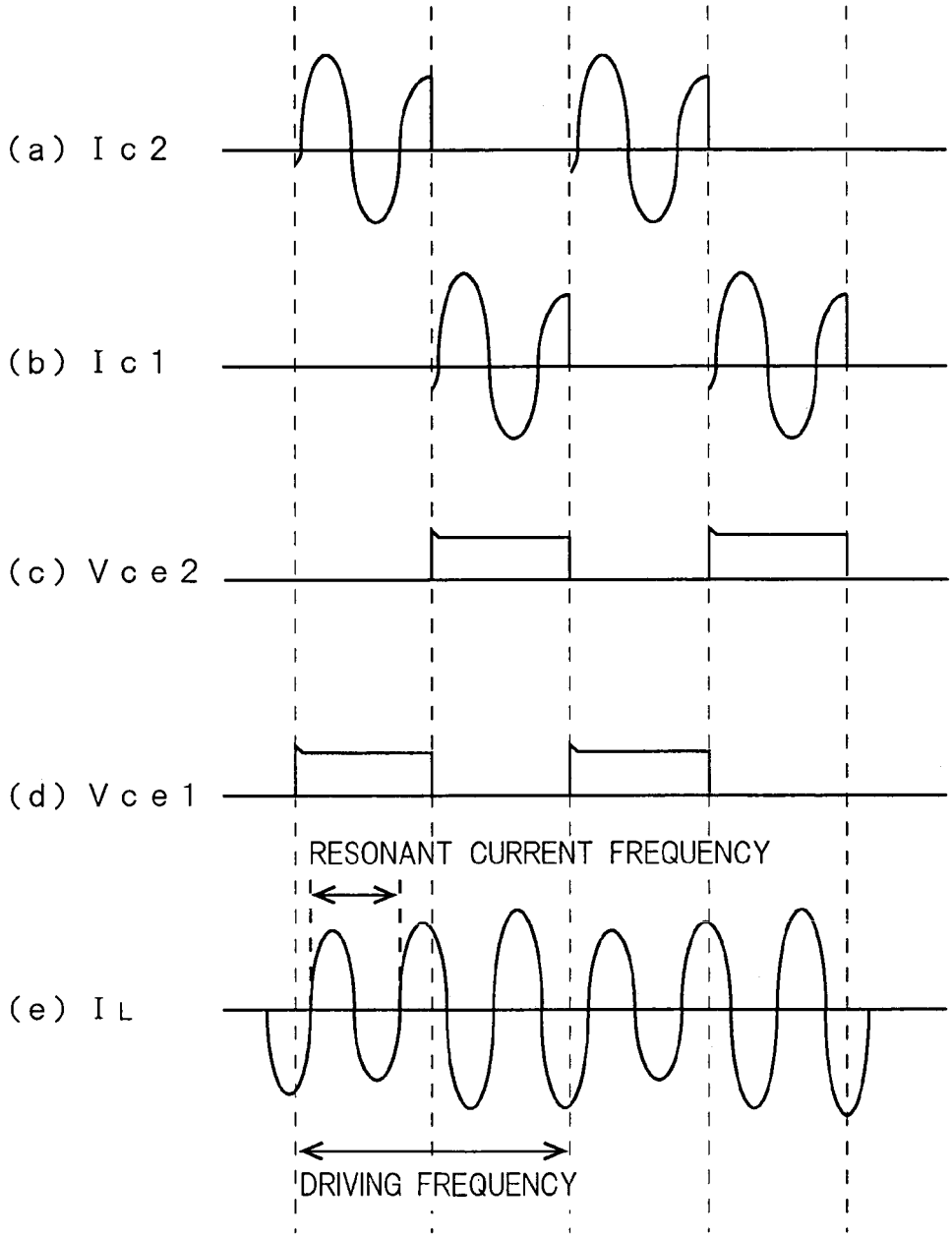
FIG. 3 is a view showing a waveform of each part of the induction heater in accordance with Embodiments 1 and 2 of the present invention.

FIG. 3 shows the waveforms of the individual parts in the present embodiment. Waveform (a) represents a waveform Ic2 of a current flowing into the second switching element 102*d* and the second diode 102*f*. Waveform (b) represents a waveform Ic1 of a current flowing into the first switching element 102*c* and the diode 102*e*. Waveform (c) represents a voltage Vce2 generated between collector and emitter of the second switching element 102*d*. Waveform (d) represents the voltage Vce1 generated between collector and emitter of the first switching element 102*c*. Waveform (e) represents a current IL flowing into the induction heating coil 101.

When the second switching element 102*d* is on, the resonance current flows into a closed circuit including the second switching element 102*d* (or the second diode 102*f*), the induction heating coil 101, and the resonant capacitor 102*g*, and energy is stored in the choke coil 102*a*. When the second switching element 102*d* is turned off, the stored energy is released to the second smoothing capacitor 102*b* via the first diode 102*e*.

After the second switching element 102*d* is turned off, the first switching element 102*c* is turned on, whereby the current flows into the first switching element 102*c* and the first diode 102*e*.

The resonance current flows into a closed circuit including the first switching element 102*c* (or the first diode 102*e*), the induction heating coil 101, the resonant capacitor 102*g*, and the second smoothing capacitor 102*b*.

The driving frequency of the first switching element 102*c* and the second switching element 102*d* is varied in the vicinity of 20 kHz. When the magnetic object to be heated (typically, an iron cooking container) is heated, a high-frequency current of about 20 kHz flows into the induction heating coil 101. The driving time ratio of the first switching element 102*c* and the second switching element 102*d* is varied in the vicinity of, respectively one seconds as shown in FIG. 3. When the object (a cooking pan) 110 which is made of a designated material (for example, a non-magnetic material having high conductivity such as aluminum) and is of standard size (for example, the diameter of which is equal to or larger than the diameter of the induction heating coil) is placed on a designated position on the top plate (for example, the position indicated as a part for heating), the impedance of the induction heating coil 101 and the resonance capacitor 102*g* is set so that the resonance frequency is about three times the driving frequency. Therefore, in this case, the resonance frequency is set to be about 60 kHz.

If the object 110 is made of aluminum, the high frequency current of about 60 kHz which is higher than usual flows through the induction heating coil 101, so that the cooking pan 110 can be efficiently heated. Since the regenerative current which flows into the first diode 102*e* and the second diode 102*f* does not flow into the first smoothing capacitor 108*b* but is supplied to the second smoothing capacitor 102*b*, the high-frequency inverter of the present embodiment has high heat efficiency.

By the second smoothing capacitor 102*b*, the envelope of the high-frequency current supplied to the induction coil 101 is smoothed more than in the prior art induction heaters. As a result, commercial frequency components of the current IL flowing into the induction heating coil 101, which is responsible for the vibration sounds being generated from the pan 110 and so on at the time of heating, are reduced.

The high-frequency inverter of the present Embodiment has a characteristic that, in the case where it operates under certain driving conditions (such as a frequency and a driving time ratio), if the magnetic coupling between the cooking pan 110 and the induction heating coil 101 is reduced, the input power (current IL) of the induction heating coil 101 drops.

The control section 104 inputs an output signal (an output value of the inverter circuit 102) proportional to the magnitude of the power source current of the induction heater (the power source current of the inverter circuit 102) from the output detection section 103, and exercises control so that the magnitude of the signal reaches a target value. By varying the drive frequency of the first switching element 102*c* and the second switching element 102*d*, or varying the driving time ratio between both the switching elements, the control section 104 exercises controls so that the input power of the induction heating coil 101 (the output value of the high-frequency inverter) reaches a target value.

The high-frequency inverter of the present embodiment (including the inverter circuit 102 and the induction heating coil 101) has a characteristic that, in the case where it operates under certain driving conditions (such as a frequency and a driving time ratio), if the magnetic coupling between the object 110 and the induction heating coil 101 is reduced, the input power (current IL) of the induction heating coil 101 drops (the detailed description of this phenomenon is made in the description of prior art example 2).

Figure 5:
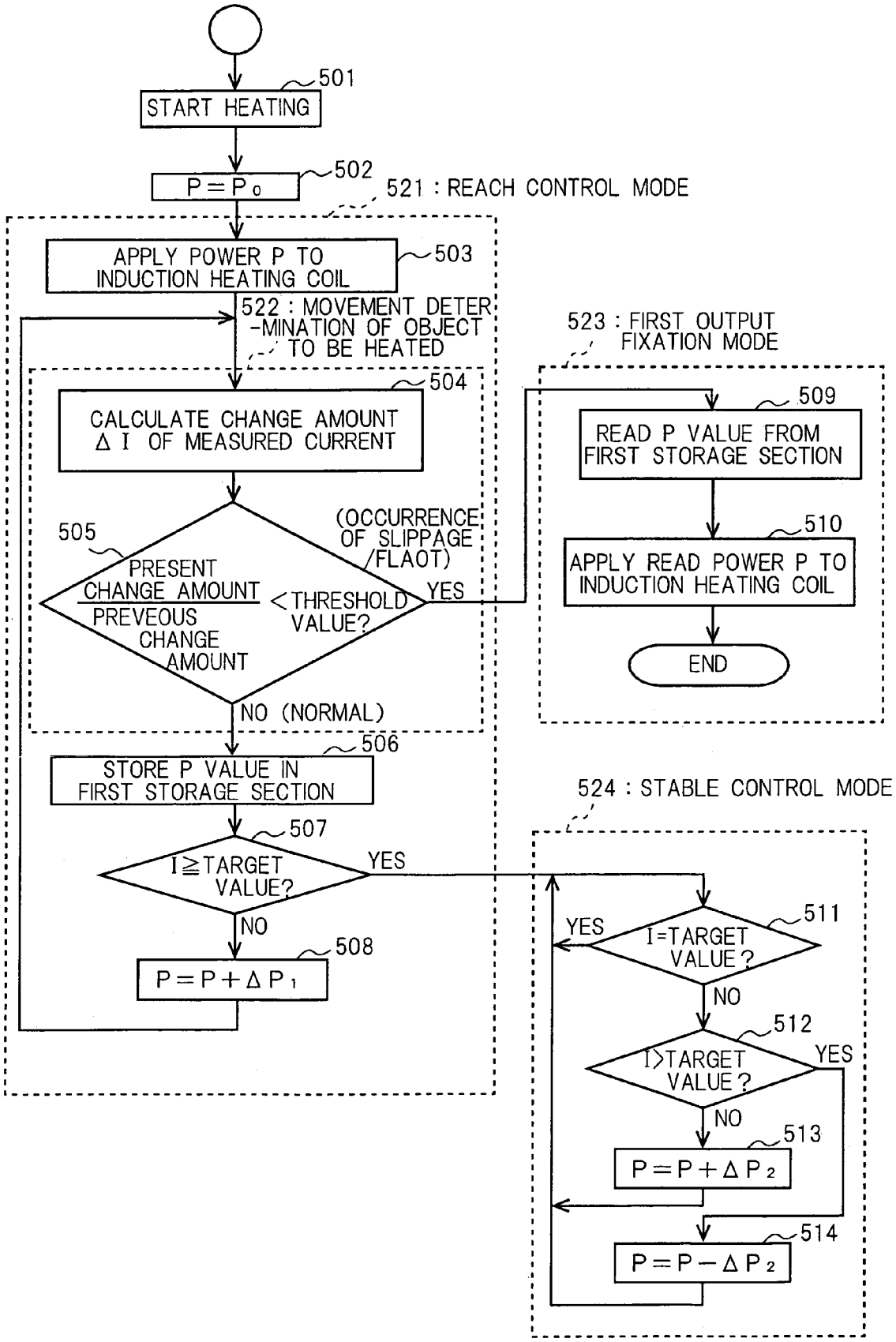
FIG. 5 is a flowchart showing a control method of the induction heater in accordance with Embodiment 1 of the present invention.
Figure 6:
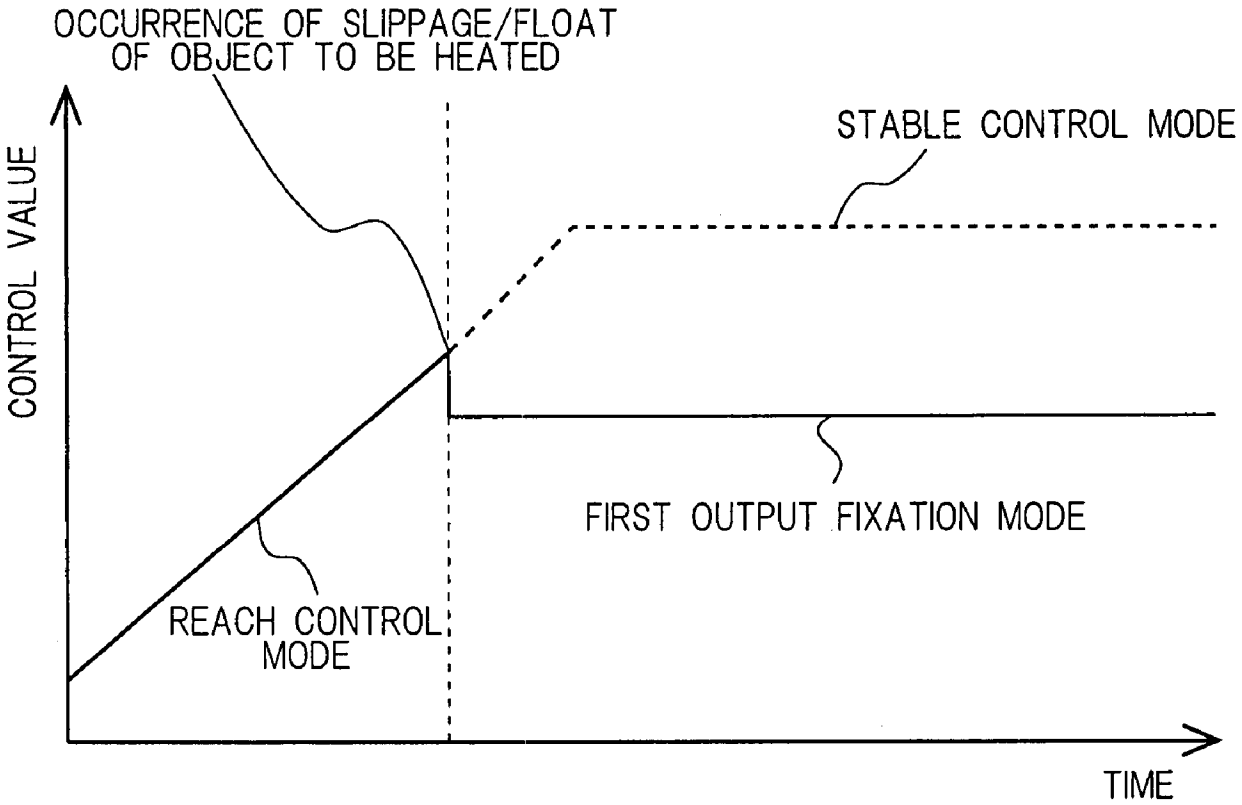
FIG. 6 is a timing chart illustrating the operation of the induction heater in accordance with Embodiment 1 of the present invention.

FIG. 5 is a flowchart showing a control method of the induction heater in accordance with Embodiment 1. FIG. 6 is a timing chart showing a state of the change in the control value output by the control section 104 of the induction heater in accordance with Embodiment 1. In FIG. 6, the horizontal axis indicates time, while the vertical axis indicates the control value output by the control section 104. In FIG. 6, the vertical dashed line indicates a point of time at which the switching between modes takes place (the same applies to the timing charts including the indications of other modes. With reference to FIG. 5 and FIG. 6, the control method of the induction heater in accordance with Embodiment 1 will be described.

First, the user inputs a heating start command by pushing the ON/OFF key switch of the setting input section 105, and inputs a command to set an output level of the heating power by pushing the UP key switch and the DOWN key switch. The control section 104 starts heating by inputting the heating start command (step 501). The target value of the power source current I to be input by the inverter circuit 102 is set according to the set output level of the heating power. First, the control section goes into a reach control mode 521. The reach control mode 521 has steps 502 to 508. In the reach control mode 521, after heating is started, the control section 104 gradually increases the heating output (control value) gradually from a low state to a set output at a nearly constant rate (so that the time differential of the control value output by the control section 104 becomes nearly constant), while checking whether the object has moved or not (FIG. 6). If the object 110 does not move during the process mentioned above, the control section 104 increases the control value until the power source current detected by the output detection section 103 reaches a target value I set at the setting input section 105.

At step 502, the control section 104 sets a control value P to P0 (initial value). P0 is a value which is small to such an extent that, however lightweight the object 110, it does not move, although the value is within the range the induction heater allows. The inverter circuit 102 applies the power corresponding to the control value P (represented as power P) to the induction heating coil 101 (step 503). The control value P output by the control section 104, specifically, sets the conditions (such as a frequency and a driving time ratio) under which the inverter circuit 102 drives the induction heating coil 101. According to the driving frequency and the duty, the input current of the inverter circuit 102 varies.

In the reach control mode 521, the first movement detection section 106 checks whether the object has moved or not (step 522). Step 522 has steps 504 and 505. At step 504, the first movement detection section 106 calculates the gradient (time differential value) ΔI of the power source current detected by the output detection section 103 (the value corresponding to the measurement value of the power source current I input by the inverter circuit 102). Next, the first movement detection section 106 calculates the ratio of the present change amount ΔI to the previous change amount ΔI (the value of the ratio can be either positive or negative) to check whether the ratio is less than a threshold value (for example 0.7) or not (step 505). In the case where the ratio is less than the threshold value (the case where the present variation is negative is included), the first movement detection section 106 determines that the object 110 has moved. In this case, the control section 104 shifts from the reach control mode 521 to a first output fixation mode 523.

If the ratio is equal to or greater than the threshold value, the sequence proceeds to step 506. P value (control value of the control section 104) is stored in the first storage section 107 (step 506). The control section 104 checks whether or not the power source current detected by the output detection section 103 is equal to or greater than the target value (step 507). If the power source current detected by the output detection section 103 is equal to or greater than the target value, the control section 104 shifts from the reach control mode 521 to a stable control mode 524. If the power source current detected by the output detection section 103 is less than the target value, the control section 104 increases the control value (power) P by a predetermined control value ΔP1 (step 508). The sequence returns to step 503 and the above-mentioned steps are repeated. In the embodiment, the processing from step 503 to step 508 is carried out repeatedly at regular time intervals.

At step 505, it is also possible to calculates the difference between the present change amount LI and the previous change amount ΔI (the value of the difference can be either positive or negative) and check whether the difference is less than the threshold value or not.

In the first output fixation mode 523, the control section 104 outputs a constant control value (FIG. 6). The first output fixation mode 523 has steps 509 and 510. At step 509, the control section 104 reads P value from the first storage section 107.

P is a control value before the first movement detection section 106 detects the movement of the object 110 (in the condition where the object 110 does not move). P is the maximum output value in the range of the output value at which neither the slippage nor the float is detected. The control section 104 outputs the read control value (power) P continuously (feedback control is not performed) (step 510). The power P is applied to the induction heating coil 101. The object 110 does not move. In the first output fixation mode 523, even when the user carries out cooking moving the object 110, the induction heater heats the object 110 with stability. The processing is finished.

In the stable control mode 524, the control section 104 exercises control so that the induction heating coil 101 outputs the target heating power (so that the inverter circuit 102 inputs the target power source current) (feedback control) (the dashed line in FIG. 6). The stabile control mode 524 has steps 511 to 514. In the embodiment, the processing from step 511 to step 514 is carried out repeatedly at regular time intervals. At step 511, it is checked whether or not the power source current I detected by the output detection section 103 is equal to the target value (a slight error may be allowed). If the power source current I is equal to the target value, step 511 is repeated. If the power source current I is not equal to the target value, the sequence proceeds to step 512. It is checked whether the power source current I is greater than the target value (step 512). If the power source current I is greater than the target value, the sequence proceeds to step 514. If the power source current I is smaller than the target value, the sequence proceeds to step 513. The control section 104 increases the control value (power) P by a predetermined control value ΔP2 (step 513). The sequence returns to step 511, the above-mentioned steps are repeated.

At step 514, the control section 104 reduces the control value (power) P by the predetermined control value ΔP2. The sequence returns to step 511, the above-mentioned steps are repeated. The values of ΔP1 and ΔP2 are arbitrary and may agree with each other. The increase ΔP2 at step 513 and the decrease ΔP2 at step 514 may be different from each other.

Figure 59:
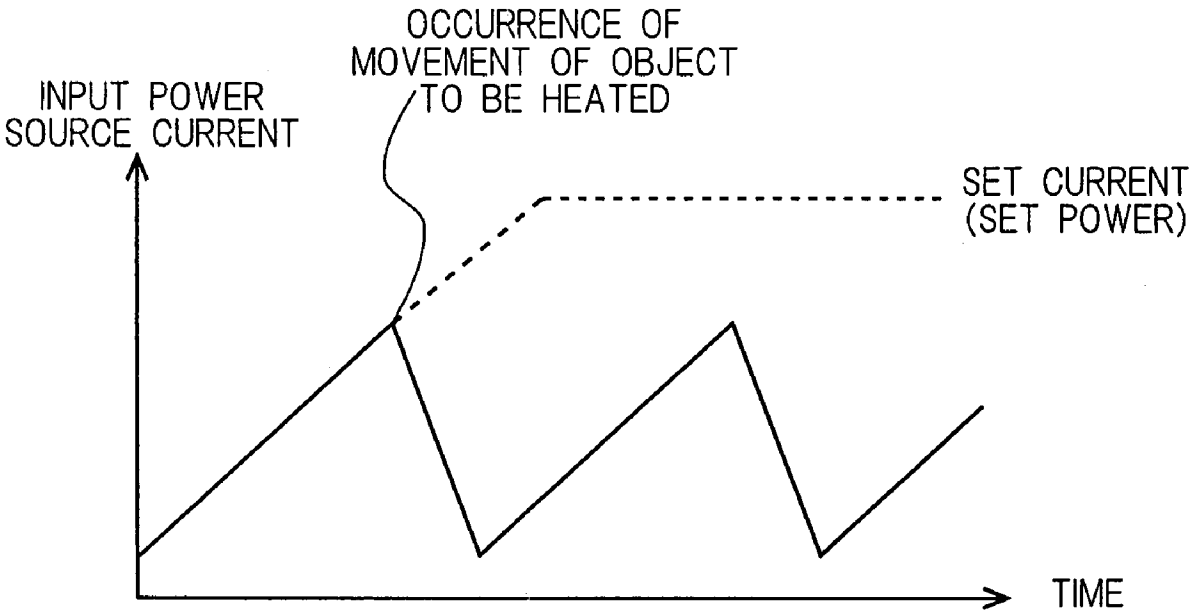
FIG. 59 is a timing chart illustrating the operation of the induction heater in accordance with prior art example 2.
Figure 60:
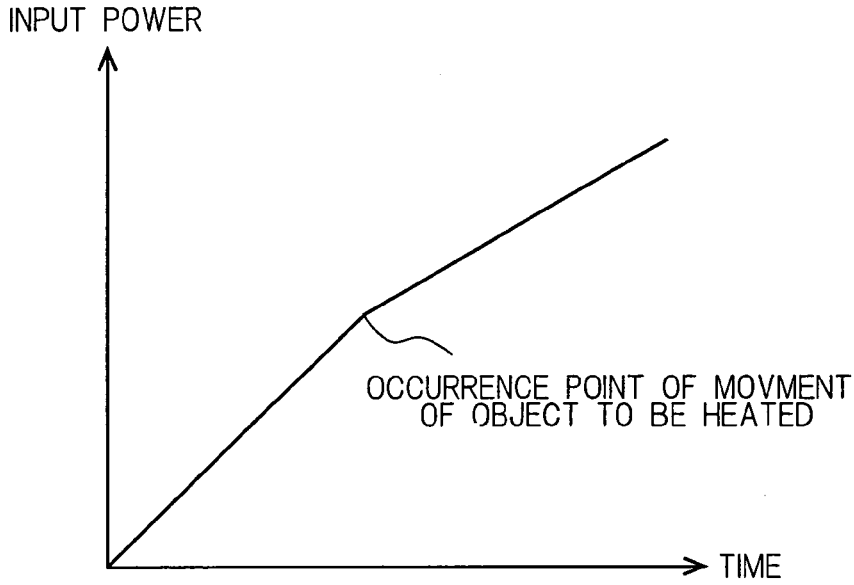
FIG. 60 is a timing chart illustrating the operation of the induction heater in accordance with prior art example 2.
Figure 60:
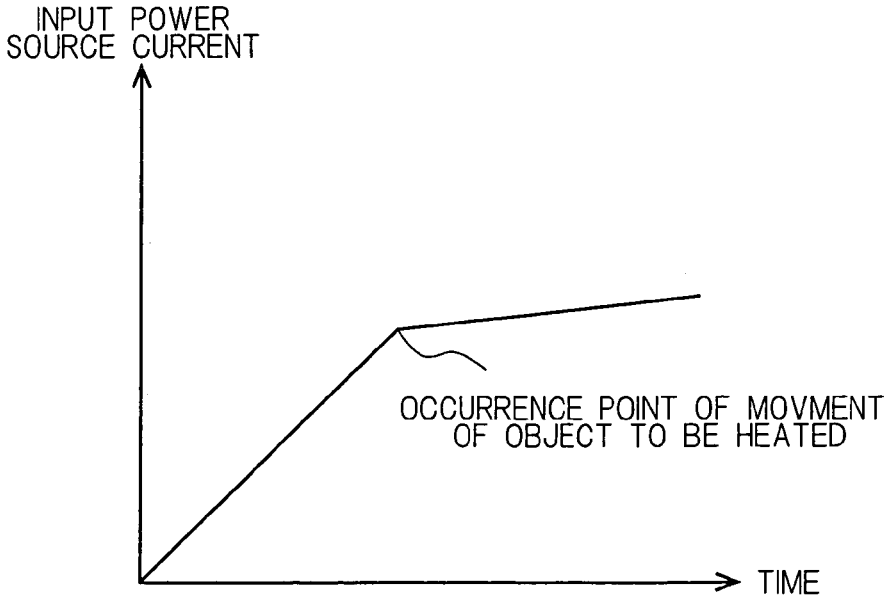

In the first output fixation mode, the induction heater of the present invention which heats the object at the maximum heating power (the heating power obtained by subtracting a predetermined correction value from the maximum heating power will do) in the range of the heating power with which the object does not move supplies sufficiently high power as compared with, for example, the induction heater in accordance with prior art example 2 which repeats the operation shown in FIG. 59.

For example, it is assumed that the user carries out cooking moving the pan (object to be heated). If the control section exercises control so that the output of the inverter circuit agrees with the target output (the same control method as in the stable control mode) as in the prior art induction heaters, the output current of the inverter circuit varies according as the user moves the pan, whereby the induction heater comes out of the controlled state. In the present invention, in the first output fixation mode, the control section outputs a control value (typically, a fixed output value) which does not utilize the output current of the inverter circuit, so that, even when the user carries out cooking moving the pan, the output of the inverter is unaffected thereby. For example, if the user starts cooking moving the pan after the inverter reaches the target output, the heating power in the first output fixation mode approximates to the target output. Even when the user moves the pan, so that the induction heater shifts to the first output fixation mode, the user is scarcely hindered from carrying out cooking.

In the embodiment, the inverter circuit 102 is a two-transistor inverter circuit. Not only this two-transistor inverter circuit but also any circuit where the input current varies with the change in the magnetic coupling to the load (object 110 to be heated) can be used. For example, one-transistor voltage resonance inverter circuit may be used.

The setting display section 113 may be, for example, an LCD (liquid crystal). The setting display of the setting display section 113 may be digital display.

The set target value and the detection data of the output detection section 103 are not limited to the input current value of the inverter circuit 102. For example, each of them may be an input current value of the entire induction heater (the input current of the entire induction heater is nearly equal to the input current of the inverter circuit 102). For example, it may be a value of the induction heating coil current.

The first movement detection section 106 may detect the movement of the object 110 by another method. For example, at the start of heating, with increasing heating output gradually, the movement of the object may be detected based on the change in the gradient (time differential) of the coil current flowing through the induction heating coil. For example, a weight sensor for detecting the weight of the object may be provided.

In the present embodiment, the first storage section 107 stores the control value output by the control section 104. Instead of this, the first storage section 107 may store the output value of the output detection section 103 (the input power source current of the inverter circuit 102 or the current of the induction heating coil 101). For example, the control section 104 derives a control value to be output from the control section 104 based on the output value of the output detection section 103 before the first movement section 106 detects the movement of the object 110 and the gradient of the current flowing through the induction heating coil. Typically, the control section 104 outputs a control value such that the maximum current in the range of the current with which the object 110 does not move flows through the induction heating coil 101.

In the present embodiment, when the first movement detection section 106 detects the movement of the object 110 in the course of the reach control mode 521, the control section 104 shifts from the reach control mode 521 to the first output fixation mode 523. In another embodiment, instead of this, the control method as mentioned below is carried out. In the reach control mode, the first storage section 107 stores the output value of the output detection section 103 (or the control value) before the first movement detection section 106 detects the movement of the object 110. When the first movement detection section 106 detects the movement of the object, the control section 104 shifts to the stable control mode where the value derived based on the output value of the output detection section 103 (or the control value) (which is the maximum value in the range of the output value at which the object does not move) stored by the first storage section 107 at the previous time (the derived value may be the maximum value itself or may be the value obtained by subtracting a predetermined correction value from the maximum value) is set as a target output. As a result, the effect which is similar to that in Embodiment 1 can be obtained.

<<Embodiment 2>>

Figure 7:
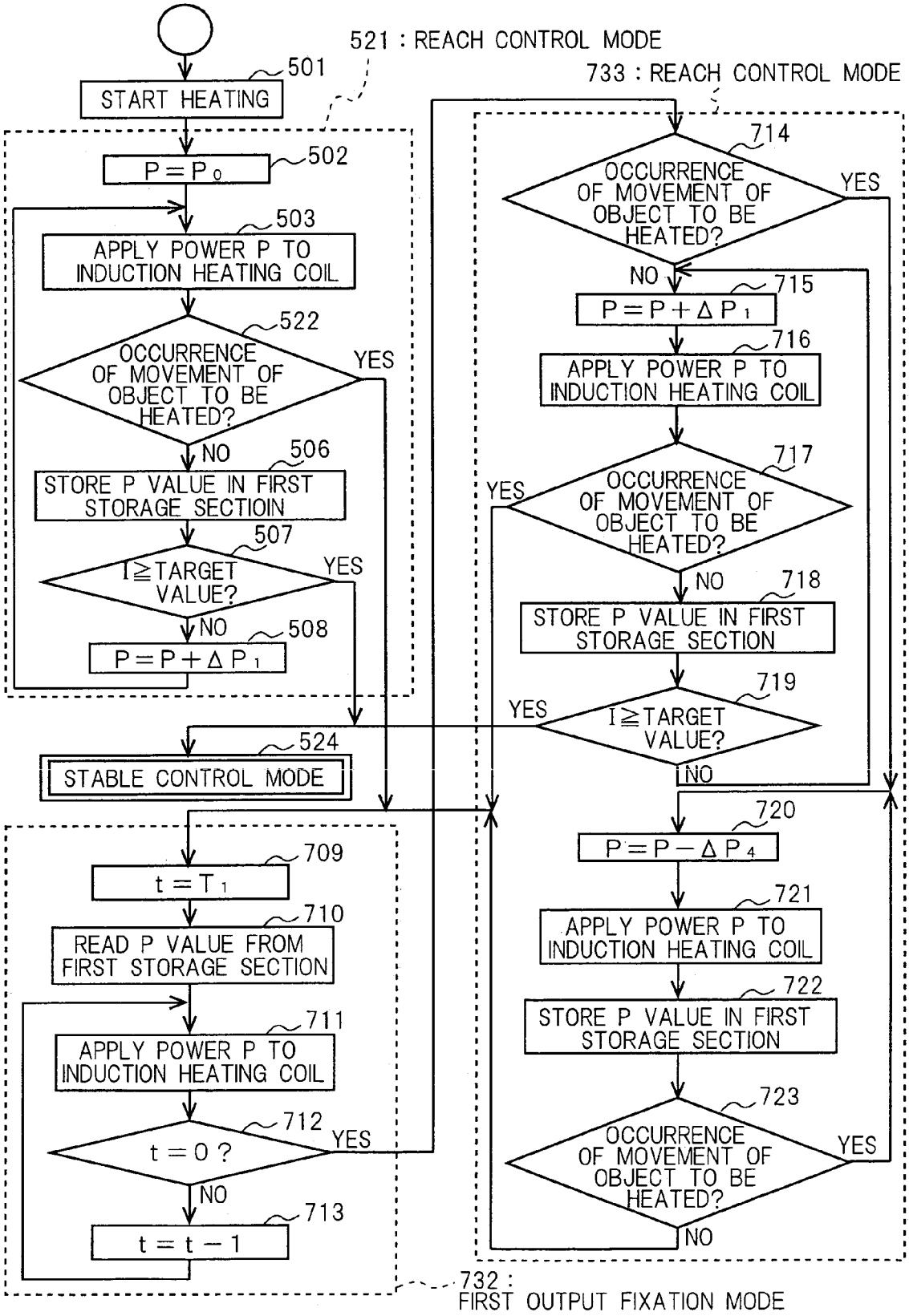
FIG. 7 is a flowchart showing a control method of the induction heater in accordance with Embodiment 2 of the present invention.
Figure 8:
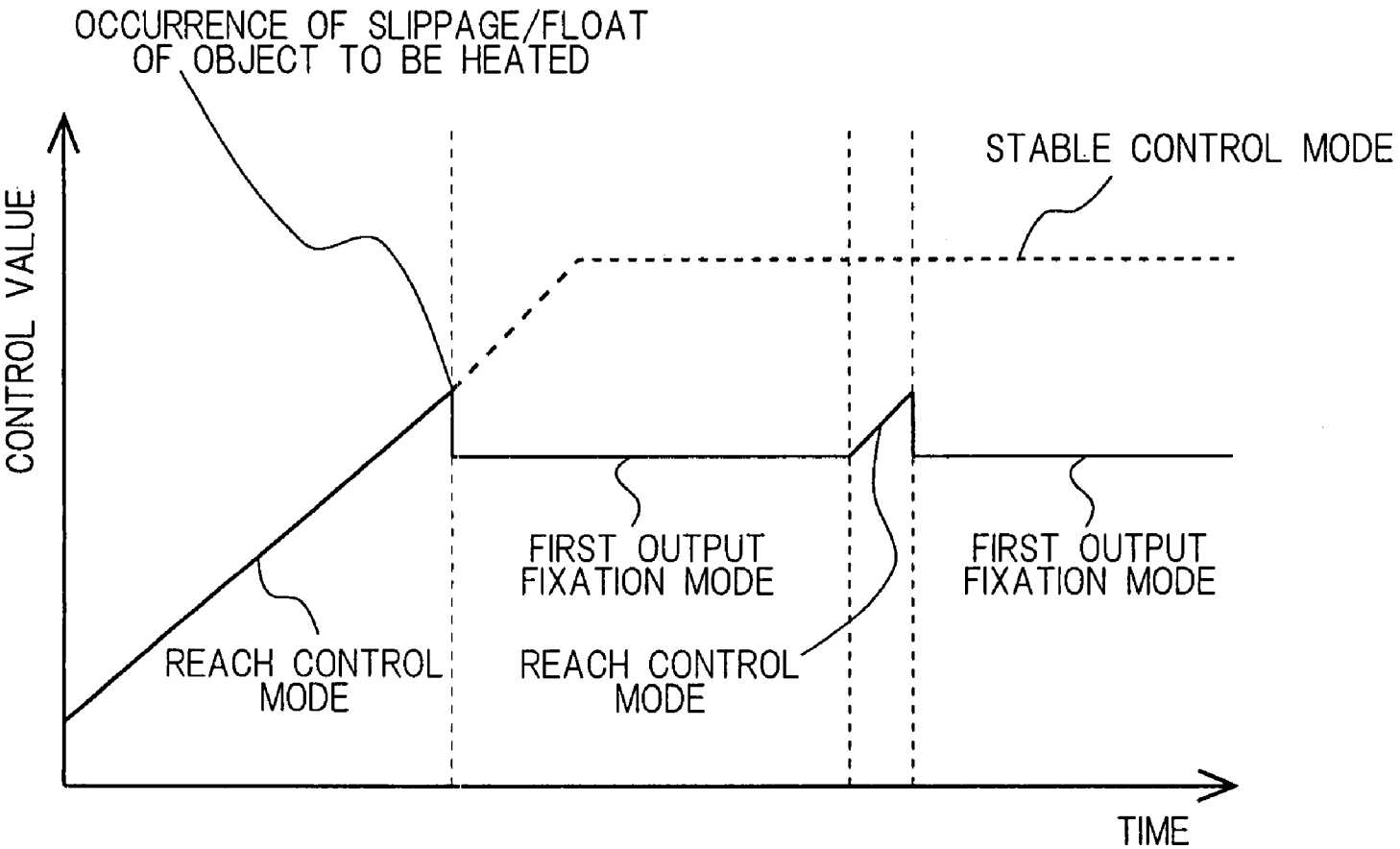
FIG. 8 is a timing chart illustrating the operation of the induction heater in accordance with Embodiment 2 of the present invention.

With reference to FIG. 1 to FIG. 4, FIG. 7 and FIG. 8, an induction heater (induction heating cooker) in accordance with Embodiment 2 of the present invention will be described. The induction heater in accordance with Embodiment 2 has the same block configuration and the same structure as those of the induction heater in accordance with Embodiment 1. (FIG. 1 to FIG. 4). The descriptions thereof are omitted. In the induction heater in accordance with Embodiment 2, the control method of the control section 104 is different from that in Embodiment 1. FIG. 7 is a flowchart showing the control method of the induction heater in accordance with Embodiment 2. FIG. 8 is a timing chart showing a state of the change in the control value output by the control section 104 of the induction heater in accordance with Embodiment 2. In FIG. 8, the horizontal axis indicates time, while the vertical axis indicates the control value output by the control section 104. With reference to FIG. 7 and FIG. 8, the control method of the induction heater in accordance with Embodiment 2 will be described.

In FIG. 7, step 501, the reach control mode 521 (steps 502 to 508), and the stable control mode 524 are the same as in Embodiment 1 (FIG. 5). In FIG. 7, the same numerals are applied to the same steps as in FIG. 5.

The control section 104 starts heating by inputting the heating start command input through the setting input section 105 by the user (step 501). The control section 104 goes into the reach control mode 521. If the power source current detected by the output detection section 103 (which is equivalent to the output value of the inverter circuit 102) reaches the target value I set at the setting input section 105, the control section 104 shifts from the reach control mode 521 to the stable control mode 524 (the dashed line in FIG. 8). When the first movement detection section 106 detects a movement of the object 110 in the course of the reach control mode 521, the control section 104 shifts from the reach control mode 521 to a first output fixation mode 732 (the solid line in FIG. 8).

Embodiment 2 differs from Embodiment 1 in the processing after the control section 104 goes into the first output fixation mode 732. The processing after the control section 104 goes into the first output fixation mode 732 will be described in detail. In the first output fixation mode 732, the control section 104 outputs a constant control value. The first output fixation mode 732 has steps 709 to 713. First, the control section 104 sets an initial value TI in the timer (step 709). At step 710, the control section 104 reads the value P out from the first storage section 107. P is a control value before the first movement detection section 106 detects a movement (including slipping and floating) of the object 110 (in the condition where the object 110 does not move). P is the maximum output value in the range of the output value at which neither the slippage nor the float is detected. The control section 104 outputs the read control value (power) P continuously (feedback control is not performed) (step 711). The power P is applied to the induction heating coil 101.

It is checked whether the value t of the timer is 0 or not (step 712). If the value t of the timer is 0 (if a predetermined period of time T1 elapses) the control section 104 shifts from the first output fixation mode 732 to a reach control mode 733. If the value t of the timer is not 0, the value t is decremented at regular time intervals (step 713). The sequence returns to step 711 and the processing mentioned above is repeated. The processing loop from 711 to 713 is executed repeatedly at regular time intervals until the exit from the processing loop is made.

In the reach control mode 733, a similar processing to that in the reach control mode 521 is carried out. The reach control mode 733 has steps 714 to 723. First, the first movement detection section 106 checks whether or not the object 110 is moving (step 714). If the object 110 is moving, the sequence proceeds to step 720, and the processing from step 720 to step 723 is carried out. If the object 110 is not moving, the sequence proceeds to step 715, the processing from step 715 to step 719 is carried out. The processing loop from step 715 to step 719 is executed repeatedly at regular time intervals until the exit from the processing loop is made. At steps 715 to 719, the control section 104 increases the heating output (control value) gradually to the set output at a nearly constant rate (so that the time differential of the control value output by the control section 104 becomes almost constant) while checking whether or not the object has moved (FIG. 8).

At step 715, the control section 104 increases the control value (power) P by the predetermined value ΔP1. The inverter circuit 102 applies the power (indicated as power P) corresponding to the control value P (which sets the conditions for driving the induction heating coil 101 (such as a frequency and a driving time ratio)) to the induction heating coil 101 (step 716). The first movement detection section 106 checks whether or not the object has moved (step 717). If the object has moved, the sequence returns to step 709 and the first output fixation mode 732 is carried out. If the object has not moved, the value P (the control value of the control section 104) is stored in the first storage section 107 (step 718).

The control section 104 checks whether or not the power source current detected by the output detection section 103 (output value of the inverter circuit 102) is equal to or greater the target value (step 719). If the power source current detected by the output detection section 103 is equal to or greater than the target value, the control section 104 shifts from the reach control mode 733 to the stable control mode 524. If the power source current detected by the output detection section 103 is less than the target value, the sequence returns to step 715, and the processing mentioned above is repeated.

At steps 720 to 723, while checking whether or not the object has moved or not, the control section 104 gradually decreases the heating output (control value) at a nearly constant rate (so that the time differential of the control value output by the control section 104 becomes nearly constant) (not shown in FIG. 8). The processing loop from steps 720 to 723 is executed repeatedly at regular time intervals until the exit from the processing loop is made.

At step 720, the control section 104 decreases the control value (power) P by a predetermined control value ΔP4 (it is possible that ΔP4=ΔP1). The inverter circuit 102 applies the power (indicated as power P) corresponding to the control value P (which sets the conditions for driving the induction heating coil 101 (such as a frequency and a driving time ratio)) to the induction heating coil 101 (step 721). The value P (the control value of the control section 104) is stored in the first storage section 107 (step 722). The first movement detection section 106 checks whether or not the object has moved (step 723). If the object has moved, the sequence returns to step 720 and the processing mentioned above is repeated. If the object has not moved, the sequence returns to step 709, and the first output fixation mode 732 is carried out.

In Embodiment 2, when the first output fixation mode is maintained for a predetermined time period, the shift to the reach control mode is made. The induction heater alternates between the reach control mode and the first output fixation mode as shown in FIG. 7 and FIG. 8. By shifting to the reach control mode at regular time intervals (in the present embodiment, the duration T1 of the first output fixation mode is set to one second), for example, even when the user puts the item to be cooked in the pan, thereby varying the weight of the object, the control section always exercises output control with the maximum output in the range of the output with which neither a slippage nor a float of the pan is caused.

A user-friendly induction heater which can carry out heating with the maximum power in the range of the power with which neither a slippage nor a float of an item being cooked is caused, and at the same time, adapts to the change in the weight of the object can be obtained.

In the present embodiment, when the first movement detection section 106 detects a movement of the object 110 in the course of the reach control mode 521, the control section 104 shifts from the reach control mode 521 to the first output fixation mode 723. In another embodiment, when the first movement detection section 106 detects the movement of the object in the reach control mode, the control section 104 shifts to the stable control mode where the value derived based on the output value of the output detection section 103 (which is the maximum value in the range of the output with which the object does not move) stored by the first storage section 107 at the previous time (the derived value may be the maximum value itself, or may be the value obtained by subtracting a predetermined correction value from the maximum value) is set as a target output. By alternating between the stable control mode and the reach control mode afterwards, the effect which is similar to that in Embodiment 2 can be obtained.

<<Embodiment 3>>

Figure 9:
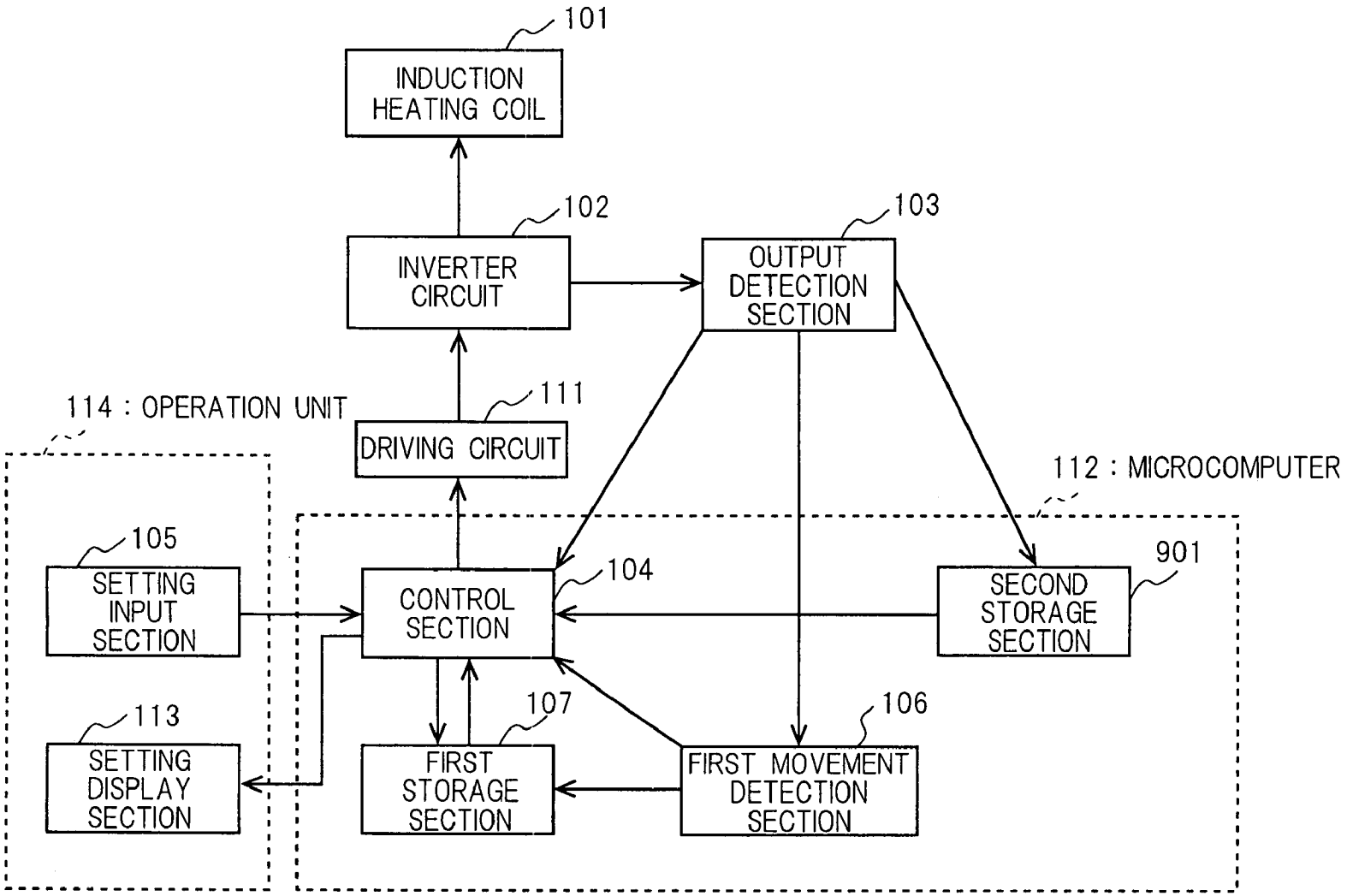
FIG. 9 is a block diagram showing a configuration of an induction heater in accordance with Embodiments 3 and 4 of the present invention.

With reference to FIG. 1 to FIG. 4, FIG. 9 and FIG. 10, an induction heater (induction heating cooker) in accordance with Embodiment 3 of the present invention will be described. FIG. 9 shows a block diagram of the induction heater in accordance with Embodiment 3. The induction heater in accordance with Embodiment 3 has a second storage section 901 in addition to the configuration in accordance with Embodiment 1 (FIG. 1). The second storage section 901 stores the power source current of the inverter circuit 102 detected by the output detection section 103 (which is equivalent to the output value of the inverter circuit 102) in the first output fixation mode. Otherwise, the induction heater in accordance with Embodiment 3 has the same block configuration and the same structure as those of the induction heater in accordance with Embodiment 1 (FIG. 1) (FIG. 2 to FIG. 4). The specific circuit of the inverter circuit 102, the output detection section 103, the induction heating coil 101 and so on in accordance with Embodiment 3 is the same as that in accordance with Embodiment 1 (FIG. 2). The microcomputer 112 has the control section 104, the first movement detection section 106, the first storage section 107, and the second storage section 901. In the present embodiment, the first storage section 107 and the second storage section 901 are internal RAM of the microcomputer 112. The first storage section 107 and the second storage section 901 may be different memory chips or may be different storage areas in one and the same memory chip. The descriptions of the same blocks as those in accordance with Embodiment 1 are omitted.

In the induction heater in accordance with Embodiment 3, control method of the control section 104 is different from that in accordance with Embodiment 1. In the first output fixation mode of the induction heater in accordance with Embodiment 3 (at this time, it is assumed that the object 110 is not moving), the power source current of the inverter circuit 102 (output value of the inverter circuit 102) detected by the output detection section 103 is stored in the second storage section 901. When the user pushes the DOWN key switch and the UP key switch (FIG. 4) to change the output level of the heating power, the target value of the power source current of the output level is set to the value derived based on the power source current stored in the second storage section 901 (the detection signal of the output detection section 103) instead of the standard target value (the target value when the movement of the object is not detected and the shift to the stable control mode is made). The standard target value Ij ($1 \leqq j \leqq 7$) of the power source current at each of the output levels (in Embodiment 3, 1 to 7 levels) is stored in the non-volatile memory of the induction heater in advance.

Figure 10:
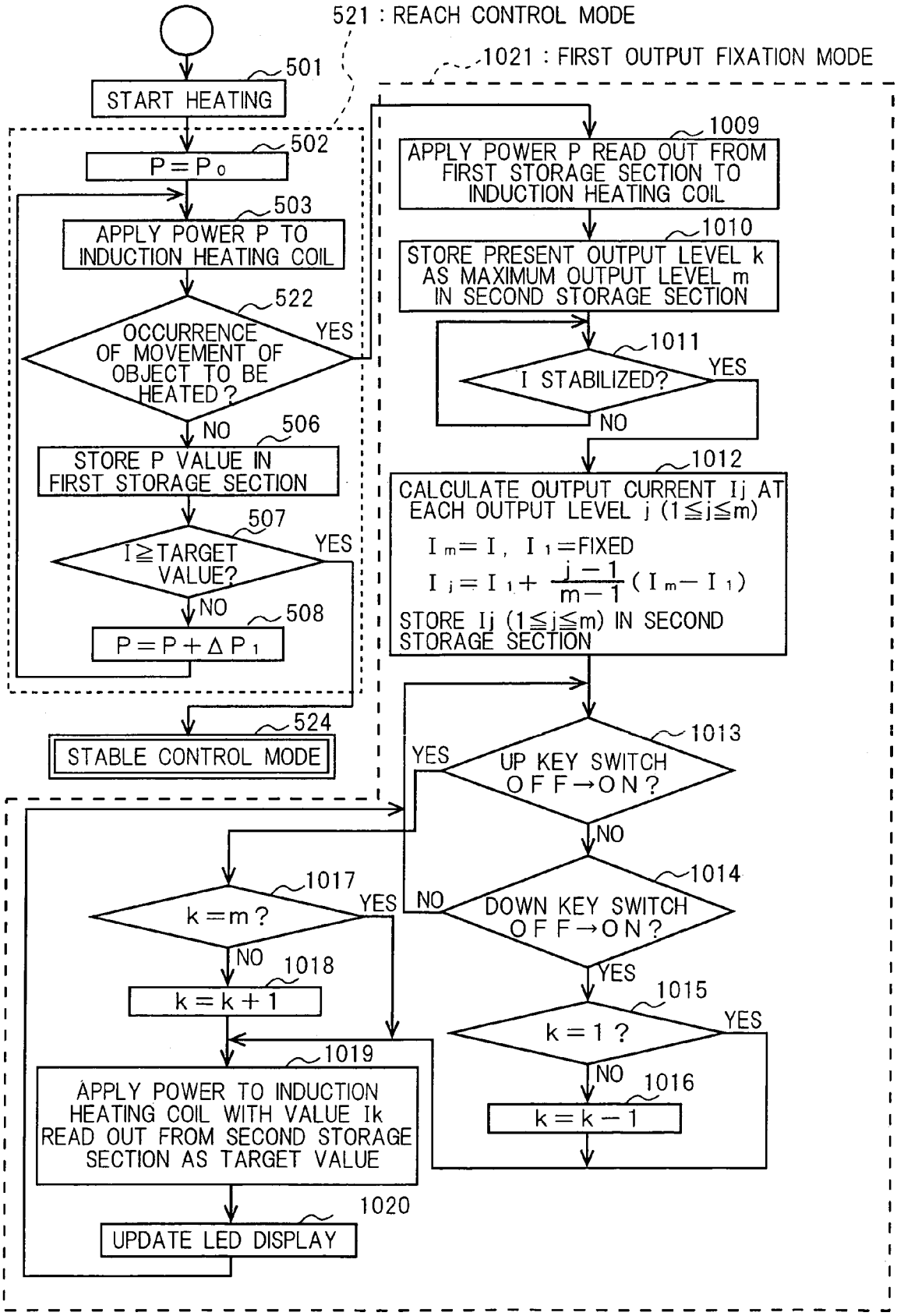
FIG. 10 is a flowchart showing a control method of the induction heater in accordance with Embodiment 3 of the present invention.

FIG. 10 is a flowchart showing the control method of the induction heater in accordance with Embodiment 3. With reference to FIG. 10, the control method of the induction heater in accordance with Embodiment 3 will be described. In FIG. 10, step 501, the reach control mode 521 (steps 502 to 508) and the stable control mode 524 are the same as in Embodiment 1 (FIG. 5). In FIG. 10, the same numerals are applied to the same steps as in FIG. 5.

The control section 104 inputs the heating start command input through the setting input section 105 by the user to start heating (step 501). First, the control section 104 goes into the reach control mode 521. When the power source current detected by the output detection section 103 reaches the target value I set at the setting input section 105, the control section 104 shifts from the reach control mode 521 to the stable control mode 524. When the first movement detection section 106 detects a movement of the object 110 in the course of the reach control mode 521, the control section 104 shifts from the reach control mode 521 to a first output fixation mode 1021.

Embodiment 3 differs from Embodiment 1 in the processing after the control section 104 goes into the first output fixation mode 1021. The processing after the control section 104 goes into the first output fixation mode 1021 will be described in detail. In the first output fixation mode 1021, the control section 104 outputs a constant control value. The first output fixation mode 1021 has steps 1009 to 1020. First, the control section 104 outputs the control value P read out from the first storage section to apply the power P to the induction heating coil 101 (step 1009). The control section 104 stores the present output level k as the maximum output level m (so that it is impossible to set the output at the output level higher than the output level m) in the second storage section 901 (step 1010).

Next, it is checked whether or not the power source current I detected by the output detection section 103 has stabilized (step 1011). If the power source current I has not stabilized, step 1011 is repeated. If the power source current I has stabilized, the sequence proceeds to step 1012. At step 1011, the power source current I detected by the output detection section 103 is stored in the second storage section 901. The control section 104 compares the power source current I newly detected by the output detection section 103 with the power source current I stored in the second storage section 901 at the previous time. When the difference is within a predetermined range and a predetermined length of time has elapsed since the shift of the control section 104 to the first output fixation mode 1021, the control section 104 determines that the power source current I has stabilized. When the difference between the power source current I newly detected by the output detection section 103 and the power source current I stored in the second storage section 901 at the previous time is outside the predetermined range, or the predetermined length of time has not elapsed since the shift of the control section 104 to the first output fixation mode 1021, the control section 104 determines that the power source current I has not stabilized.

At step 1012, the new target value of the power source current of each output level is calculated and stored. To be specific, the target value of the m level is set to the power source current I (stable value) stored in the second storage section 901. The target value I1 of the first level remains at the standard target value ($I1 \leqq Im$). With regard to each of the other output levels, the target value Ij ($1<j<m$) is calculated from the equation, $Ij=I1+(j-1)(Im-I1)/(m-1)$. The calculated new target value Ij ($1 \leqq j \leqq m$) is stored in the second storage section 901.

At step 1013, it is checked whether or not the user has pushed the UP key switch (whether the UP key switch has changed from the OFF state to the ON state). If the user has pushed the UP key switch, the sequence proceeds to step 1017. If the user has not pushed it, the sequence proceeds to step 1014.

At step 1014, it is checked whether or not the user has pushed the DOWN key switch (whether the DOWN key switch has changed from the OFF state to the ON state). If the user has pushed the DOWN key switch, the sequence proceeds to step 1015. If the user has not pushed it, the sequence returns to step 1013.

At step 1015, it is checked whether or not the present output level k is 1. If the present output level k is 1, the sequence proceeds to step 1019. If the present output level k is not 1 (k=2), k is decremented (step 1016). The sequence proceeds to step 1019.

At step 1017, it is checked whether or not the present output level k is m. If the present output level k is m, the sequence proceeds to step 1019. If the present output level k is not m (k<m), k is incremented (step 1018).

Next, at step 1019, power is applied to the induction heating coil with the value Ik (the value of the output level k which is among the new target values ij ($1 \leqq j \leqq m$) stored at step 1012) read out from the second storage section as the new target value. In Embodiment 3, at the m output level, control is exercised in the first output fixation mode (where the control value to be output by the control section 104 is fixed at the value stored in the first storage section 107). At the first to (m−1) output levels, the control section goes into the stable control mode, and control is exercised with the target value set to Ik.

The LED display of the setting display section 113 is updated so as to agree with the new output level (step 1020). The sequence returns to step 1013.

In Embodiment 3, when the movement of the object is detected in the reach control mode 521, the target value is set to the value derived based on the power source current stored in the second storage section 901 (detection signal of the output detection section 103) instead of the standard target value in the stable control mode.

If the power source current, which is the standard target value related to each output level (the standard output value set in relation to each output level), is supplied to the inverter circuit 102, the light-weight pan, which is the object, can move. In Embodiment 3, even in this case, the target value is automatically reduced and the output of the inverter circuit 102 is lowered in the stable control mode, so that neither a slippage nor a float of the pan is caused. The pan is safely heated with the stable power.

The standard target value Ij ($1 \leqq j \leqq 7$) of the power source current at each of the output levels (in Embodiment 3, 1 to 7 levels) in the stable control mode is stored in the non-volatile memory of the induction heater in advance.

In the present embodiment, when the first movement detection section 106 detects the movement of the object 110 in the course of the reach control mode 521, the control section 104 shifts from the reach control mode 521 to the first output fixation mode 1021. The second storage section 901 stores the output value of the output detection section 103 at regular time intervals. In another embodiment, instead of this, the control method mentioned below is carried out. In the reach control mode, the first storage section 107 stores the output value (or the control value) of the output detection section 103 before the first movement detection section 106 detects a movement of the object 110. When the first movement detection section 106 detects the movement of the object, the control section 104 shifts to the stable control mode where the value derived based on the output value of the output detection section 103 (or the control value) (which is the maximum value in the range of the output value at which the object does not move) stored by the first storage section 107 at the previous time (the derived value may be for example, the maximum value itself, or the value obtained by subtracting a predetermined correction value from the maximum value) is set as a target output (it is also possible to derive the target value from multiplying the control value by the conversion factor according to the object). In the stable control mode, the first storage section 107 (or the second storage section) stores the output value output by the output control section 104 (or the output value of the output detection section 103) after a time interval. When the difference between the control value output by the control section 104 (or the output value of the output detection section 103) which the first storage section 107 stored at the previous time and the control value output by the control section 104 (or the output value of the output detection section 103) which is newly stored therein is within a predetermined range and a predetermined length of time has elapsed since the control section 104 shifted to the control mode, the control section 104 changes the target output value set by the setting input section 105 into the value derived based on the control value output by the control section 104 (or the output value of the output detection section 103) which is stored in the first storage section 107. As a result, the effect which is similar to that in Embodiment 3 can be obtained.

<<Embodiment 4>>

Figure 11:
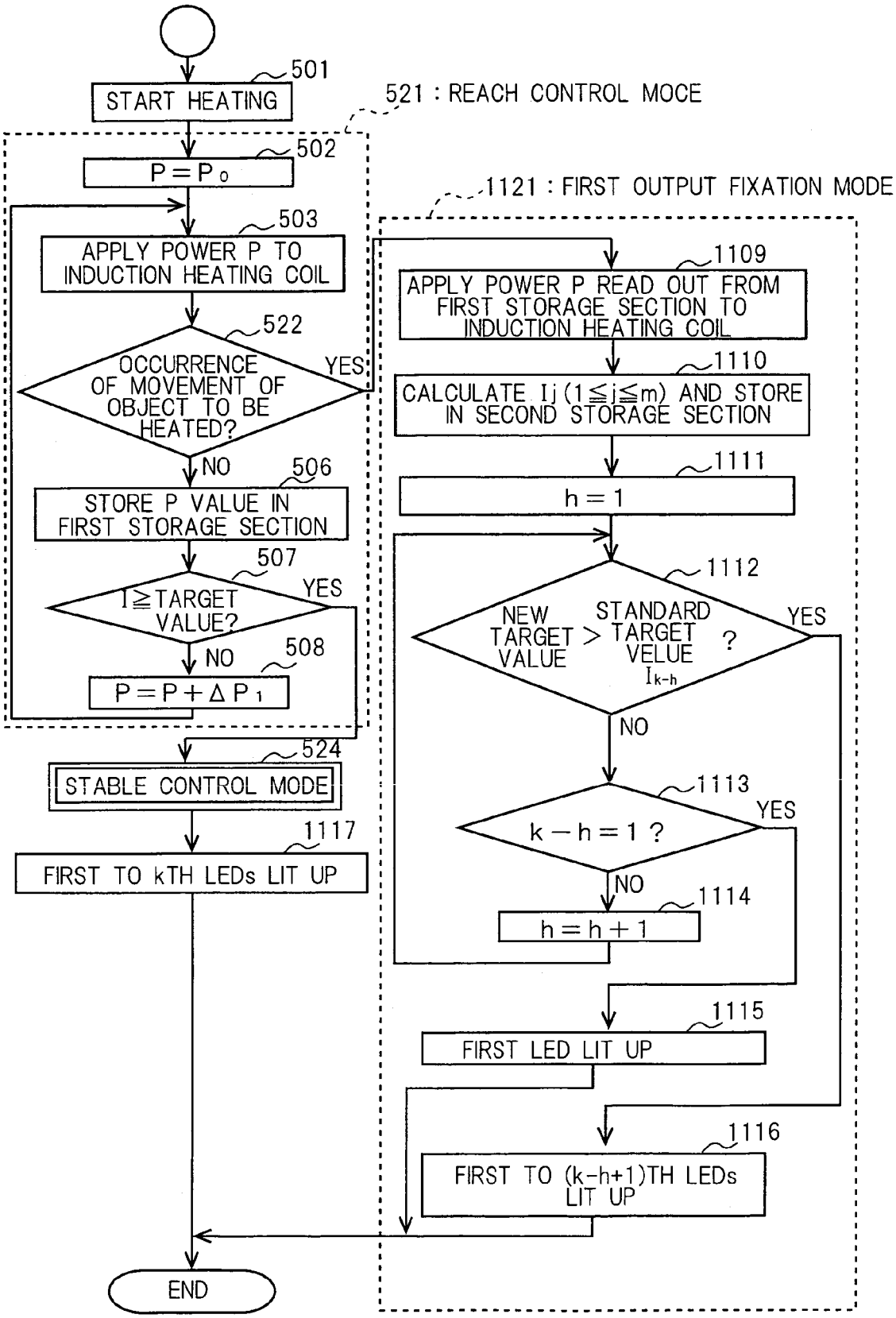
FIG. 11 is a flowchart showing a control method of the induction heater in accordance with Embodiment 4 of the present invention.

With reference to FIG. 11, an induction heater (induction heating cooker) in accordance with Embodiment 4 of the present invention will be described. The induction heater in accordance with Embodiment 4 has the same block diagram (FIG. 9), and the structure as those of the induction heater in accordance with Embodiment 3. The induction heater in accordance with Embodiment 4 carries out the same control method as in Embodiment 3 (FIG. 10) except for the display method.

In the induction heater in accordance with Embodiment 4, when the target value of the present output level derived based on the power source current I stored in the second storage section 901 is less than the standard target value (the target value in the case where the object does not move) of the output level which is lower than the present output level, the display corresponding to the standard target value which is almost the same as the target value derived based on the power source current I stored in the second storage section 901 is provided. The user can know the power which the induction heater actually outputs.

FIG. 11 is a flowchart showing the control method of the induction heater in accordance with Embodiment 4 (steps associated with the display specific to Embodiment 4 are chiefly described, while the descriptions of the same steps as in Embodiment 3 are omitted). With reference to FIG. 11, the control method of the induction heater in accordance with Embodiment 4 will be described. In FIG. 11, step 501, the reach control mode 521 (steps 502 to 508), and the stable control mode 524 are the same as in Embodiment 1 (FIG. 5). In FIG. 11, the same numerals are applied to the same steps as in FIG. 5.

The control section 104 inputs the heating start command input through the setting input section 105 by the user to start heating (step 501). First, the control section 104 goes into the reach control mode 521. If the power source current detected by the output detection section 103 reaches the target value I set at the setting input section 105, the control section 104 shifts from the reach control mode 521 to the stable control mode 524. In the stable control mode 524, when the present output level is k, k LEDs (the first to k LEDs in FIG. 4) light up (step 1117).

When the first movement detection section 106 detects a movement of the object 110 in the course of the reach control mode 521, the control section 104 shifts from the reach control mode 521 to a first output fixation mode 1121. The first output fixation mode has steps 1109 to 1116. At step 1109, the control section 104 outputs the control value read out from the first storage section 107 and applies power P to the induction heating coil 101. Next, the detected power source current I is stored in the second storage section 901. After the power source current I becomes stable, the new target value Ij ($1 \leqq j \leqq 7$) of each output level is calculated based on the power source current I stored in the second storage section 901, and is further stored in the second storage section 901 (step 1110). Step 1110 is almost the same as steps 1010 to 1012 in accordance with Embodiment 3 (FIG. 10). As with Embodiment 3, at the m output level, the control section 104 goes into the first output fixation mode. At the first to (m−1) output levels, the control section 104 goes into the stable control mode, and exercises the control where the target value is set to Ik.

When operating in the stable control mode, the control section 104 exercises control so that the power source current (the detection signal of the output detection section 103) agrees with the new target value stored in the second storage section 901.

Next, at steps 1110 to 1113, it is checked which output-level standard value (the target value in the case where the object does not move) is almost the same as the new target value I of the present output level derived based on the power source current I stored in the second storage section 901. First, h is set to 1 (initial value) (step 1111). It is checked whether or not the new target value I is greater than the standard target value I (k−h) (the standard target value of the output level (k−h)) (step 1112). If the new target value I is greater than the standard target value I (k−h), the sequence proceeds to step 1116. If the new target value I is not greater than the standard target value I (k−h), the sequence proceeds to step 1113. At step 1113, it is checked whether (k−h) is 1 or not. If (k−h) is 1 (the new target value I is equal to or less than the standard target value of the first output level), the sequence proceeds to step 1115. If the value (k−h) is not 1, the value h is incremented (step 1114). The sequence returns to step 1112, the above-mentioned processing is repeated.

At step 1115, only the first LED in FIG. 4 lights up. The processing is finished.

At step 1116, the first to (k−h+1) LEDs in FIG. 4 light up. The processing is finished.

With a specific example applied to the control method in FIG. 10, the description thereof will be made. For example, it is assumed that the standard target values of the fourth output level, the fifth output level, and the sixth output level are 116, 128, and 140 respectively. It is assumed that the induction heater is currently at the sixth output level. In the first output fixation mode 1121, if the new target value of the sixth output level derived based on the power source current I stored in the second storage section 901 is a value in the range from 129 to 140, the first to sixth LEDs in FIG. 4 light up. If the new target value of the sixth output level is a value in the range from 117 to 128, the first to fifth LEDs in FIG. 4 light up.

In this way, when the new target value (new output value) stored by the second storage section 114 is equal to or less than the standard target value of each output level (the output value controlled at each output level), the display of the setting display section 113 is changed.

By changing the display of the setting display section 113 according to the actual output value, the induction heater can displays the actual power to the user. A user-friendly induction heater can be obtained.

In another embodiment, when the first movement detection section 106 detects a movement of the object in the reach control mode, the control section 104 shifts to the stable control mode where the value derived based on the output value of the output detection section 103 (the maximum value in the range of the output value at which the object does not move) stored by the first storage section 107 at the previous time (the derived value may be, for example, the maximum value itself, or may be the value obtained by subtracting a predetermined correction value from the maximum value), is set as a target output. At the first to m output levels, the control section 104 goes into the stable control mode. By carrying out the above-mentioned processing, the effect which is similar to that in Embodiment 4 can be obtained.

<<Embodiment 5>>

Figure 12:
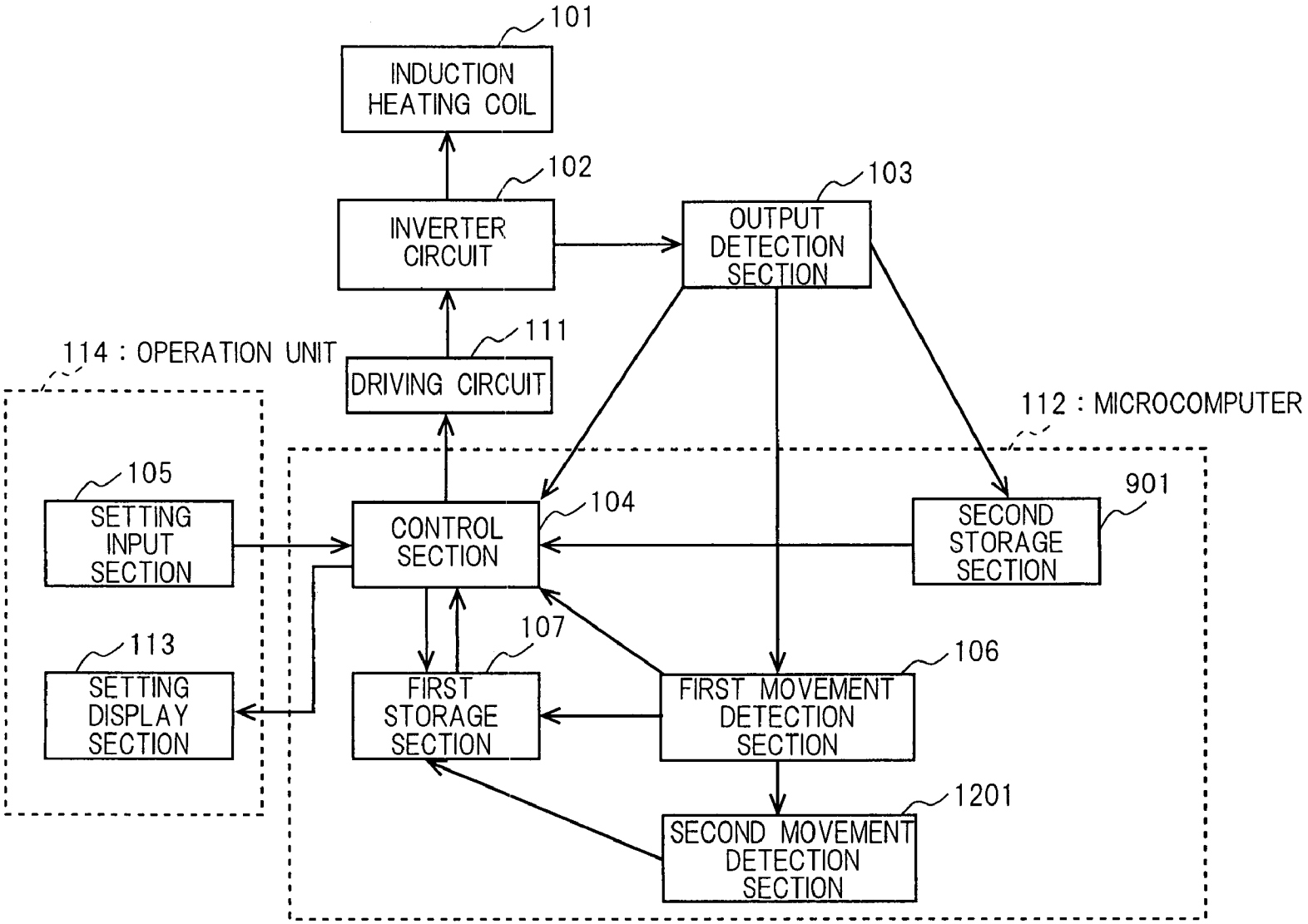
FIG. 12 is a block diagram showing a configuration of an induction heater in accordance with Embodiments 5 and 6 of the present invention.
Figure 13:
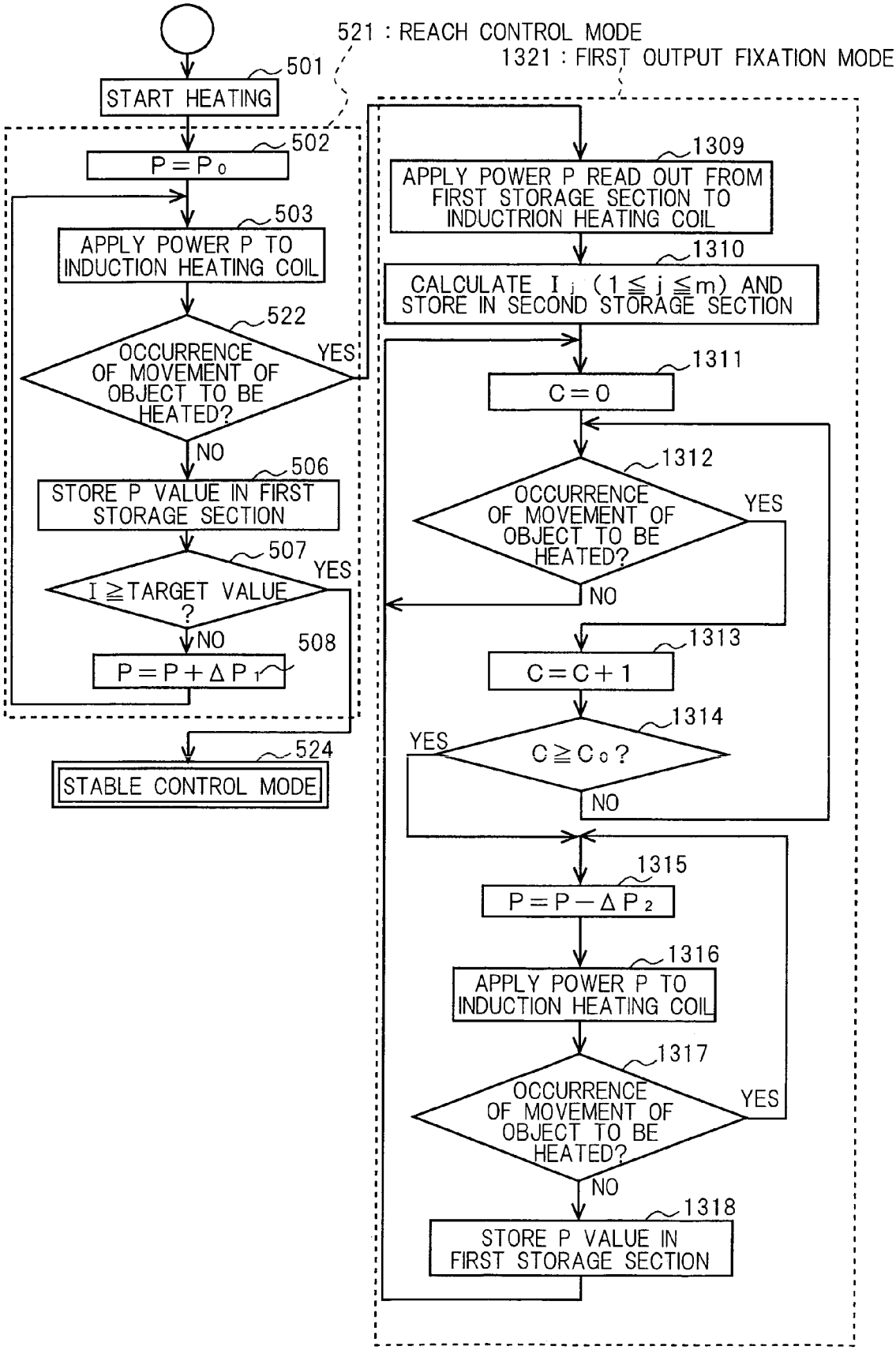
FIG. 13 is a flowchart showing a control method of the induction heater in accordance with Embodiments 5 and 6 of the present invention.
Figure 14:
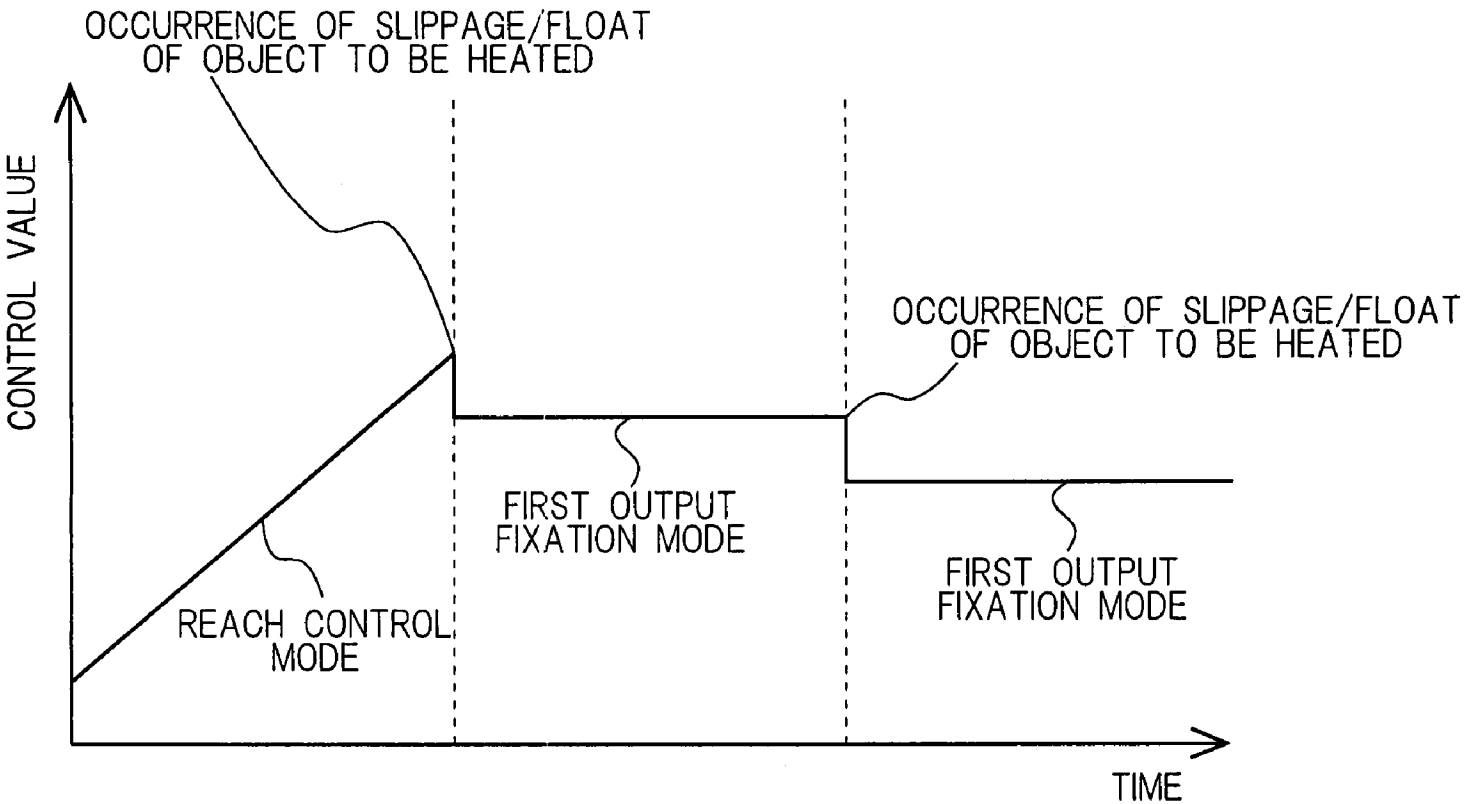
FIG. 14 is a timing chart illustrating the operation of the induction heater in accordance with Embodiment 5 of the present invention.

With reference to FIG. 12 to FIG. 14, an induction heater (induction heating cooker) in accordance with Embodiment 5 of the present invention will be described. The induction heater in accordance with Embodiment 5 has a second movement detection section 1201 in addition to the configuration in accordance with Embodiment 4 (FIG. 9). When the first movement detection section detects a movement of the object 110 a plurality of times (for example, ten times) in a row in the output fixation mode, the second movement detection section 1201 determines that the object 110 has moved. Otherwise, the induction heater in accordance with Embodiment 5 has the same block configuration and the same structure as in Embodiment 4 (FIG. 9) (FIG. 2 to 4). The specific circuit of the inverter circuit 102, the output detection section 103, the induction heating coil 101 and so on in accordance with Embodiment 5 is the same as in Embodiment 1 (FIG. 2). The microcomputer 112 has the control section 104, the first movement detection section 106, the first storage section 107, the second storage section 901 and the second movement detection section 1201. The first storage section 107 and the second storage section 901 are internal RAM of the microcomputer 112. The first storage section 107 and the second storage section 901 may be different memory chips or may be different storage areas in one and the same memory chip. The second movement detection section 1201 is operated by software. The descriptions of the same blocks as described in Embodiments 1 to 4 are omitted.

In the induction heater in accordance with Embodiment 5, the control method of the control section 104 is different than in Embodiment 4. When the second movement detection section 1201 determines that the object 110 has moved in the first output fixation mode, the control section 104 lowers the control value to be output (the control value is changed so that the output of the inverter circuit 102 (the power to be applied to the induction heating coil 101) is lowered). For example, the driving frequency of the inverter circuit 102 is lowered. The ON period of the transistors 102*c* and 102*d* of the inverter circuit 102 is reduced (the duty during the ON period is reduced).

FIG. 13 is a flowchart showing the control method of the induction heater in accordance with Embodiment 5 (steps associated with the display specific to Embodiment 5 are chiefly described, while the descriptions of the same steps as in Embodiment 4 are omitted). FIG. 14 is a timing chart showing a state of the change in the control value output by the control section 104 of the induction heater in accordance with Embodiment 5. In FIG. 14, the horizontal axis indicates time, while the vertical axis indicates the control value output by the control section 104. With reference to FIG. 13 and FIG. 14, the control method of the induction heater in accordance with Embodiment 5 will be described. In FIG. 13, step 501, the reach control mode 521 (steps 502 to 508), and the stable control mode 524 are the same as in Embodiment 1 (FIG. 5). In FIG. 13, the same numerals are applied to the same steps as in FIG. 5.

The control section 104 inputs the heating start command input through the setting input section 105 by the user to start heating (step 501). First, the control section 104 goes into the reach control mode 521. When the power source current detected by the output detection section 103 reaches the target value I set at the setting input section 105, the control section 104 shifts from the reach control mode 521 to the stable control mode 524.

When the first movement detection section 106 detects a movement of the object 110 in the course of the reach control mode 521, the control section 104 shifts from the reach control mode 521 to a first output fixation mode 1321. The first output fixation mode 1321 has steps 1309 to 1318. At step 1309, the control section 104 outputs the control value read out from the first storage section 107 and applies power P to the induction heating coil 101. Next, the detected power source current I is stored in the second storage section 901. After the power source current I becomes stable, the new target value Ij ($1 \leqq j \leqq 7$) of each output level is calculated based on the power source current I stored in the second storage section 901 and is further stored in the second storage section 901 (step 1310). Step 1310 is almost the same as steps 1010 to 1012 in Embodiment 3 (FIG. 10). As with Embodiment 3, at the m output level, the control section 104 goes into the first output fixation mode. At the first to (m−1) output levels, the control section 104 goes into the stable control mode and exercises the control where the target value is set to Ik.

When operating in the stable control mode, the control section 104 exercises control so that the power source current (the detection signal of the output detection section 103) agrees with the new target value stored in the second storage section 901.

At steps 1311 to 1314, it is checked whether the object 110 is moving little by little (the processing carried out by the second movement detection section 1201). First, C is set to 0 (initial value) (step 1311). C represents the number of times the first movement detection section 106 detects the movement of the object 110 continually. Next, the first movement detection section 106 checks whether or not the object 110 has moved (step 1312). If the object 110 has moved, the sequence proceeds to step 1313. If the object 110 has not moved, the sequence returns to step 1311, the processing mentioned above is repeated.

At step 1313, C is incremented. It is checked whether or not C is equal to or greater than a predetermined value C0 (for example, ten times). When C is equal to or greater than the predetermined value C0, it is determined that the object 110 has truly moved, and the sequence proceeds to step 1315. If C is less than the predetermined value C0, the sequence returns to step 1312, and the processing mentioned above is repeated.

At step 1315, the control section 104 reduces the control value (power) P by the predetermined control value ΔP2 (it is possible that ΔP2=ΔP1). For example, the driving frequency of the inverter circuit 102 is decreased. For example, the ON period of the transistors 102*c* and 102*d* of the inverter circuit 102 is reduced (the duty during the ON period is reduced). The inverter circuit 102 applies the power (indicated as power P) corresponding to the control value P (which sets the conditions for driving the induction heating coil 101 (such as a frequency and a driving time ratio) to the induction heating coil 101 (the resumption of the first output fixation mode) (step 1316). The first movement detection section 106 checks whether or not the object has moved (step 1317). If the object has moved, the sequence returns to step 1315, and the above-mentioned processing is repeated. If the object has not moved, the sequence proceeds to step 1318, the P value (the control value of the control section 104) is stored in the first storage section 107. The sequence returns to step 1311, and the processing mentioned above is repeated.

For example, if the weight of the object, which is a load, is distributed off-center, in the first output fixation mode 1321, at the output value stored in the first storage section 107, the object 110 can slip little by little on the induction heater. With this configuration, in the case as mentioned above, it is possible to detect the movement of the object 110, reduce the output value, and stop the slippage of the pan. The safety of the induction heater is improved.

In another embodiment, when the first movement detection section 106 detects a movement of the object in the reach control mode, the control section 104 shifts to the stable control mode where the value derived based on the output value of the output detection section 103 (which is the maximum value in the range of the output value at which the object does not move) stored by the first storage section 107 at the previous time (the derived value may be, for example, the maximum value itself, or the value obtained by subtracting a predetermined correction value from the maximum value) is set as a target output. At the first to m output levels, the control section 104 goes into the stable control mode. By carrying out the processing mentioned above, the effect which is similar to that in Embodiment 5 can be obtained.

<<Embodiment 6>>

Figure 15:
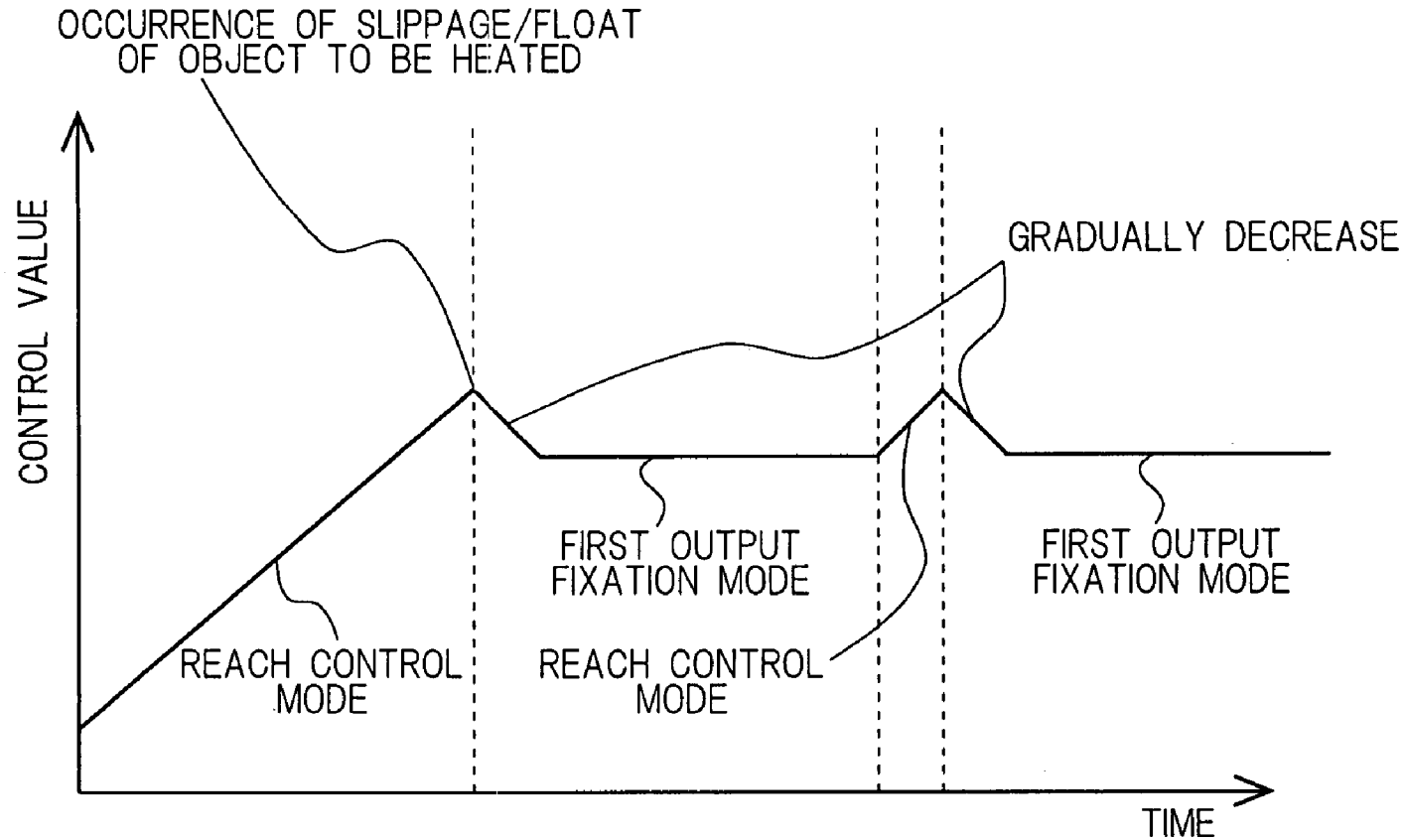
FIG. 15 is a timing chart illustrating the operation of the induction heater in accordance with Embodiment 6 of the present invention.

With reference to FIG. 7 and FIG. 15, an induction heater in accordance with Embodiment 6 of the present invention will be described. The induction heater in accordance with Embodiment 6 has the same configuration as that of the induction heater in accordance with Embodiment 2. In the induction heater in accordance with Embodiment 6, the control method of the control section 104 is partly different from that in accordance with Embodiment 2. Otherwise, the induction heater in accordance with Embodiment 6 is the same as that in accordance with Embodiment 2. FIG. 15 is a timing chart showing a state of the change in the control value output by the control section 104 of the induction heater in accordance with Embodiment 6. In FIG. 15, the horizontal axis indicates time, while the vertical axis indicates the control value output by the control section 104.

In the flowchart of Embodiment 2 shown in FIG. 7, when shifting from the reach control mode 733 to the first output fixation mode 732, the control section 104 immediately changes the control value from the control value at the time when the first movement detection 106 detected that the object 110 had moved to the control value P stored in the first storage section 107 (step 711). In Embodiment 6, at step 711 when the control section 104 shifts from the reach control mode 733 to the first output fixation mode 732 (FIG. 7), the control section 104 gradually changes the control value from the control value at the time when the first movement detection section 106 detected that object 110 had moved into the control value stored in the first storage section 107 (see FIG. 15). For example, if the control value stored in the first storage section 107 (the output value of the control section 104) is 100 and the control value (the output value of the control section 104) at the time when the first movement detection section 106 detected a slippage or a float of the pan is 120, the control section 104 decreases the output one by one in synchronism with the period of the AC power source to reduce the control value from 120 to 100.

When the control section 104 shifts from the reach control mode 733 to the first output fixation mode 732, abrupt variations in the output can be suppressed, whereby stable power can be obtained.

In another embodiment, when the first movement detection section 106 detects a movement of the object in the reach control mode, the control section 104 shifts to the stable control mode where the value derived based on the output value of the output detection section 103 stored by the first storage section 107 at the previous time is set as a target output. By carrying out the processing mentioned above, the effect which is similar to that in Embodiment 6 can be obtained.

<<Embodiment 7>>

Figure 16:
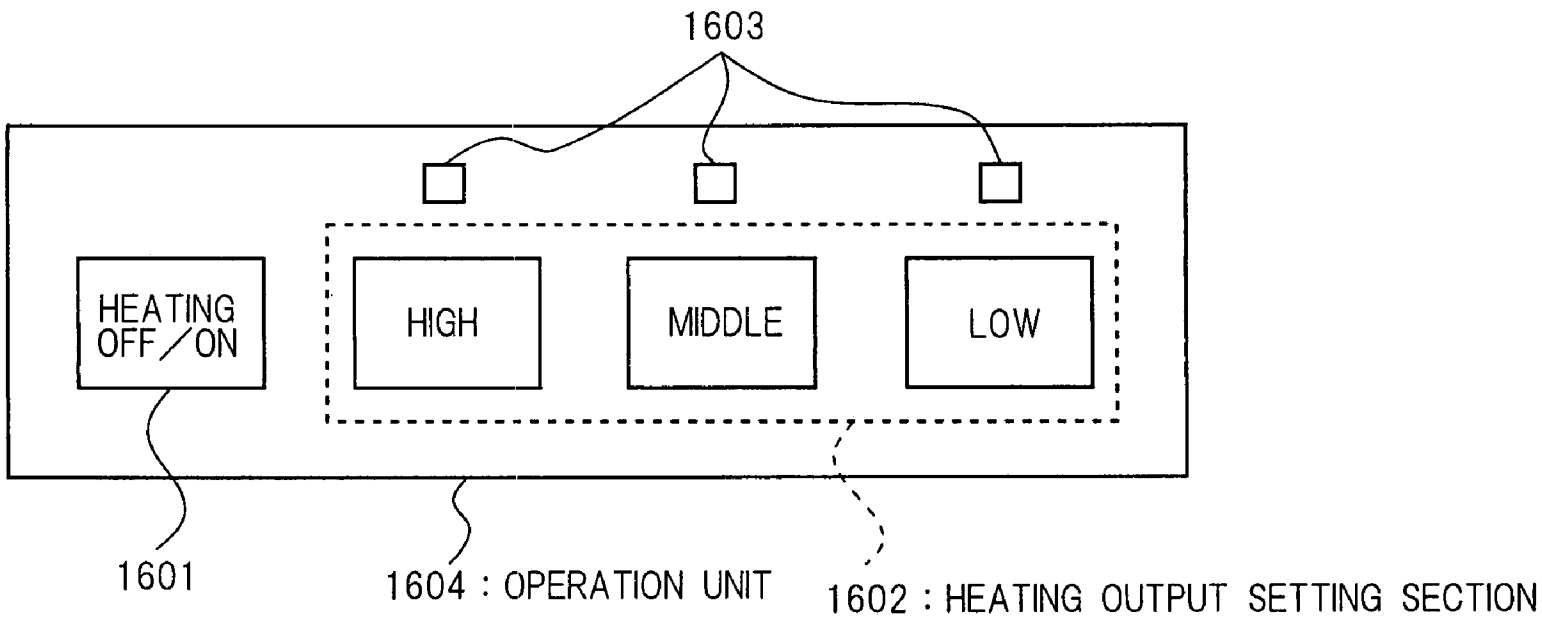
FIG. 16 is a plan view of the principal part of a setting input section of an induction heater in accordance with Embodiment 7 of the present invention.
Figure 17:
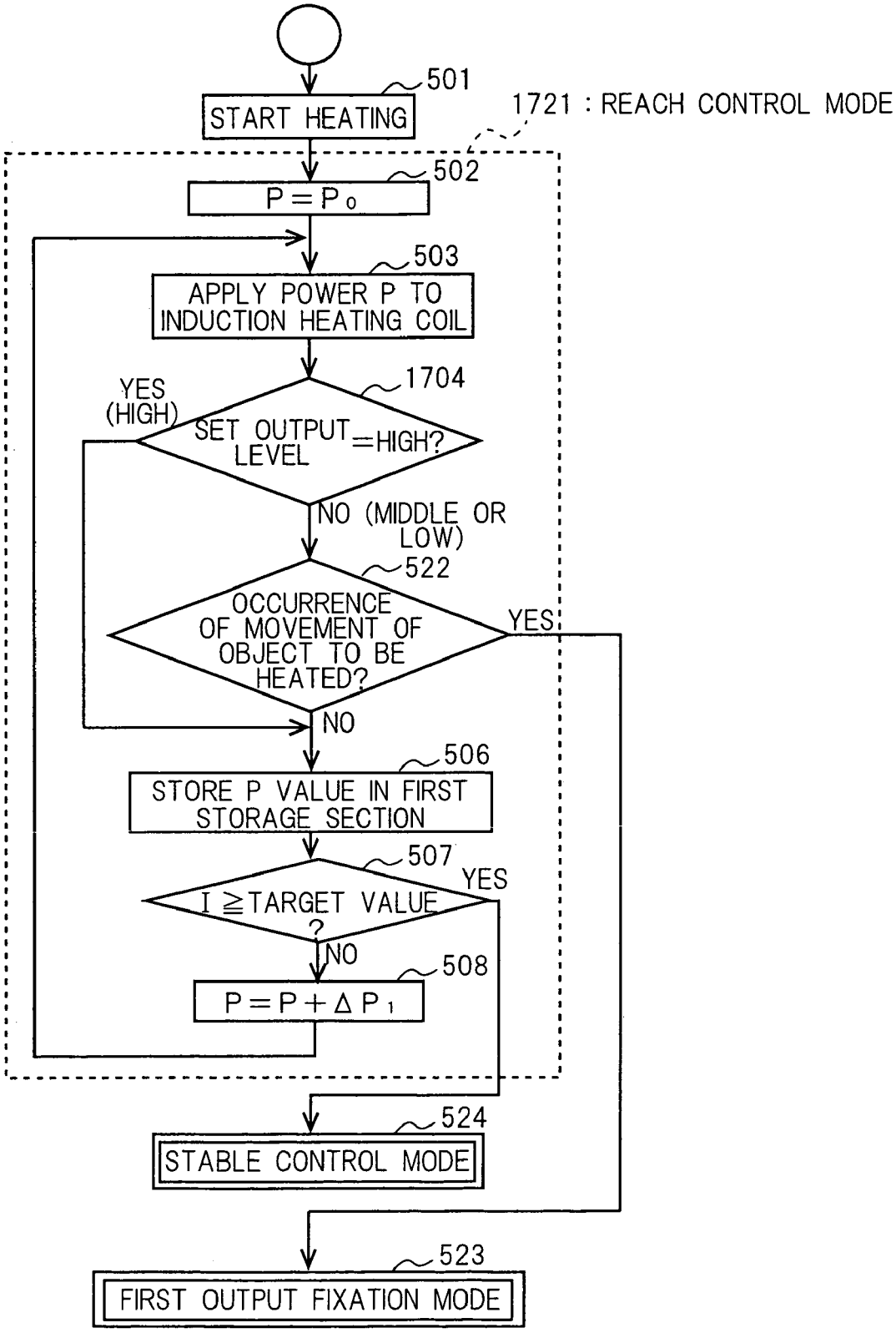
FIG. 17 is a flowchart showing a control method of the induction heater in accordance with Embodiment 7 of the present invention.

With reference to FIG. 16, and FIG. 17, an induction heater (induction heating cooker) in accordance with Embodiment 7 of the present invention will be described. The induction heater in accordance with Embodiment 7 has the same block diagram (FIG. 1) and the same structure as those of the induction heater in accordance with Embodiment 1. The induction heater in accordance with Embodiment 7 has the same configuration as that of the induction heater in accordance with Embodiment 1 (FIG. 1 to FIG. 3) except that the operation unit (FIG. 16) and the control method (FIG. 17) are different than in Embodiment 1 (FIG. 4 and FIG. 5).

FIG. 16 is a plan view of the principal part showing a configuration of an operation unit 1604 of the induction heater in accordance with Embodiment 7. The operation unit 1604 has a heating OFF/ON switch 1601, a heating output setting section 1602, and a setting display section 1603. By pushing the heating ON/OFF key switch 1601, the user can start heating or stop heating. The user selectively pushes three key switches of the heating output setting section 1602 to set the heating output at three output levels. If the "high" key switch is pushed, the high heating output is selected (the output level of "high"), if the "low" key switch is pushed, the low heating output level is selected (the output level of "low"), and if the "middle" key switch is pushed, the heating output at the level between the level of "high" and the level of "low" (output level of "middle") is selected. The heating OFF/ON switch 1601 and the heating output setting section 1602 constitutes the setting input section.

The setting display section 1603 displays one of three LEDs selectively to display the selected output level.

In Embodiment 1, whichever output level (of the first to seventh output levels in FIG. 4) is selected, the first movement detection section 106 determines whether or not the object has moved, and when the object 110 has moved, the control section 104 shifts to the first output fixation mode 523. In the induction heater in accordance with Embodiment 7, when the set output level is "middle" or "low", the first movement detection section 106 detects a movement of the object 110, and, if the object 110 has moved, the control section 104 shifts to the first output fixation mode 523. If the set output level is "high", the first movement detection section 106 does not detect the movement of the object 110.

FIG. 17 is a flowchart showing a control method of the induction heater in accordance with Embodiment 7.

In FIG. 17, steps 501 to 508, the first output control mode 523 and the stable control mode 524 are the same as in Embodiment 1 (FIG. 5). In FIG. 17, the same numerals are applied to the same steps as in FIG. 5. In FIG. 17, step 704 is added between step 503 and step 522 in FIG. 5. Otherwise, the control method of the induction heater in accordance with Embodiment 7 is the same as in Embodiment 1.

The control section 104 inputs the heating start command input through the setting input section 105 by the user to start heating (step 501). The target value of the power source current I to be input by the inverter circuit 102 is established according to the set output level of the heating power ("high", "middle" or "low"). First, the control section goes into a reach control mode 1721. The reach control mode 1721 has steps 502 to 508. In the reach control mode 1721, after the start of heating, while checking whether the object has moved or not, the control section 104 gradually increases the heating output (control value) from a low state to a set output at a nearly constant rate (so that the time differential of the control value output by the control section 104 becomes nearly constant) (FIG. 6). If the object 110 does not move in the process mentioned above, the control section 104 increases the control value until the power source current detected by the output detection section 103 reaches the target value I set at the setting input section 105.

At step 502, the control section 104 set the control value P to P0 (initial value). The inverter circuit 102 applies power (power P) corresponding to the control value P to the induction heating coil 101 (step 503). The control value P output by the control section 104, to be specific, sets the conditions (such as a frequency and a driving time ratio) under which inverter circuit 102 drives the induction heating coil 101. The input current of the inverter circuit 102 changes according to the driving frequency and the duty.

It is checked whether or not the set output level is "high" (step 1704). If the set output level is "high", the sequence proceeds to step 506 (the first movement detection section 106 does not operate.) If the set output level is not "high" (but "middle" or "low"), the sequence proceeds to step 522. At step 522, the first movement detection section 106 checks whether or not the object has moved. If the object has moved, the control section 104 shifts from the reach control mode 521 to the first output fixation mode 523.

If the object has not moved, the sequence proceeds to step 506. The value of P (the control value of the control section 104) is stored in the first storage section 107 (step 506). The control section 104 checks whether or not the power source current detected by the output detection section 103 is equal to or greater than the target value (step 507). If the power source current detected by the output detection section 103 is equal to or greater than the target value, the control section 104 shifts from the reach control mode 1721 to the stable control mode 524. If the power source current detected by the output detection section 103 is less than the target value, the control section 104 increases the control value (power)

P by the predetermined value ΔP1 (step 508). The sequence returns to step 503, the above-mentioned steps are repeated.

In the fry cooking where the frying pan is frequently moved by the user's operation, high heating power is required, so that the induction heater is mostly set at the "high" output level where high heating output can be obtained. Therefore, in the present invention, when the set output level is "high" (the highest output level), the load movement detection function of the first movement detection section 106 is disabled. As a result, in the case wherein the induction heater is set at the "high" output level, even when the user moves the object, the movement thereof is not virtually detected, so that there never occurs a reduction of the heating output or a stop of the heating. The user can carry out cooking without being hindered by the safety function based on a movement of the object.

Next, the description of the case where the aluminum pan is used in stew cooking will be made. In the stew cooking where the object continues to be heated over a low heat for a long time, the user is often away from the object. It is possible that, in the process of the stew cooking, the pan becomes empty of water, and the pan reduced in weight floats and moves by the action of the magnetic field. In the stew cooking, in order that the object is prevented from scorching, the output level (heating output) is often set at the "middle" or "low" output level where low heating output is obtained.

Then, when the output level is set at the "middle" or "low" output level, the first movement detection section 106 becomes operative, thereby detecting a movement of the object (load).

In the present embodiment, the dedicated input section (for example, a switching section) for the switching of the first movement detection section 106 between "operative" and "inoperative" is not provided. In relation to the heating output setting section 1602, which is the usual input setting section, the switching of the first movement detection section 106 between "operative" and "inoperative" is performed. Without being purposefully operated by the user, the induction heater automatically performs the switching of the control method according to the usage. The present invention realizes a user-friendly induction heater.

In Embodiment 7, the induction heater is configured so that the function of the first movement detection section 106 is suppressed or disabled according to the settings at the heating output setting section 1602 (in Embodiment 7, the output level). As a result, the inconvenience in cooking caused by inappropriate activation of the safety function based on a movement of the object is mitigated. An induction heater having the improved usability can be obtained.

In order that the function of the first movement detection section 106 is suppressed or stopped, the detection method or the detection sensitivity may be changed, the degree of the suppression may be changed with the detection method and the detection sensitivity left unchanged, or both the detection method and the detection sensitivity may be changed at the same time.

The induction heater in accordance with Embodiment 7 has the heating output setting section 1602 for switching the heating output in three levels—"high", "middle", and "low". However, not that the levels of the heating output are limited thereto, but that heating output may have two levels or more than three levels. In addition, the induction heater may be configured so that the setting of the heating output can be continuously adjusted. In any of these cases, the same effect as in the present embodiment can be obtained.

In Embodiment 7, the switching of the first movement detection section 106 between "operative" and "inoperative" is done in response to the setting (output level) of the heating output of "high", "middle", or "low". Instead of this, for example, the threshold value of the gradient (time differential) of the power source current input by the inverter circuit 102 which becomes a criterion for the detection determination made by the first movement detection section 106 may be changed. For example, at the output level where the heating output is "high", the threshold value of the gradient of the power source current input by the inverter circuit 102 which becomes a criterion for the detection determination of the load movement is lowered. In other words, the sensitivity to determine that the object has moved by buoyant force is decreased so that it becomes difficult to detect the load movement. At the output level where the heating output is "low", the threshold value of the gradient of the power source current input by the inverter circuit 102 which becomes a criterion for the detection determination of the load movement is raised, in other words, the sensitivity to determine that the object has moved by buoyant force is enhanced so that it becomes easy for the first movement detection section 106 to detect the load movement.

For example, at step 505 in FIG. 5, if the output level is "high", the threshold value is changed from 0.7 to 0 (only when the present change amount ΔI is negative, the first movement detection section 106 determines that the object 110 has moved).

For example, at step 505, when the difference between the present change amount LI and the previous change amount ΔI is calculated and it is checked whether or not the difference is less than the threshold value, if the output level is "high", the threshold value is changed from the usual value of 10 to 0.

For example, at step 505, if the output level is "middle" or "low", it is checked whether or not the object has moved only once. If the output level is "high", the detection of whether or not the object has moved is done a plurality of times at predetermined intervals, and only when it is determined that the object 110 has moved a predetermined number of times (for example, ten times) in a row, the determination that the object 110 has moved truly may be made.

By doing as mentioned above, the effect which is similar to that mentioned above can be obtained.

Even when the control section 104 inputs the signals from the first movement detection section 106 and the heating output setting section 307 and similarly exercises control of the heating output such as maintaining, stopping, or lowering the heating output, the same effect as in the present embodiment can be obtained. For example, the function of the first movement detection section 106 is always set operative, and when the first movement detection section 106 detects the movement of the object 110, if the setting (output level) of the heating output setting section 1602 is "middle" or "low", the control section 104 shifts to the first output fixation mode, whereas if the output level is "high", the control section 104 maintains the usual operation.

Instead of the first movement detection section 106, the second movement detection section 1201 may be used.

In the present embodiment, the fist movement detection section 106 detects a movement of the object based on the gradient of the power source current input by the inverter circuit 102. The method by which the first movement detection section 106 detects the movement of the object is arbitrary. For example, the first movement detection section 106 may detect the movement of the object based on the change of the induction heating coil current and the change of the resonant capacitor voltage. The first movement detection section 106 may detect the movement of the object using an optical or mechanical sensor. Any method will suffice so long as it serves the purpose of the present invention that the safety function based on a movement of the object is suppressed or disabled according to the settings at the operation unit (input unit).

In the present embodiment, the first movement detection section 106 observes the change of the heating coil current with time during the softstart period when heating is started (in the reach control mode) to detect a float or a movement of the object. In the stable control mode, it is possible to measure the induction heating coil current, or another current or voltage associated with the induction heating coil output and observe the change thereof to detect the movement of the object caused by buoyant force.

For example, when the power source current decreases from the control stability state, the time which equals or exceeds a predetermined length of time elapses from when the power source current starts to decrease until it recovers to the control stability state or a predetermined value, so that it can be determined that the movement of the pan has been caused by buoyant force.

In another embodiment, when the first movement detection section 106 detects the movement of the object in the reach control mode, the control section 104 shifts to the stable control mode where the value derived based on the output value of the output detection section 103 stored by the first storage section 107 at the previous time is set as a target output.

<<Embodiment 8>>

Figure 18:
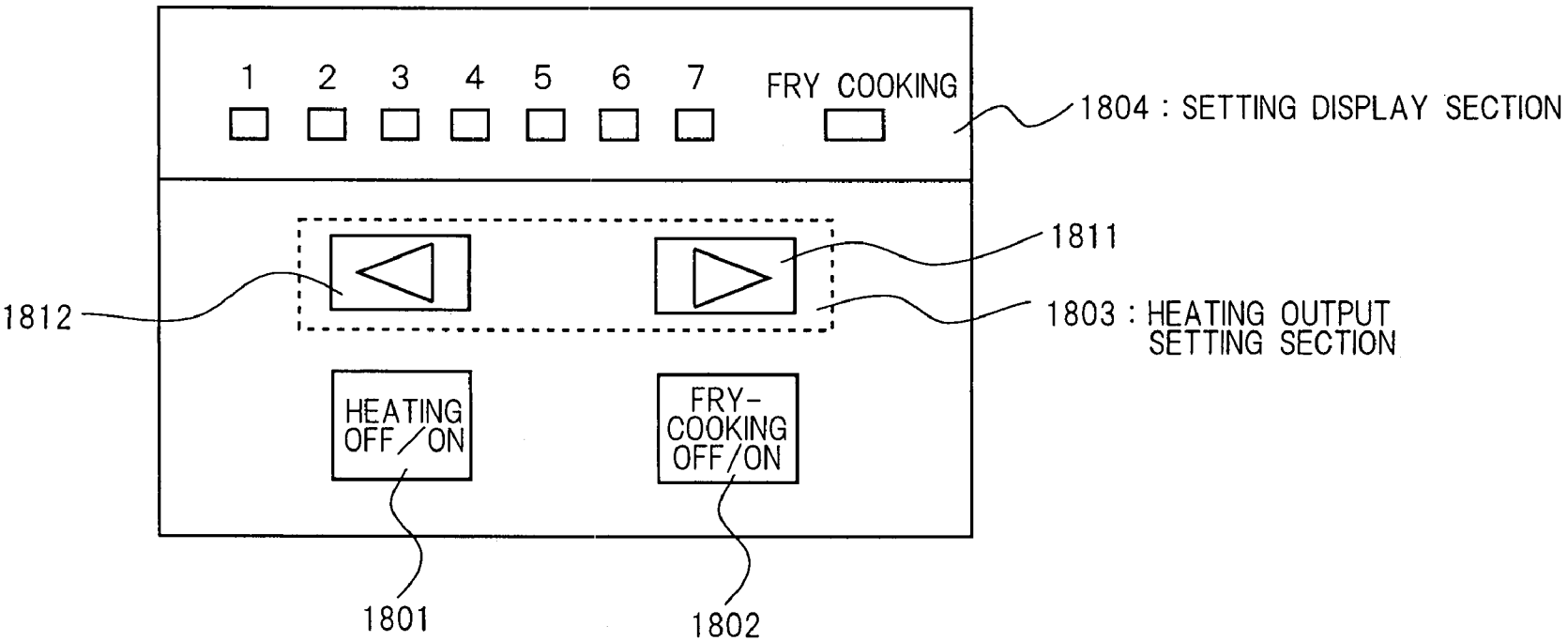
FIG. 18 is a plan view of the principal part of a setting input section of an induction heater in accordance with Embodiment 8 of the present invention.
Figure 19:
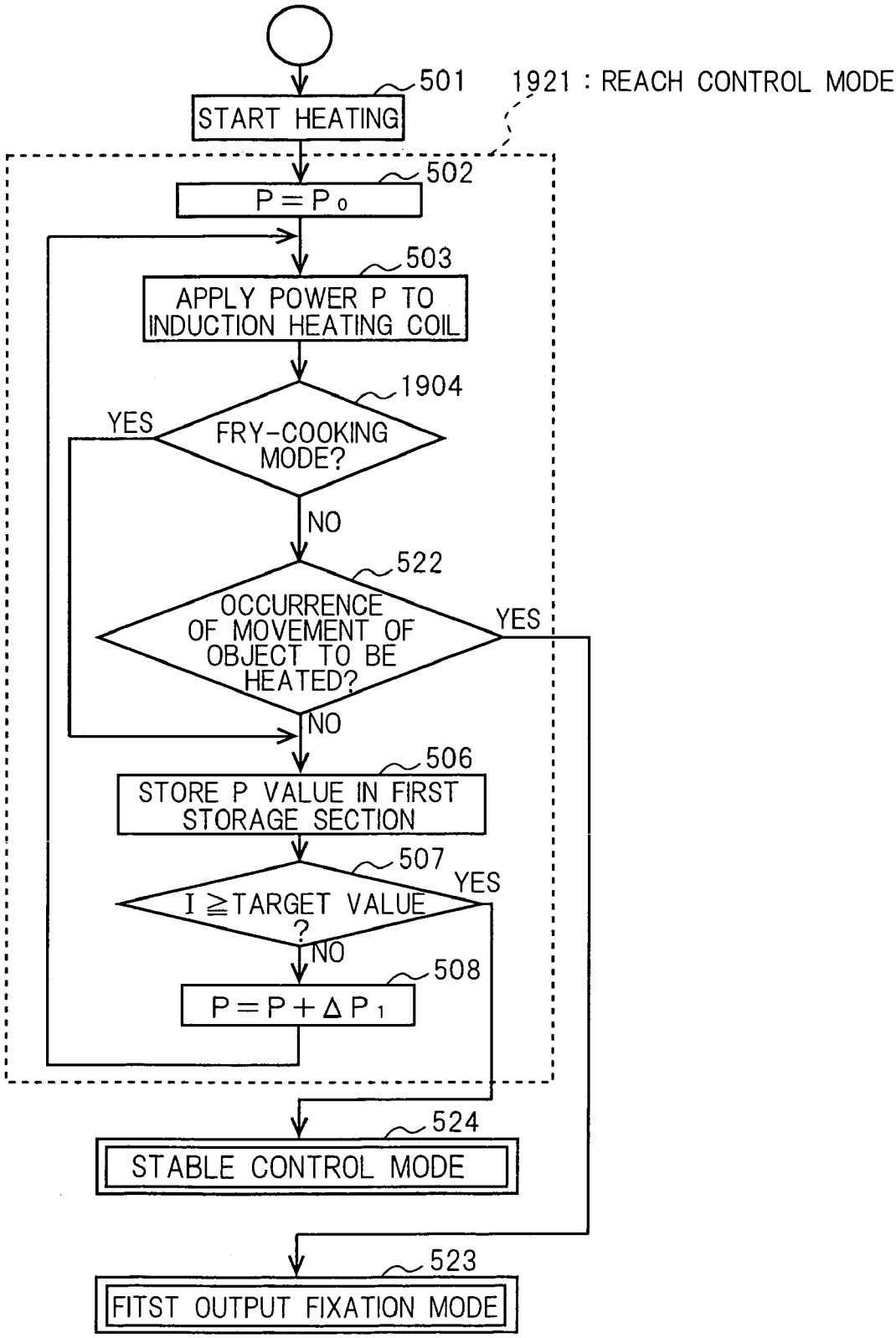
FIG. 19 is a flowchart showing a control method of the induction heater in accordance with Embodiment 8 of the present invention.

With reference to FIG. 18 and FIG. 19, an induction heater (induction heating cooker) in accordance with Embodiment 8 will be described. The induction heater in accordance with Embodiment 8 has the same block diagram (FIG. 1) and the same structure as those of the induction heater in accordance with Embodiment 7. The induction heater in accordance with Embodiment 7 has the same configuration as that of the induction heater in accordance with Embodiment 8 (FIG. 16, and FIG. 17) except for an operation unit (FIG. 18) and a control method (FIG. 19). Since the basic configuration in accordance with the present embodiment is the same as in Embodiment 7, the different points will be mainly described. The same numerals are applied to the same functions as in Embodiment 7, and the descriptions thereof are omitted.

FIG. 18 is a plan view of the principal part showing the configuration of the operation unit of the induction heater in accordance with Embodiment 8. The operation unit has a heating OFF/ON key switch 1801, a fry cooking OFF/ON key switch 1802 (a fry cooking selection section), a heating output setting section 1803, and a setting display section 1804. By pushing the heating ON/OFF key switch 1801, the user can start or stop heating. The user pushes two key switches of the heating output setting section 1803 selectively to set the output level of the heating output. With the push of a key switch 1811 on the right, one higher level of heating output is selected, whereas with the push of a key switch 1812 on the left, one lower level of heating output is selected. By pushing the fry cooking ON/OFF key switch 1803, the user can select the fry cooking mode or the normal mode. The heating OFF/ON key switch 1801, the fry cooking OFF/ON key switch 1802, and the heating output setting section 1803 constitutes a setting input section.

The setting display section 1804 lights up one of seven LEDs selectively to display the selected output level, and turns a fry cooking LED on or off to display whether or not the fry cooking mode is selected.

FIG. 19 is a flowchart showing the control method of the induction heater in accordance with Embodiment 8.

In FIG. 19, step 1704 in FIG. 17 is replaced with step 1904 (in this connection, the numeral of the reach control mode is changed from 1721 to 1921). Otherwise, FIG. 19 is the same as FIG. 17. First, step 503 and then only the processing in the vicinity of step 1904 will be described.

The inverter circuit 102 applies power corresponding to the control value P (power P) to the induction heating coil 101 (step 503). The control value P output by the control section 104, specifically, sets the conditions (such as a frequency and a driving time ratio) under which the inverter circuit 102 drives the induction heating coil 101. According to the driving frequency and the duty, the input current of the inverter circuit 102 is changed.

It is checked whether or not the induction heater is currently placed in the fry-cooking mode (step 1904). If it is in the fry-cooking mode, the sequence proceeds to step 506 (the first movement detection section 106 does not operate). If it is not in the fry-cooking mode (if it is in the normal mode), the sequence proceeds to step 522. At step 522, the first movement detection section 106 checks whether or not the object has moved. If the object has moved, the control section 104 shifts from the reach control mode 521 to the first output fixation mode 523.

If the object has not moved, the sequence proceeds to step 506. Thereafter, the operation which is similar to that in Embodiment 7 is performed.

In the case of the fry cooking, a frying pan is used as the object to be heated. By pushing the fry cooking selection section 1802, the fry-cooking mode is selected and heating is started. The fry cooking LED of the setting display section 1804 lights up. In the fry cooking, the user usually attends the induction heater to carry out cooking with high heating power flipping over the item being cooked. In Embodiment 8, when the fry-cooking mode is selected, the load movement detection function of the first movement detection section 106 becomes inoperative. In the case of fry cooking, since the user carries out cooking flipping over the item being cooked, the frying pan, which is the object to be heated, is sometimes moved. In the fry-cooking mode, since the load movement detection of the first movement detection section 106 is inoperative, even when the user moves the object, the first movement detection section 106 does not detect the movement of the load. Even when the user moves the object, the induction heater maintains the high heating output without lowering nor stopping the heating output.

Next, when stew cooking is carried out, the heating output setting section 1803 is operated. The user pushes the heating OFF/ON key switch 1801, so that induction heater starts heating. The fry cooking LED of the setting display section 1804 goes out. The user sets the heating power through the heating output setting section 1803. When the user pushes the heating OFF/ON key switch 1801 to start cooking, the load movement detection function of the first movement detection section 106 becomes operative. The first movement detection section 106 detects a movement of the object. When the movement of the object is detected, the induction heater lowers the heating output or stops heating. As a result, the object is prevented from moving.

Furthermore, since the fry cooking selection section (fry cooking OFF/ON key switch) 1802, which is a change input section, is provided as an independent key switch, the operation of the induction heater is simple and easy to understand. The user can disable or suppress the load detection function as required.

The fry cooking OFF/ON key switch 1802 may be deleted, and instead, for example, by pushing the heating OFF/ON key switch 1801 three times in a row at short intervals, the fry cooking mode may be selected (the heating OFF/ON key switch 1801 is also used as the change input section). Space savings in the operation unit can be made.

In Embodiment 8, when the fry cooking selection section 1802 is operated, the load movement detection function of the first movement detection section 106 is disabled. It is also possible to make the load movement detection function of the first movement detection section 106 difficult to operate substantially, instead of disabling the load movement detection function of the first movement detection section 106.

In Embodiment 8, as an example of the change input section, "the fry cooking" is provided. However, naturally, the change input section is not limited thereto, but a similar switch may be provided as the change input section for another kind of cooking where the object is moved by the user's operation, for example, "rolled egg".

In Embodiments 7 and 8, the key switches are provided in the operation unit. Instead of them, any change section such as a dial, a sound input section, or a voice recognition input section may be provided. When the method of the cooking where the object is moved by the user's operation is selected through the change section, the effect of the present invention can be obtained.

In the present embodiment, the control section 104 and the inverter circuit 102 each are operated by the switching element driving frequency control. Instead of this, even when the control section and the inverter circuit is operated by an output control method such as the input voltage control method or a switching element driving duty control method, the effect of the present invention can be obtained.

In order that the function of the first movement detection section 106 suppressed or stopped, the detection method or the detection sensitivity may be changed, the degree of the suppression may be changed with the detection method and the detection sensitivity left unchanged, or both the detection method and the detection sensitivity may be changed at the same time.

In another embodiment, when the first movement detection section 106 detects a movement of the object in the reach control mode, the control section 104 shifts to the stable control mode where the value derived based on the output value of the output detection section 103 stored by the first storage section 107 at the previous time is set as a target output.

In the induction heaters in accordance with Embodiments 7 and 8, the control method may be changed as described below. When the first movement detection section 106 detects the movement of the object in the reach control mode, the control section 104 may stop the inverter circuit. For example, by setting the heating output at output level of "high" through the heating output setting section, or by setting the fry cooking mode, the detection sensitivity of the movement detection section may be decreased or the detection thereof may be stopped, or the control operation of the control section 104 may be weakened or may not be performed.

<<Embodiment 9>>

Figure 20:
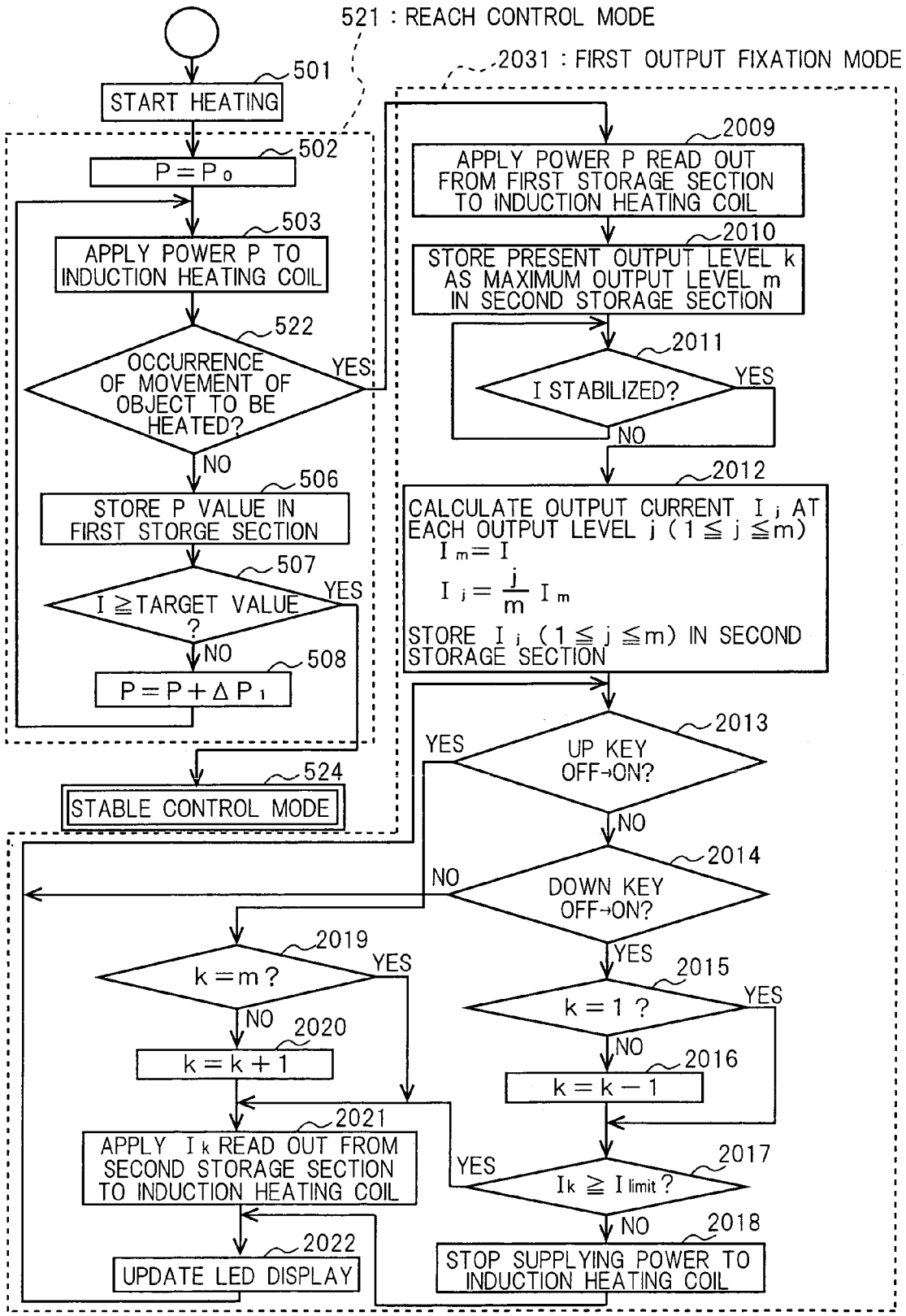
FIG. 20 is a flowchart showing a control method of an induction heater in accordance with Embodiment 9 of the present invention.

With reference to FIG. 20, an induction heater (induction heating cooker) in accordance with Embodiment 9 will be described. The induction heater in accordance with Embodiment 9 has the same block diagram as that of the induction heater in accordance with Embodiment 3. In the induction heater in accordance with Embodiment 9, the control method (including a display method of the setting display section 113) is different from that in accordance with Embodiment 3. Otherwise, Embodiment 9 is the same as the Embodiment 3.

FIG. 20 is a flowchart showing a control method (including the display method of the setting display section 113) of the induction heater in accordance with Embodiment 9. With reference to FIG. 20, the control method of the induction heater in accordance with Embodiment 9 will be described. In FIG. 20, step 501, the reach control mode 521 (steps 502 to 508), and the stable control mode 524 are the same as in Embodiment 1 (FIG. 5). In FIG. 20, the same numerals are applied to the same steps as in FIG. 5.

The control section 104 inputs the heating start command input through the setting input section 105 by the user to start heating (step 501). First, the control section 104 goes into the reach control mode 521. When the power source current detected by the output detection section 103 reaches the target value I set at the setting input section 105, the control section 104 shifts from the reach control mode 521 to the stable control mode 524. When the first movement detection section 106 detects a movement of the object 110 in the course of the reach control mode 521, the control section 104 shifts from the reach control mode 521 to a first output fixation mode 2031.

In Embodiment 9, the processing after the control section 104 goes into the first output fixation mode 2031 differs than that in Embodiment 3. The processing after the control section 104 goes into the first output fixation mode 2031 will be described in detail. In the first output fixation mode 2031, the control section 104 outputs a constant control value. The first output fixation mode 2031 has steps 2009 to 2022. First, the control section 104 outputs the control value P read out from the first storage section to apply power P to the induction heating coil 101 (step 2009). The control section 104 stores the present output level k as the maximum output level m (so that it is impossible to set the output at the output level higher than the output level m) in the second storage section 901 (step 2010).

Next, it is checked whether or not the power source current I detected by the output detection section 103 has stabilized (step 2011). If the power source current I has not stabilized, the step 2011 is repeated. If the power source current I has stabilized, the sequence proceeds to step 2012. At step 2011, the power source current I detected by the output detection section 103 is stored in the second storage section 901. The control section 104 compares the power source current I newly detected by the output detection section 103 with the power source current I stored in the second storage section 901 at the previous time. If the difference is within a predetermined range, and a predetermined length of time has elapsed since the shift of the control section 104 to the output fixation mode 2031, the control section 104 determines that the power source current I has stabilized. When the difference between the power source current I newly detected by the output detection section 103 and the power source current I stored in the second storage section 901 at the previous time is outside the predetermined range, or the predetermined length of time has not elapsed since the shift of the control section 104 to the output fixation mode 2031, the control section 104 determines that the power source current I has not stabilized.

At step 2012, the new target value of the power source current of each output level is calculated and stored. To be specific, the target value of the m level is set to the power source current I-stored in the second storage section 901 (the stable value). With regard to each of the other output levels, the target value Ij ($1 \leqq j < m$) is calculated from the equation, $Ij = j \cdot Im/m$. The calculated new target value Ij ($1 \leqq j \leqq m$) is stored in the second storage section 901.

At step 2013, it is checked whether or not the user had pushed the UP key switch (whether or not the UP key switch has changed from the OFF state to the ON state). If the UP key switch has been pushed, the sequence proceeds to step 2019. If it has not been pushed, the sequence proceeds to step 2014.

At step 2014, it is checked whether or not the user has pushed the DOWN key switch (whether the DOWN key switch has changed from the OFF state to the ON state). If the DOWN key switch has been pushed, the sequence proceeds to step 2015. If it has not been pushed, the sequence returns to step 2013.

At step 2015, it is checked whether the present output level k is 1 or not. If the present output level k is 1, the sequence proceeds to step 2017. If the present output level k is not 1 (k=2), k is decremented (step 2016). The sequence proceeds to step 2017.

At step 2017, it is checked whether or not the target value Ik of the present output level k is equal to or greater than the minimum value of the power source current, "I limit". If the target value Ik is equal to or greater than the minimum value of the power source current "I limit", the sequence proceeds to step 2021. If the target value Ik is less than the minimum value of power source current, "I limit", the control section 104 makes the inverter circuit 102 stop supplying power to the induction heating coil 101 (step 2018). The minimum value "I limit" is the lowest power source current which the inverter circuit 102 can output with stability.

At step 2019, it is checked whether or not k is equal to m (the highest output level). If k is equal to m, the sequence proceeds to step 2020. If k is not equal to m, k is incremented (step 2020).

At step 2021, with the value Ik (the value of the output level k which is among the new target values Ij ($1 \leqq j \leqq m$) stored at step 2012) read out from the second storage section as a new target value, power is applied to the induction heating coil. In Embodiment 9, at the m output level, control is exercised in the first output fixation mode (where the control value output by the control section 104 is fixed at the value stored in the first storage section 107). At the first to (m−1) output levels, the control section 104 goes into the stable control mode to exercises control where the target value is set to Ik.

At step 2022, the LED display of the setting display section 113 (FIG. 4) is updated. The sequence returns to step 2013.

In Embodiment 9, if the movement of the movement of the object is detected in the reach control mode 521, instead of the standard target value in the stable control mode, the target value is set to the value derived based on the power source current stored in the second storage section 901 (the detection signal of the output detection section 103) (the value calculated and stored at step 2012).

If the power source current which is the standard target value related to each output level (the standard output value which is set in relation to each output level) is supplied to the inverter circuit 102, the light-weight pan, which is the object to be heated can be moved. In Embodiment 9, even in such a case, the target value is automatically decreased and the output of the inverter circuit 102 is reduced in the stable control mode, so that neither a slippage nor a float of the pan is caused. The pan is safely heated with stable power.

In Embodiment 9, if the target value calculated and stored at step 2012 is lower than the minimum value "I limit" of the power source current which the inverter circuit 102 can output with stability, the inverter circuit 102 is stopped (step 2018). When the pan which is too light-weight to be heated is the object, the heating can be automatically stopped, so that the induction heater which is highly safe can be obtained.

The standard target value Ij ($1 \leqq j \leqq 7$) of the power source current at each output level (in Embodiment 9, each of the first to seven output levels) in the stable control mode is stored in the non-volatile memory of the induction heater in advance.

In another embodiment, the control method described below is performed. In the reach control mode, the first storage section 107 stores the output value of the output detection section 103 before the first movement detection section 106 detects a movement of the object 110. When the first movement detection section 106 detects the movement of the object, the control section 104 shifts to the stable control mode where the value derived based on the output value (the maximum value in the range of the output value at which the object does not move) of the output detection section 103 stored by the first storage section 107 at the previous time (the derived value may be, for example, the maximum value itself, or may be the value obtained by subtracting a predetermined correction value from the maximum value) is set as a target output. In the stable control mode, the first storage section 107 (or the second storage section) stores the control value output by the control section 104 (or the output value of the output detection section 103) at certain time intervals. If the difference between the control value output by the control section 104 (or the output value of the output detection section 103) which the first storage section 107 stored at the previous time and the control value output by the control section 104 (or the output value of the output detection section 103) which is newly stored therein is within a predetermined range and a predetermined length of time has elapsed since the shift of the control section 104 to the stable control mode, the control section 104 changes the target output value set by the setting input section 105 into the value derived based on the control value output by the control section 104 (or the output value of the output detection section 103) which is stored in the first storage section 107. At the first to m output levels, the control section 104 goes into the stable control mode and exercises control where the target value is set to Ik. Otherwise, by performing the processing which is similar to that described above, the effect which is similar to that in Embodiment 9 can be obtained.

<<Embodiment 10>>

Figure 21:
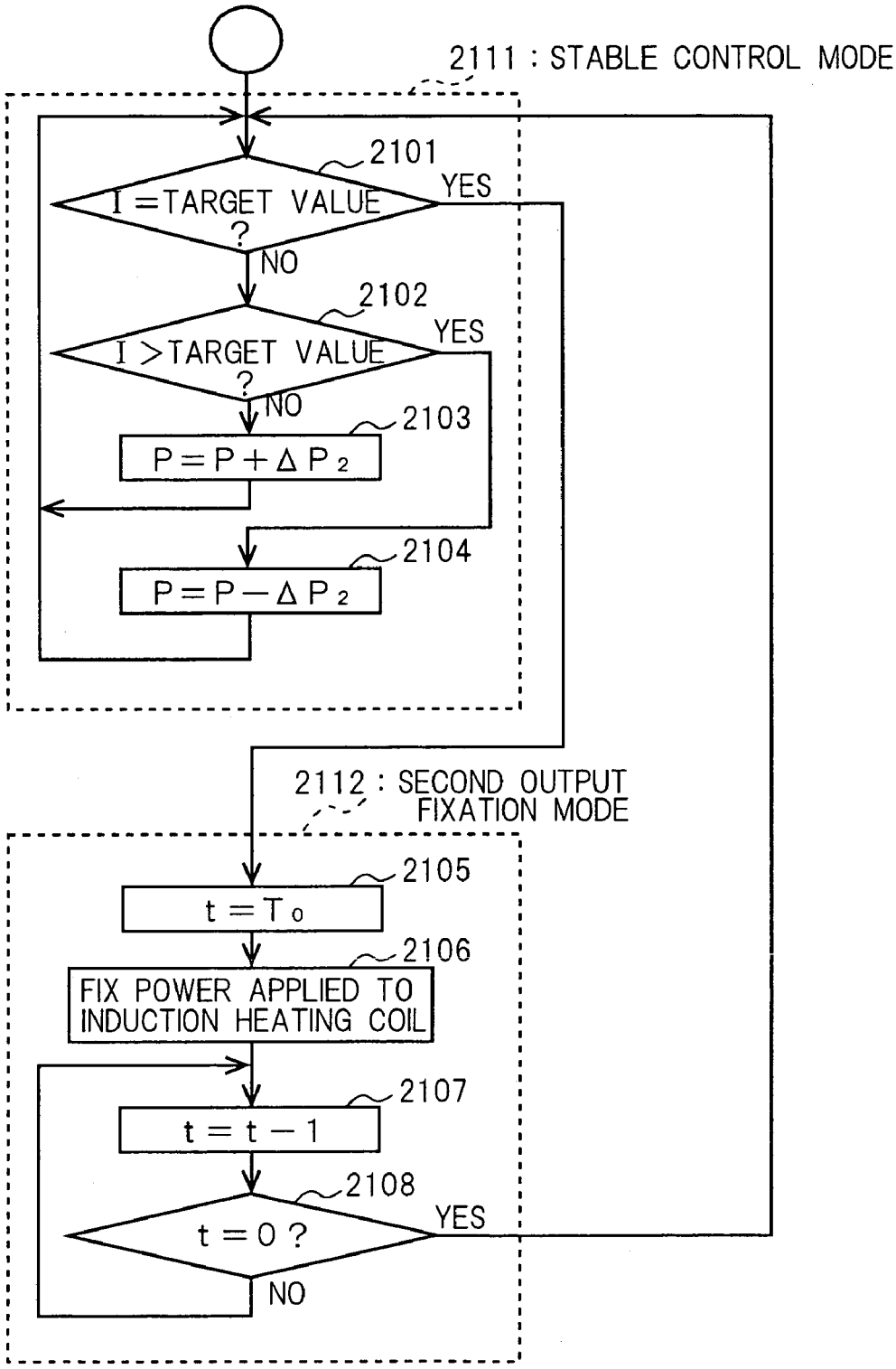
FIG. 21 is a flowchart showing a control method of an induction heater in accordance with Embodiment 10 of the present invention.
Figure 22:
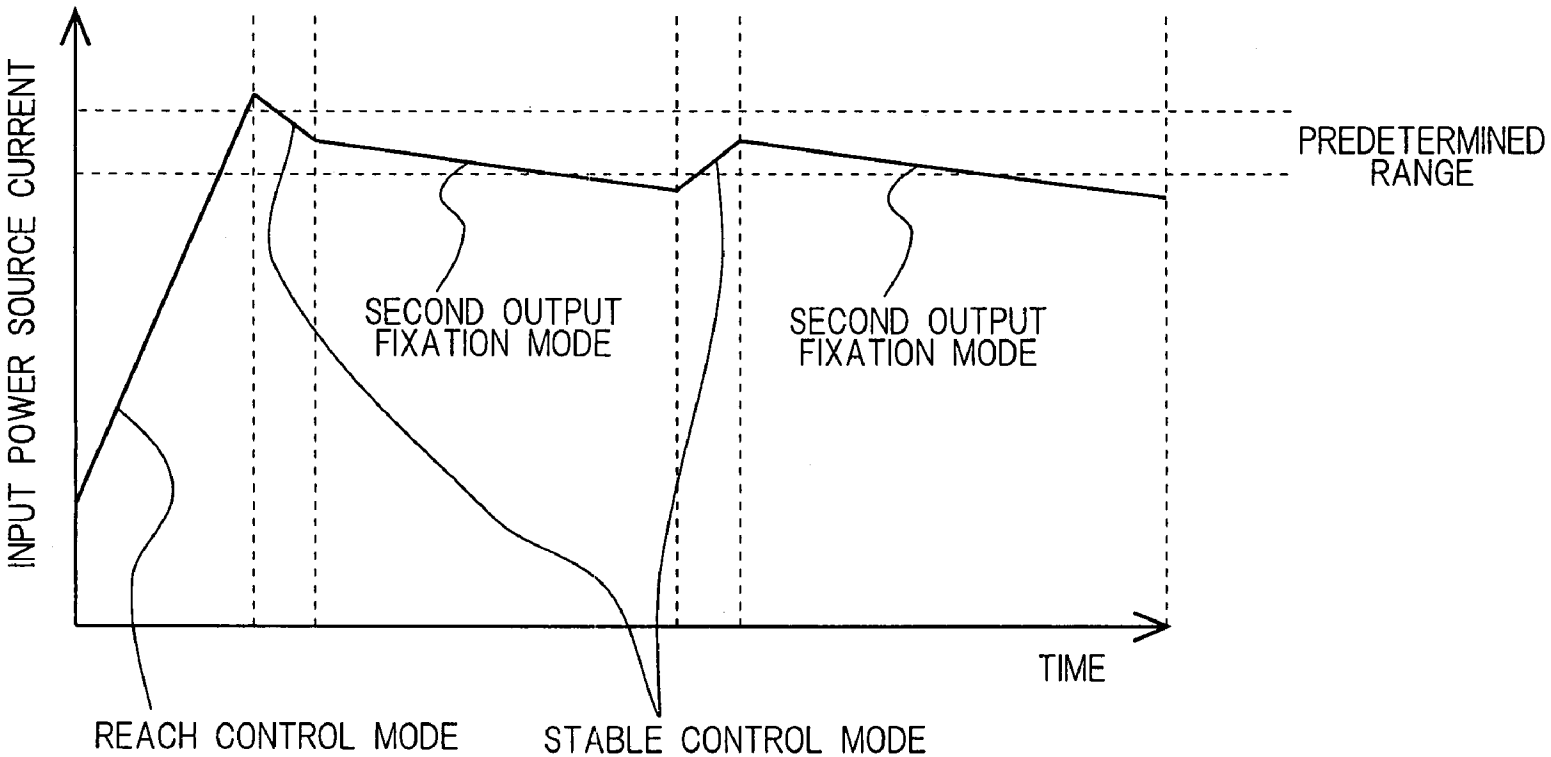
FIG. 22 is a timing chart illustrating the operation of the induction heater in accordance with Embodiment 10 of the present invention.

With reference to FIG. 21 and FIG. 22, an induction heater (induction heating cooker) in accordance with Embodiment 10 will be described. The induction heater in accordance with Embodiment 10 has the same block configuration and the same structure as those of the induction heater in accordance with Embodiment 1 (FIG. 1 to 4). These descriptions thereof are omitted. In the induction heater in accordance with Embodiment 10, the control method of the control section 104 differs from that in accordance with Embodiment 1. FIG. 21 is a flowchart showing a control method of the induction heater in accordance with Embodiment 2. FIG. 22 is a timing chart showing a state of the change in the input power source of the inverter circuit 102 of the induction heater in accordance with Embodiment 10. In FIG. 22, the horizontal axis indicates time, while the vertical axis indicates the input power source of the inverter circuit 102. With reference to FIG. 21 and FIG. 22, the control method of the induction heater in accordance with Embodiment 10 will be described.

With regard to step 501, the reach control mode 521, and the first output fixation mode 523 in FIG. 5, Embodiment 10 is the same as Embodiment 1. Embodiment 10 differs from Embodiment 1 in the control method in the stable control mode (in another embodiment, it may be the case where, in the course of the reach control mode, a movement of the pan is detected, and subsequently, the control section exercises control so that the output of the inverter agrees with a lowered target output). The processing after the shift to a stable control mode 2111 is made will be described in FIG. 21.

The stable control mode 2111 has steps 2101 to 2104. The processing loop from step 2101 to step 2104 is executed repeatedly at regular time intervals until the exit from the processing loop is made. First, at step 2101, it is checked whether or not the power source current of the inverter circuit 102 detected by the output detection section 103 is the same as the target value. If the difference between the power source current and the target value is within a predetermined range, they are generally considered to be the same. If the power source current is the same as the target value, the control section 104 shifts to a second output fixation mode 2112. If the power source current is not the same as the target value, the sequence proceeds to step 2102. At step 2102, it is checked whether or not the power source current is greater than the target value. If the power source current is smaller than the target value, the control section 104 increases the control value P by the predetermined value ΔP2 and outputs the increased control value P (step 2103). The inverter circuit 102 supplies the new power P to the induction heating coil 101. The sequence returns to step 2101, and the above-mentioned processing is repeated if the power source current is greater than the target value, the control section 104 decreases the control value P by the predetermined value ΔP2 and outputs the decreased control value P (step 2104). The inverter circuit 102 supplies the new power P to the induction heating coil 101. The sequence returns to step 2101, and the above-mentioned processing is repeated.

The second output fixation mode 2112 has steps 2105 to 2108. First, at step 2105, the value of the timer is set to T0 (initial value). Next, the control section 104 fixed the control value at the present value and outputs the fixed value (the detection signal (power source current) of the output detection section 103 is not fed back). Next, the processing loop from step 2107 to step 2108 is executed repeatedly at regular time intervals until the exit from the loop is made. Timer t is decremented (step 2107). Next, it is checked whether the timer t is 0 or not (step 2108). If the timer t is 0, the control section 104 returns from the second output fixation mode 2112 to the stable control mode 2111. If the timer t is not 0, the sequence returns to step 2107.

As shown in FIG. 21 and FIG. 22, in the induction heater in accordance with Embodiment 10, the stable control mode 2111 and the second output fixation mode 2112 alternates with each other. When by the stable control mode 2111, the difference between the power source current and the target value is within a predetermined range (for example, AD conversion value of plus or minus 1), the shift to the output fixation mode 2112 is made. In the second output fixation mode 2112, if a predetermined length of time T0 (for example, about one second) elapses, the shift to the stable control mode 2111 is made.

By fixing the output in a state where the target output value can be obtained, the adverse influence of the disturbance can be eliminated, and the variations in the output of the inverter circuit 102 can be reduced. As a result, the detection accuracy of the first movement detection section and/or the second movement detection section can be improved.

<<Embodiment 11>>

Figure 23:
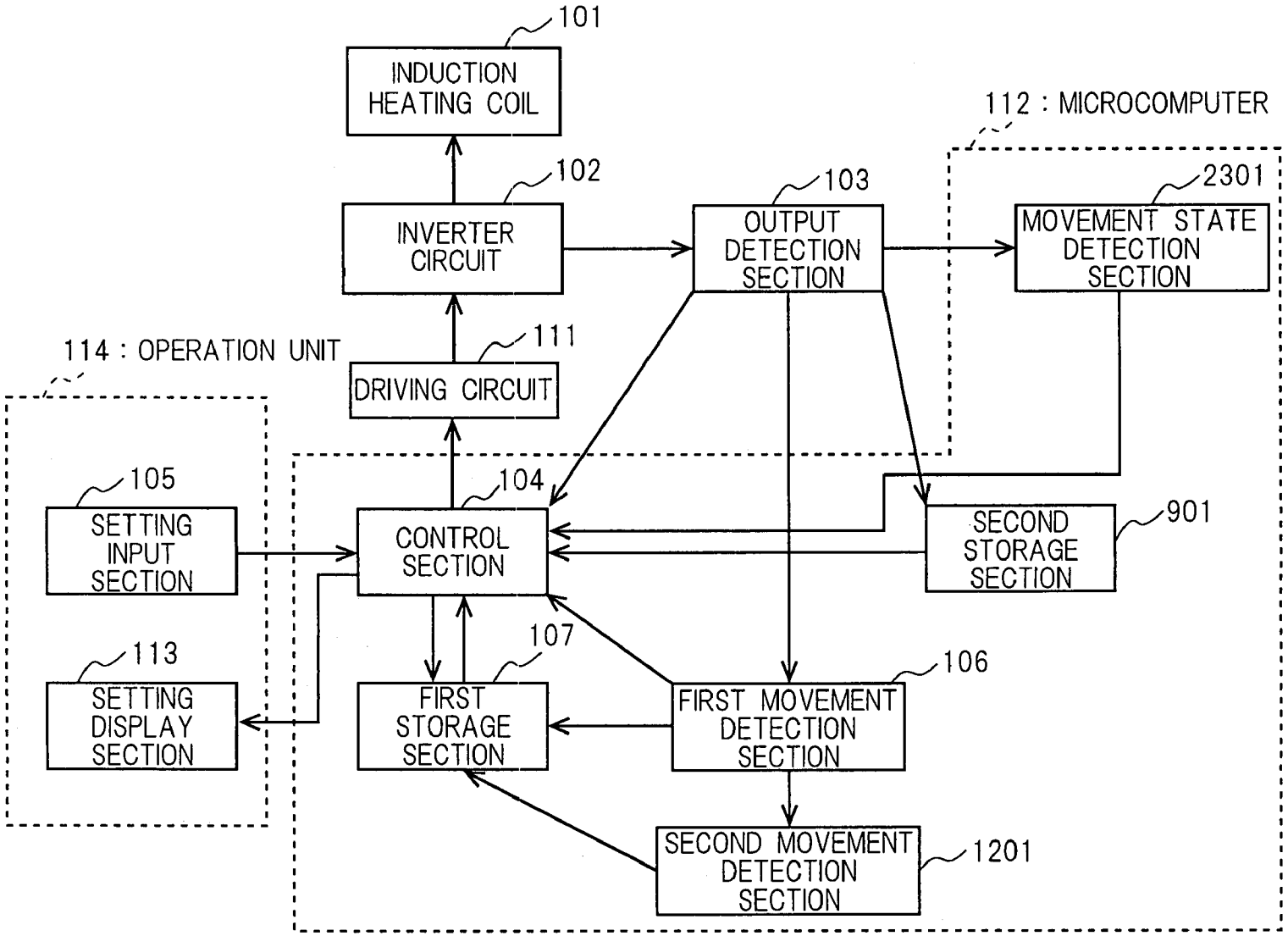
FIG. 23 is a block diagram showing a configuration of an induction heater in accordance with Embodiments 11 and 12 of the present invention.
Figure 24:
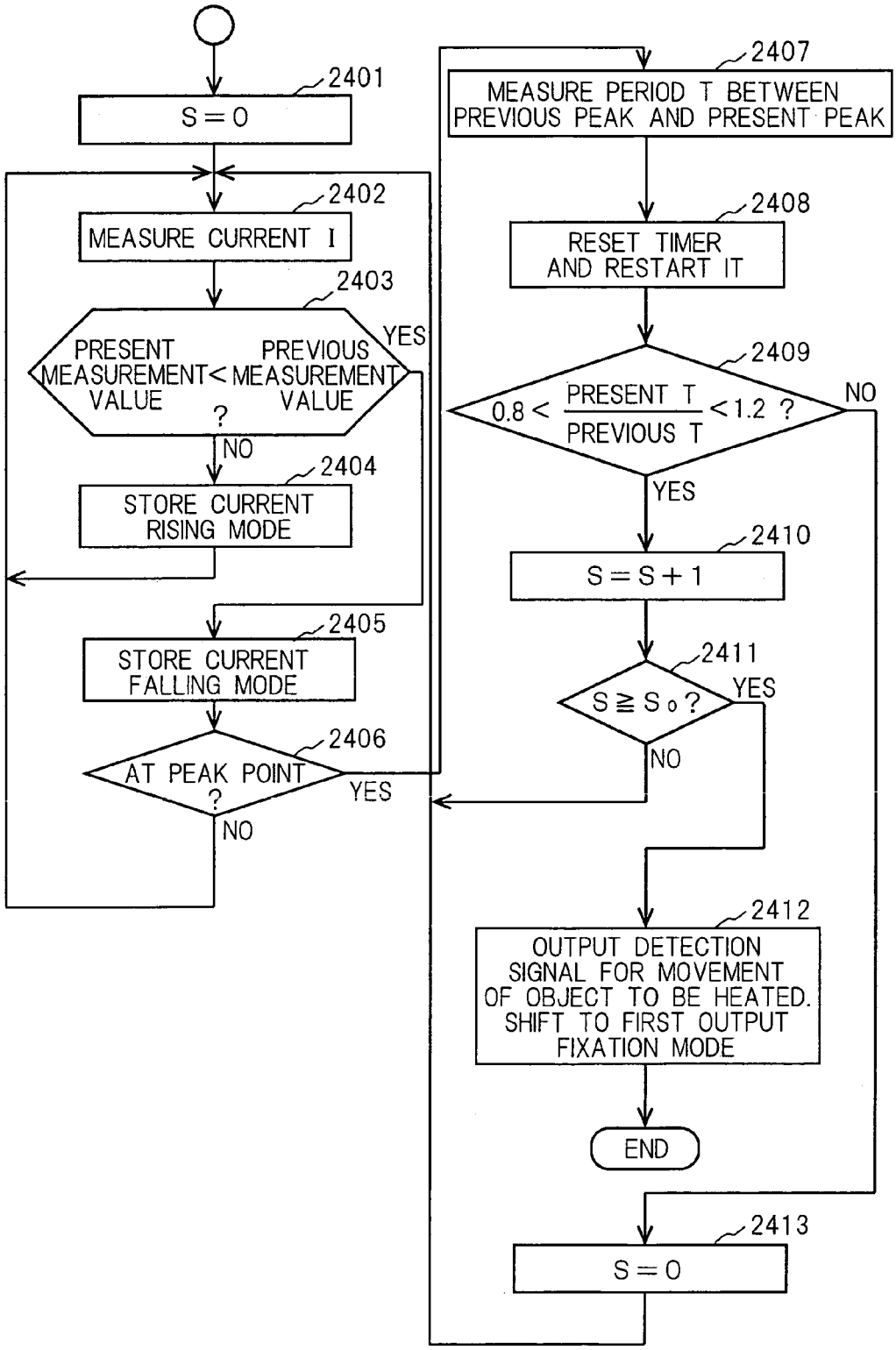
FIG. 24 is a flowchart showing a control method of the induction heater in accordance with Embodiment 11 of the present invention.
Figure 25:
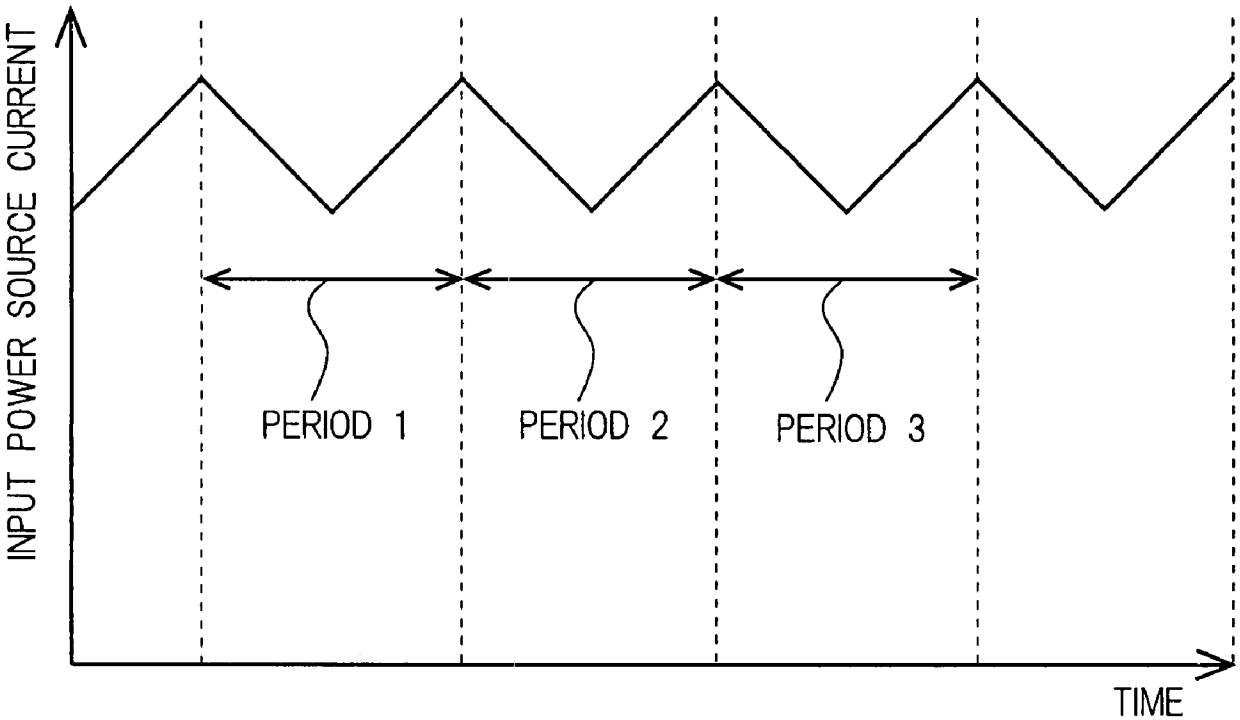
FIG. 25 is a timing chart illustrating the operation of the induction heater in accordance with Embodiment 11 of the present invention.

With reference to FIG. 23 to FIG. 25, an induction heater (induction heating cooker) in accordance with Embodiment 11 of the present invention will be described. FIG. 23 shows a block diagram of the induction heater in accordance with Embodiment 11. The induction heater in accordance with Embodiment 11 has a movement state detection section 2301 in addition to the configuration in accordance with Embodiment 6 (FIG. 12). The microcomputer 112 has the control section 104, the first movement detection section 106, the first storage section 107, the second storage section 901, the second movement detection section 1201, and the movement state detection section 2301. The function of the movement state detection section 2301 is carried out by software. Otherwise, the induction heater in accordance with Embodiment 11 has the same configuration as that of the induction heater in accordance with Embodiment 6.

In the stable control mode, the movement state detection section 2301 determines whether or not the change period of the power source current of the inverter circuit 102 detected by the output detection section 103 (which is equivalent to the output value of the inverter circuit 102) is successively within a predetermined range (the differences among the periods are within the predetermined range). If the change period of the power source current is successively within the predetermined range (if the periods are nearly uniform), it can be considered that the object is moving by the action of the magnetic field of the induction heating coil. In such a case, the control section 104 shifts to the first output fixation mode. If the change period of the power source current is not successively within the predetermined range (if the periods are not uniform), it is considered that the user is moving the object. In such a case, the control section 104 maintains the stable control mode.

FIG. 24 is a flowchart showing a control method of the movement state detection section 2301 of the induction heater in accordance with Embodiment 11. FIG. 25 is a timing chart showing a state of the change in the input power source current of the inverter circuit 102 of the induction heater in accordance with Embodiment 11 of the present invention. In FIG. 25, the horizontal axis indicates time, while the vertical axis indicates the input power source current of the inverter circuit 102. With reference to FIG. 24 and FIG. 25, the control method of the induction heater in accordance with Embodiment 11 will be described. The movement state detection section 2301 performs the processing in FIG. 24 in a state where the control section 104 is placed in the stable control mode. In FIG. 24, first, S is set to 0 (initial value) (step 2401). S is a count value representing the number of times that the change period of the power source current lies within the predetermined range successively.

Next, the output detection section 103 measures the power source current I (step 2402). Next, it is checked whether or not the present measurement value of the power source current I is less than the previous measurement value thereof (step 2403). If the present measurement value of the power source current I is less than the previous measurement value thereof, the power source current falling mode is stored (step 2405). Next, it is checked whether or not power source current I is presently at its peak point (in the previous measurement, it is in the power source current rising mode and in the present measurement, the change to the power source current falling mode is made) (step 2406). If it is at its peak point, the sequence proceeds to step 2407. If it is not at its peak point, the sequence returns to step 2402. The processing loop from steps 2402 to step 2406 is executed repeatedly at regular time intervals until the exit from the processing loop is made.

At step 2403, if the present measurement value of the power source current I is not less than the previous measurement value thereof, the power source current rising mode is stored (step 2404). The sequence returns to step 2402.

At step 2407, the period T between the previous peak and the present peak is measured. The timer is reset, and restarted (step 2408). Next, the ratio obtained by dividing the present period by the previous period is calculated. It is checked whether or not the following inequality holds: 0.8<(the present period/the previous period)<1.2 (step 2409). If the inequality holds, S is incremented (step 2410). Next, it is checked whether or not S is equal to or greater than a predetermined value S0 (in the embodiment, 3) (step 2411). If S is less than the predetermined value S0, the sequence returns to step 2402. If S is equal to or more than the predetermined value S0 (as shown in FIG. 25, almost the same period is repeated S0 times in a row), the movement state detection section 2301 outputs the detection signal for the movement of the object to the control section 104. The control section 104 shifts to the first output fixation mode (step 2412).

At step 2409, if the inequality does not hold (if the period changes), S is reset to 0 (step 2413). The sequence returns to step 2402.

In Embodiment 11, according to whether or not the change period of the output of the output detection section 103 is successively within the predetermined range in the stable control mode, it is determined whether the object has moved by the outside force, or a slippage or a float of the object has been caused by the repelling magnetic field because the object is lightweight.

FIG. 25 shows an example in the case where, since the object is lightweight, the slippage or the float thereof has been caused by the repelling magnetic field. In the induction heater in accordance with the present embodiment, when the time lengths of the period 1, period 2, period 3 are measured, and the differences among them lie within a predetermined length of time, it is determined that since the object is lightweight, the slippage or float thereof has been caused by the repelling magnetic field. When the differences are not within the predetermined length of time, it is determined that the object has been moved by the outside force.

In the case where the user carries out cooking grasping the frying pan by the handle, if the control section 104 is in the stable control mode, the induction heater can determines that the user is carrying out cooking grasping the frying pan by the handle and the frying pan is not moving by the action of the magnetic field. When the user carries out cooking grasping the frying pan by the handle, the safety function based on a movement of the object is not activated so that a user-friendly induction heater can be obtained.

In the present embodiment, the movement state detection section 2301 measures a peak-to-peak time of the input power source current (the output of the output detection section 103) as a period. The measurement method of the period is arbitrary. For example, the period is a time period from the time the input power source current value (or the current value of the induction heating coil) increases to a predetermined value until it increases to the same value the next time. The period is, for example, a time period from the time the control value reaches the minimum value until it reaches the minimum value the next time. The period is, for example, a time period from the time the weight sensor reaches the maximum value until it reaches the maximum time the next time.

In the present embodiment, a plurality of periods are measured and, based on a plurality of periods, the movement state detection section 2301 determines whether the object has moved by the outside force, or the slippage or the float thereof has been caused by the repelling magnetic field because the object is lightweight. Instead of this, one period (for example, the time period from when the control value or the output of the output detection section reaches a certain value until it reaches the same value again) is measured, and based on the measured period, it may be determined whether the object has moved by the outside force or the slippage or the float thereof has been caused by the repelling magnetic field because the object is lightweight. In general, when the user moves the pan, after reaching a certain value, the control value or the output of the output detection section returns to the value within a certain time period, albeit irregularly. When the slippage or the float of the object is caused by the repelling magnetic field, the pan continues moving in one direction so that, after reaching a certain value, the control value or the output of the output detection section does not returns to the value within a predetermined time period. Based on this, the determination mentioned above can be made.

In another embodiment, at step 2412, the control section 104 shifts to the stable control mode where the target value is lowered. By performing the above-mentioned processing, the effect which is similar to that in Embodiment 11 can be obtained.

<<Embodiment 12>>

Figure 26:
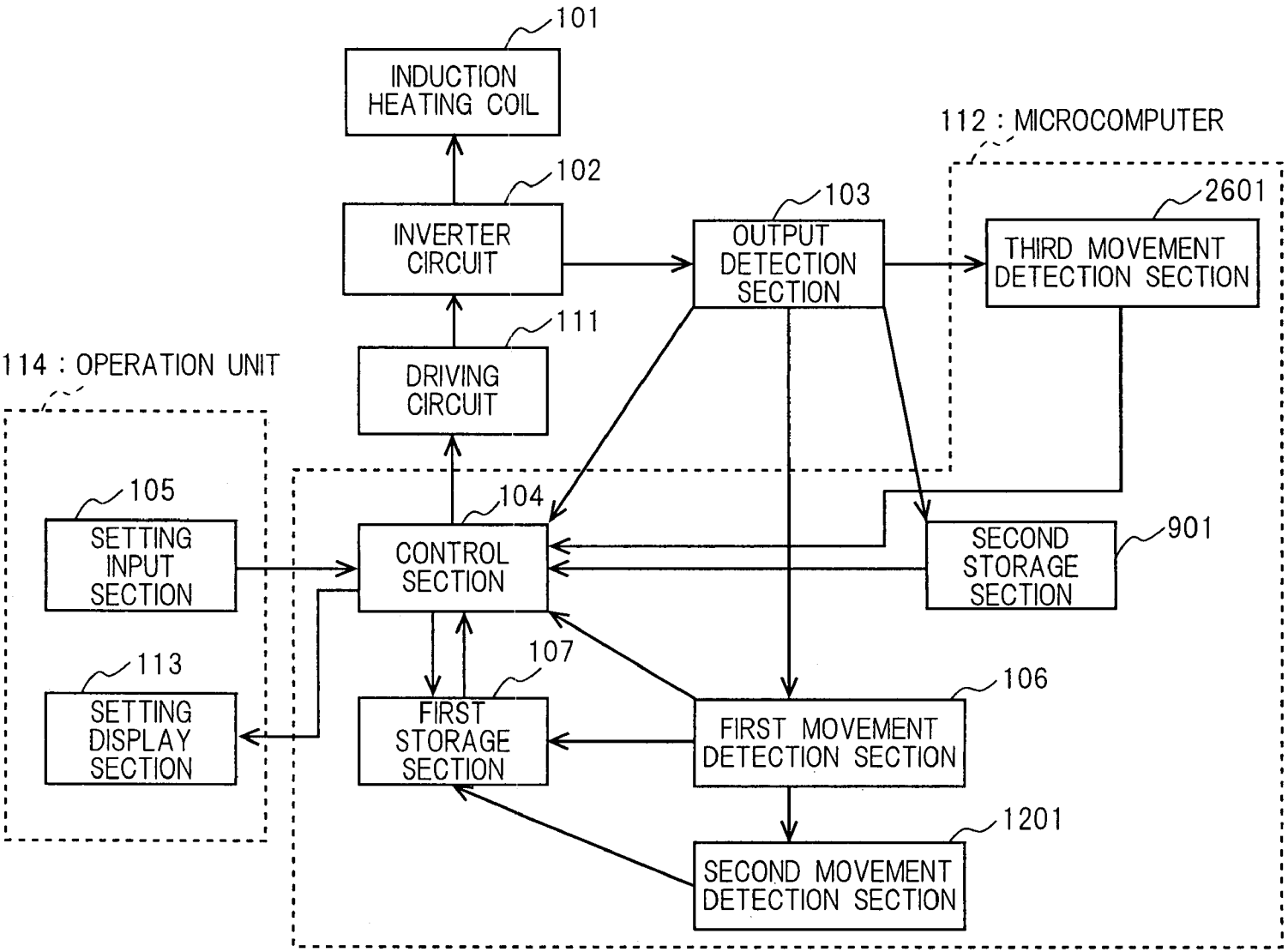
FIG. 26 is a block diagram showing a configuration of the induction heater in accordance with Embodiment 12 of the present invention.
Figure 27:
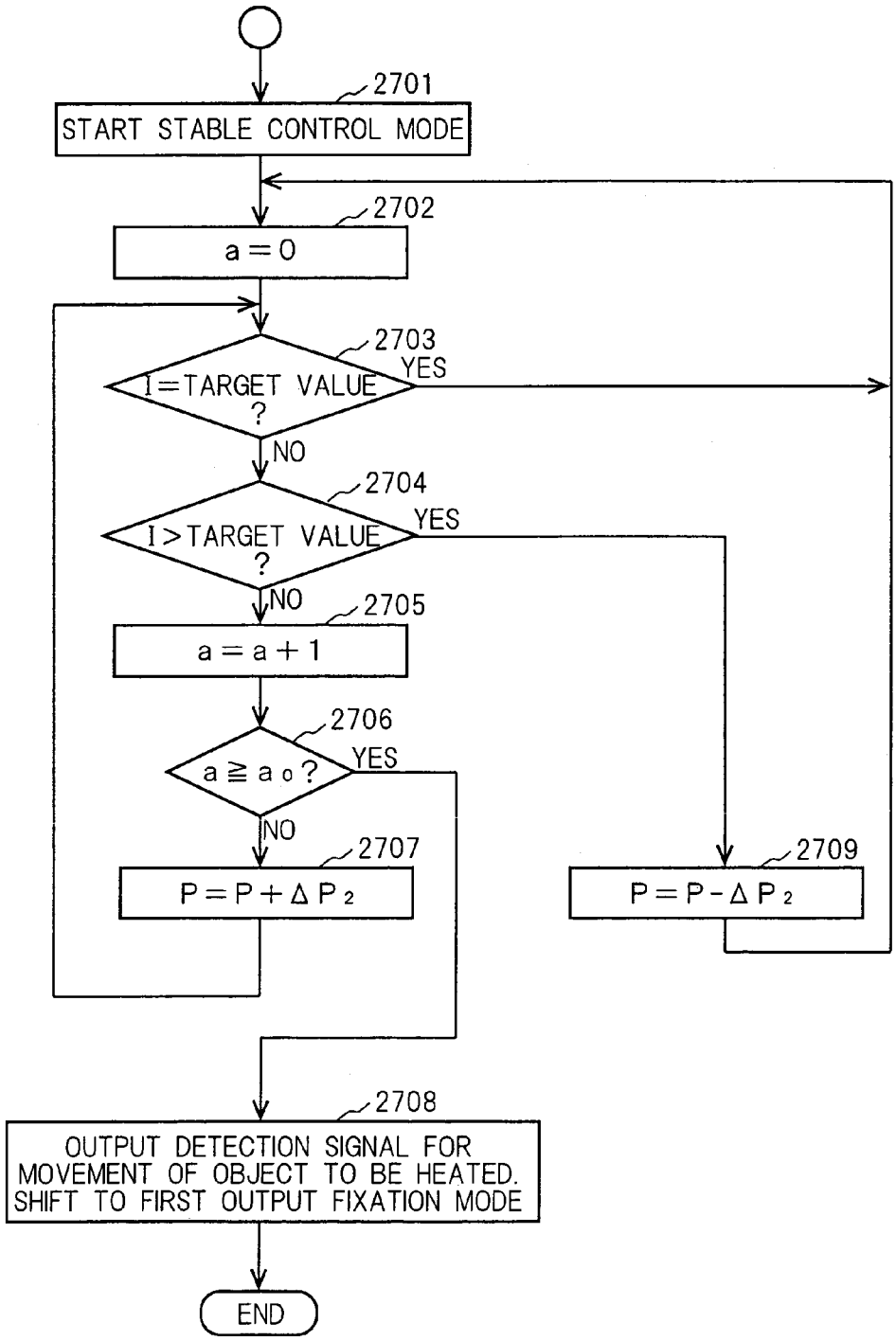
FIG. 27 is a flowchart showing a control method of the induction heater in accordance with Embodiment 12 of the present invention.

With reference to FIG. 23, FIG. 26, and FIG. 27, an induction heater (induction heating cooker) in accordance with Embodiment 12 of the present invention will be described. FIG. 26 shows a block diagram of the induction heater in accordance with Embodiment 12. The induction heater in accordance with Embodiment 12 has a third movement detection section 2601 in addition to the configuration in accordance with Embodiment 6 (FIG. 12). The microcomputer 112 has the control section 104, the first movement detection section 106, the first storage section 107, the second storage section 901, the second movement detection section 1201, and the third movement detection section 2601. The function of the third movement detection section 2601 is performed by software. Otherwise, the induction heater in accordance with Embodiment 12 has the same configuration as that of the induction heater in accordance with Embodiment 6.

If the control value output by the control section 104 continuously increases (if the control value output by the control section 104 a predetermined number of times increases monotonously) in the stable control mode, the third movement detection section 2601 determines that the object is moving by the action of the magnetic field.

Figure 28:
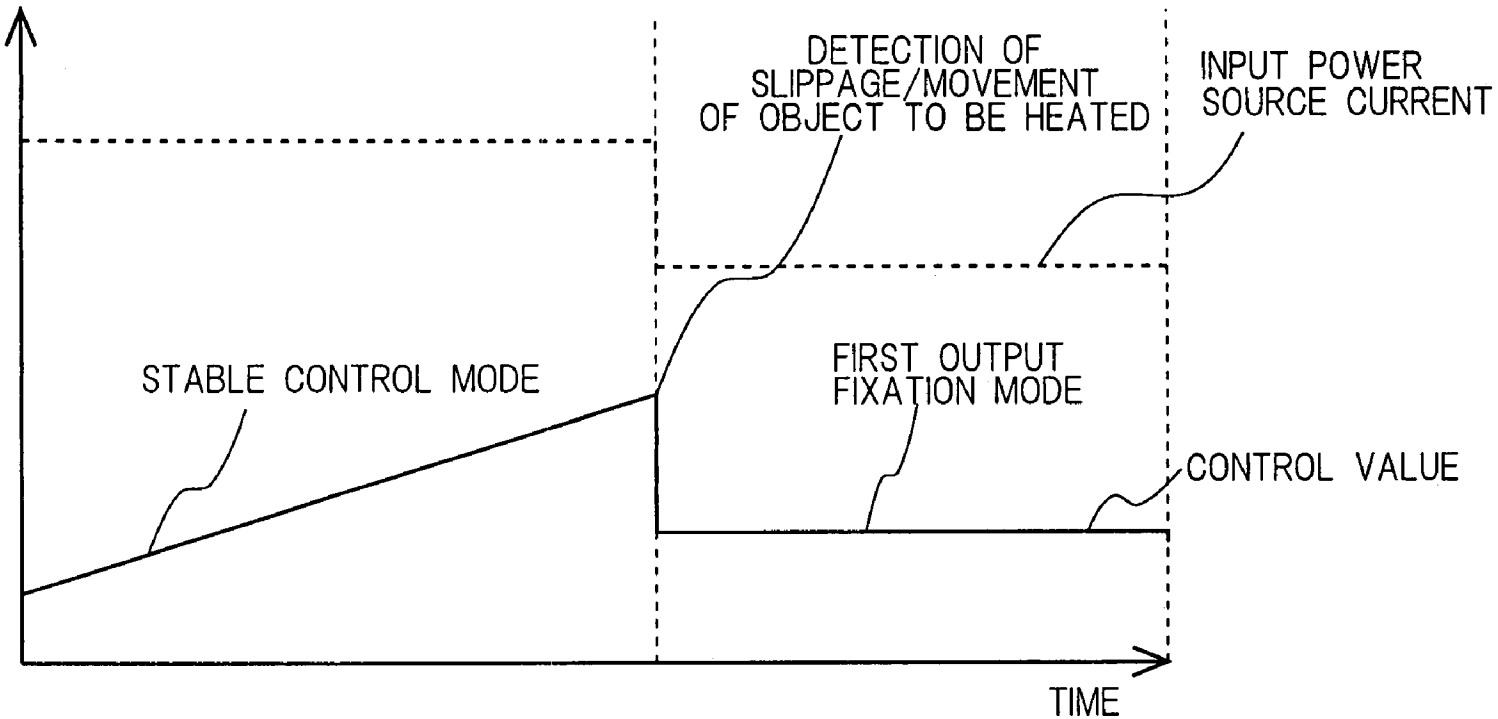
FIG. 28 is timing chart illustrating the operation of the induction heater in accordance with Embodiment 12 of the present invention.

FIG. 28 is a timing chart showing changes of the control value and input power source current with time of the induction heater in accordance with Embodiment 12 of the present invention. In FIG. 28, the horizontal axis indicates time, while the vertical axis indicates the control value (solid-line graph) and the input power source current of the inverter circuit 102 (dashed-line graph). When the object is moving by the action of the magnetic field, the magnetic coupling between the induction heating coil and the object is gradually reduced, so that if the control value remains constant, the power source current of the inverter circuit 102 detected by the output detection section 103 (which is equivalent to the output value of the inverter circuit 102) continuously decreases (the power source current detected by the output detection section 103 decreases monotonously). In the stable control mode, since the control section 104 tries to maintain the power source current constant, in this case, the control value output by the control section 104 continuously increases (FIG. 28). That the control value output by the control section 104 continuously increases means that the control value is changed so that the output of the inverter circuit 102 increases. For example, the driving frequency of the inverter circuit 102 is increased. For example, the ON period of the transistors 102*c* and 102*d* of the inverter circuit 102 is made longer (the duty of the ON period is increased).

When the user moves the object, the movements of the object are random, so that the control value output by the control section 104 varies irregularly. The possibility that the third movement detection section 2601 erroneously determines that the object is moving by the action of the magnetic field is remote.

FIG. 27 is a flowchart showing a control method of the third movement detection section 2601 of the induction heater in accordance with Embodiment 12. With reference to FIG. 27, and FIG. 28, the control method of the induction heater in accordance with Embodiment 12 will be described. The third movement detection section 2601 performs the processing in FIG. 27 in a state where the control section 104 is placed in the stable control mode. In FIG. 27, first, the control section 104 starts the stable control mode. A value a is set to 0 (initial value) (step 2702). The value a is a count value representing the number of times the control value output by the control section 104 increases monotonously.

Next, the output detection section 103 measures the power source current I. It is checked whether or not the measured power source current I is the same as the target value (it is determined that the power source current I is the same as the target value if it is within a predetermined allowable range) (step 2703). If the measured power source current I is the same as the target value, the sequence returns to step 2702. The processing loop from step 2702 to step 2703 is executed repeatedly at regular time intervals until the exit from the processing loop is made.

If the power source current I measured at step 2703 is not the same as the target value, it is checked whether or not the measured power source current I is greater than the target value (step 2704). If the measured power source current I is greater than the target value, the control section 104 decreases the control value P by the predetermined value ΔP2 (step 2709). The sequence returns to step 2702. The processing loop comprising steps 2702 to 2704 and step 2709 is executed repeatedly at regular time intervals until the exit from the processing loop is made.

At step 2704, if the measured power source current I is less than the target value, the value a is incremented (step 2705). Next, it is determined whether or not the value a is equal to or greater than a predetermined value a0 (for example, 10) (step 2706). If the value a is less than the predetermined value a0, the control section 104 increases the control value P by the predetermined value ΔP2 (step 2707). The sequence returns to step 2703. The processing loop from step 2703 to step 2707 is executed repeatedly at regular time intervals until the exit from the processing loop is made.

At step 2706, if the value a is equal to or greater than the predetermined value a0, the third movement detection section outputs the detection signal for the movement of the object to the control section 104. The control section 104 shifts to the first output fixation mode (step 2708).

When the user is carrying out cooking grasping the frying pan by the handle, if the control section 104 is in the stable control mode, it can be determined that the user is carrying out cooking grasping the frying pan by the handle and the frying pan is not moving by the action of the magnetic field. When the user carries out cooking grasping the frying pan by the handle, the safety function based on a movement of the object is not activated, so that a user-friendly induction heater can be obtained.

For example, even when the pan is gradually slipped from above the induction heating coil, or even when the pan is gradually reduced in weight by evaporation or the like to float, the induction heater of the present invention can detect the slippage of the pan.

In another embodiment, at step 2708, the control section 104 shifts to the stable control mode where the target value is lowered. By performing the above-mentioned processing, the effect which is similar to that in Embodiment 12 can be obtained.

<<Embodiment 13>>

Figure 29:
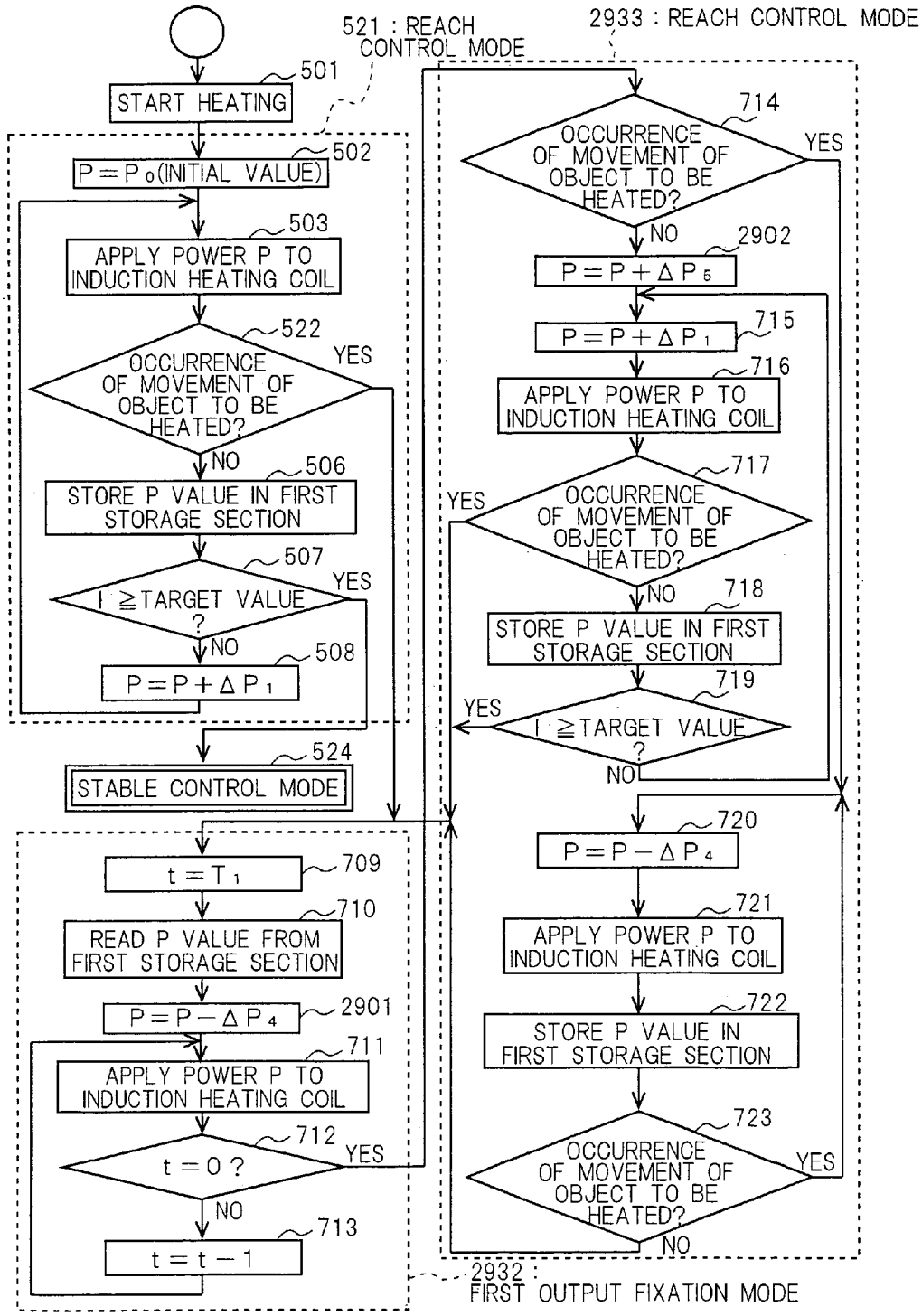
FIG. 29 is a flowchart showing a control method of an induction heater in accordance with Embodiment 13 of the present invention.
Figure 30:
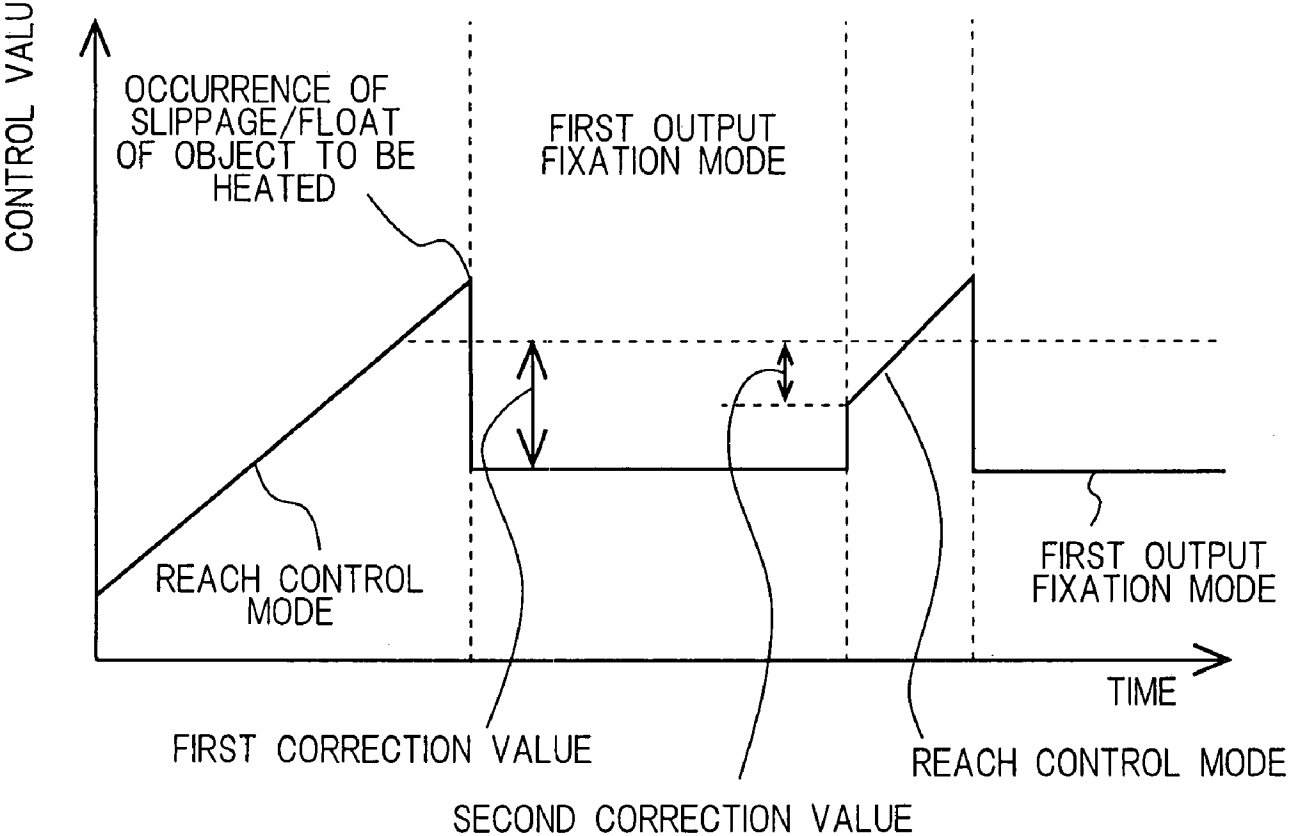
FIG. 30 is a timing chart illustrating the operation of the induction heater in accordance with Embodiment 13 of the present invention.

With reference to FIG. 29 and FIG. 30, an induction heater (induction heating cooker) in accordance with Embodiment 13 of the present invention will be described. The induction heater in accordance with Embodiment 13 has the same configuration as that of the induction heater in accordance with Embodiment 2 (FIG. 1 to FIG. 4). A control method in accordance with Embodiment 13 (FIG. 29) is basically the same as that in accordance with Embodiment 2 (FIG. 7).

In Embodiment 13, when the shift from the reach control mode to the first output fixation mode is made, and when the shift from the first output fixation mode to the reach control mode is made, a correction is made to the control value stored in the first storage section 107. When the shift from the reach control mode to the first output fixation mode is made, a correction is made with a first correction value ΔP4, whereas when the shift from the first output fixation mode to the reach control mode is made, a correction is made with a second correction value ΔP5 (ΔP4>ΔP5). Otherwise, the induction heater in accordance with Embodiment 13 is the same as that in accordance with Embodiment 2.

FIG. 30 is a timing chart showing a state of the change in the control value of the control section 104 of the induction heater in accordance with Embodiment 13 of the present invention. In FIG. 30, the horizontal axis indicates time, while the vertical axis indicates the control value.

FIG. 29 is a flowchart showing the control method of the induction heater in accordance with Embodiment 13. As compared with FIG. 7, FIG. 29 obtains an addition of step 2901 at which the control value is corrected by subtracting the first correction value ΔP4 from the control value P read out from the first storage section 107 after step 709 (just after the shift from the reach control mode to the first output fixation mode is made). Furthermore, step 2902 at which the control value is corrected by adding the second correction value ΔP5 to the control value P read out from the first storage section 107 is added after step 714 (just after the shift from the first output fixation mode to the reach control mode made). Otherwise, FIG. 29 (Embodiment 13) is the same as FIG. 7 (Embodiment 2).

By correcting the control value with the first correction value, in the case where the shift from the first output fixation mode to the reach control mode is made, the control value in the output fixation mode becomes a value at which there never occurs a slippage of the pan. By correcting the control value with the second correction value, in the case where the shift from the reach control mode to the first output fixation mode is made, the control value at which the pan moves can be detected soon.

In the present embodiment, when shifting from the reach control mode to the first output mode, the control section outputs the correction value obtained by correcting the control value stored in the storage section with the first correction value. When shifting from the stable control mode to the first output mode, the control section may similarly output the correction value obtained by correcting the control value stored in the storage section with the first correction value.

In another embodiment, when the first movement detection section 106 detects a movement of the object in the reach control mode or in the stable control mode, the control section 104 shifts to the stable control mode where the value derived based on the output value of the output detection section 103 (or the control value) stored by the first storage section 107 (which stores the output value when the object does not moves) at the previous time is set as a target output (the stable control mode where the target output is lowered). When shifting from the reach control mode or the stable control mode to the stable control mode where the target output is lowered, the control section 104 sets the output value obtained by subtracting the first correction value from the output value of the output detection section 103 stored in the storage section (typically, the maximum output in the range of the output with which the object does not move) as a new target output. The control section outputs the correction value such that the same output as the new target output can be obtained. When shifting from the first output mode to the reach control mode, the control section 104 outputs the control value obtained by adding the second correction value to the control value stored in the storage section, or the correction value such that the output value obtained by adding the second correction value to the output value of the output detection section 103 stored in the storage section can be gained. The first correction value is set greater than the second correction value. In another embodiment, the effect which is similar to that in Embodiment 13 can be obtained.

<<Embodiment 14>>

Figure 31:
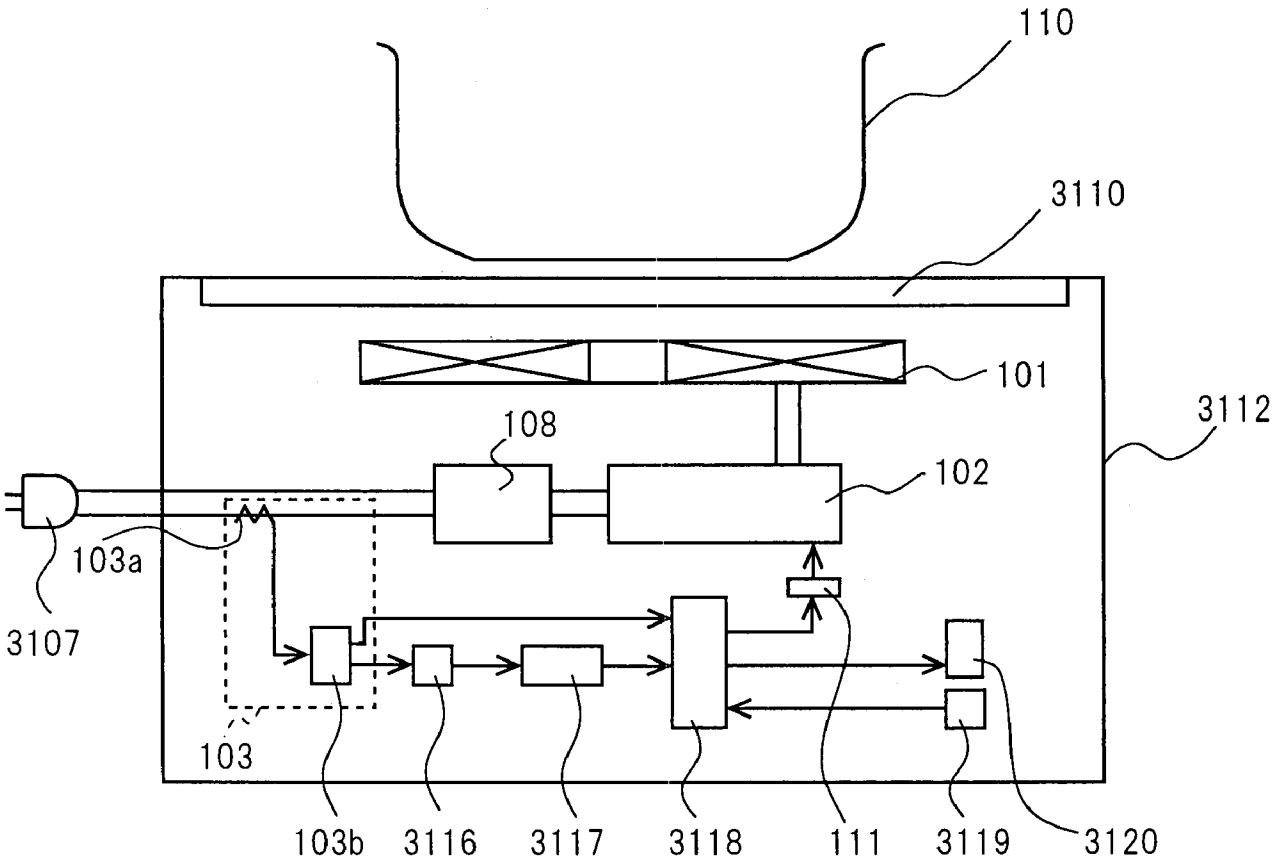
FIG. 31 is a block diagram showing a configuration of an induction heater in accordance with Embodiment 14 of the present invention.
Figure 32:
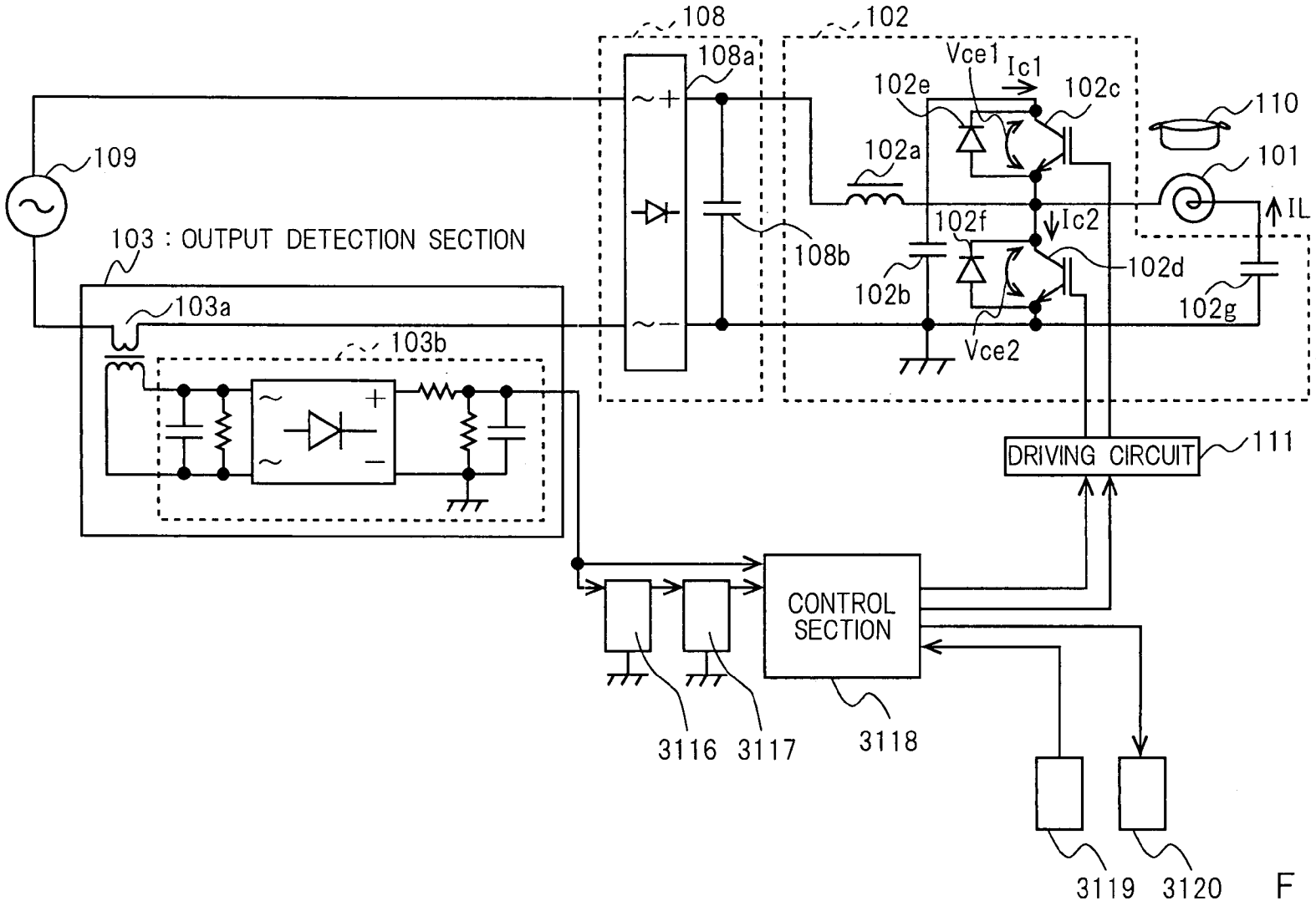
FIG. 32 is a specific circuit diagram of the induction heater in accordance with Embodiment 14 of the present invention.

With reference to FIG. 31 to FIG. 39, an induction heater (induction heating cooker) in accordance with Embodiment 14 of the present invention will be described. FIG. 31 is a schematic sectional block diagram of the induction heater of the present embodiment. FIG. 32 shows a circuit block diagram of the induction heating cooker. In FIG. 31 and FIG. 32, a ceramic top plate 3110 is placed on the top of a housing 3112, and the cooking pan 110, which is an object to be heated, is further placed on the top plate 3110. A power plug 3107 is connected to the commercial power source 109. Inside the housing 3112, the commercial power source 109 is input to the rectifying-smoothing circuit 108. The output terminals of the rectifying-smoothing circuit 108 are connected to the input terminals of the inverter circuit 102. The output terminals of the inverter circuit 102 are connected to the induction heating coil 101. The output detection section 103 detects the power source current which the inverter circuit 102 inputs from the commercial power source 109 to output the detection signal proportional to the magnitude of the power source current to a control section 3118 and a power source current change detection section 3116.

The configurations and the operation of the rectifying-smoothing section 108, the inverter circuit 102, the induction heating coil 101 and the output detection section 103 are the same as in Embodiment 1 (FIG. 2 and FIG. 3).

The power source current change detection section 3116 outputs a change detection signal for the power source current change to a change determination section 3117. The change determination section 3117 compares the change detection signal with a predetermined threshold value to output the determination signal representing the result of the comparison to the control section 3118. The power source current change detection section 3116 and the change determination section 3117 constitute a movement detection section. The control section 3118 drives the first switching element 102*c* and the second switching element 102*d* of the inverter circuit 102 through the driving circuit 111.

A setting input section 3119 having input key switches which the user operates in order to set the heating output or to start or stop heating are connected to the control section 3118, and the output signal from the setting input section 3119 is output to the control section 3118. Furthermore, a setting display section 3120 is connected to the control section 3118 to display the settings of the heating output and so on made by the setting input section 3119 toward the user.

The high frequency inverter of the present embodiment has a characteristic that in the case where it operates in certain driving conditions (such as a frequency and a driving time ratio), if the magnetic coupling between the cooking pan 110 and the induction heating coil 101 is reduced, the input power (current IL) of the induction heating coil 101 is lowered.

The control section 3118 inputs the detection signal from the output detection section 103 (the signal proportional to the magnitude of the power source current, which is abbreviated as a power source current) and controls the inverter circuit 102 so that the detection signal agrees with a predetermined target value (so that the input power (output value) of the inverter circuit 102 agrees with the predetermined target value) (the stable control mode). With the control value output by the control section 3118, the driving frequency and/or the driving time ratio between the first switching element 102*c* and the second switching element 102*d* of the inverter circuit 102 is varied, and both the switching elements are controlled.

Figure 34:
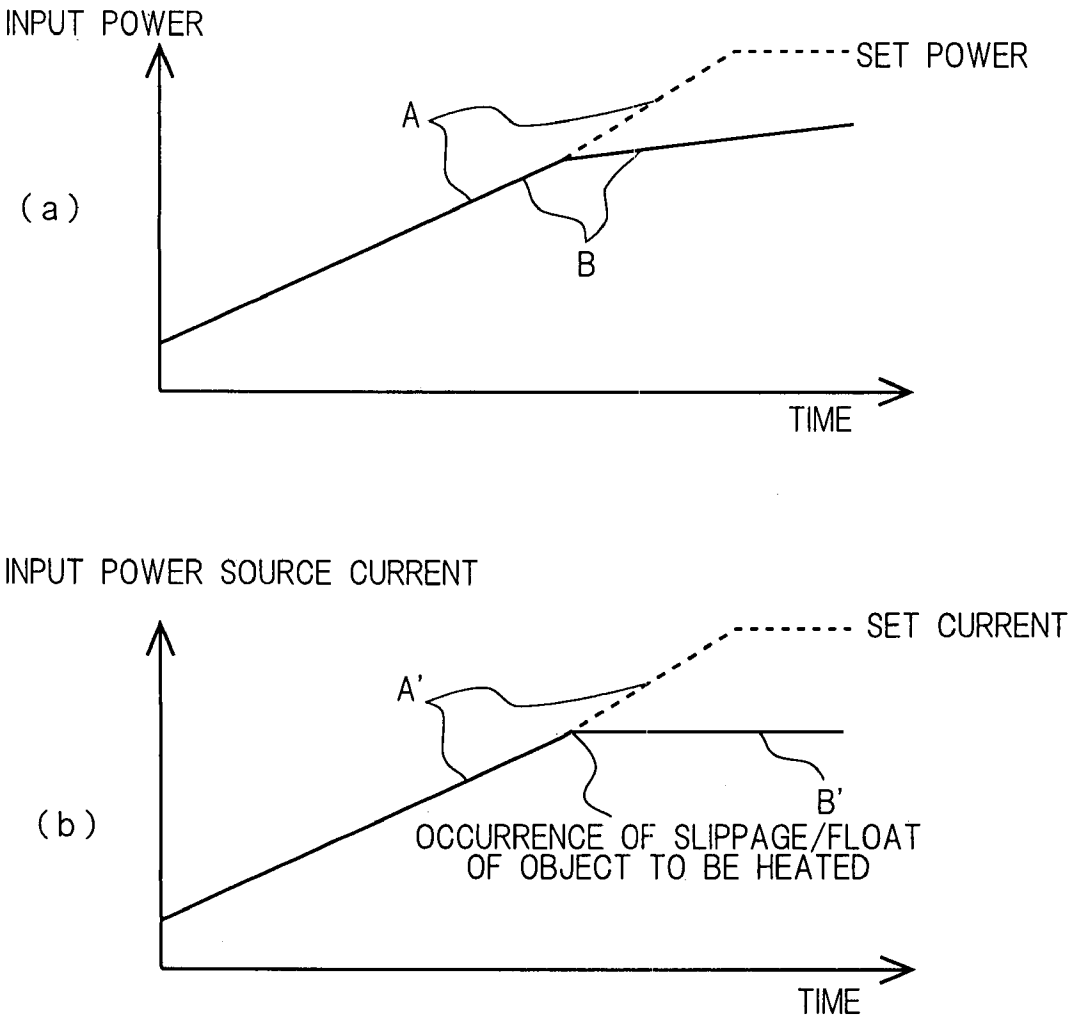
FIG. 34 is a timing chart illustrating the operation of the induction heater in accordance with Embodiment 14 of the present invention.

As shown by a solid line and dashed line A in part (a) of FIG. 34, at startup, the control section 3118 gradually changes the driving frequency and/or the driving time ratio to increases the output of the inverter circuit 102 from the low output to the set level of power (target value) (reach control mode). On this occasion, as shown by the line A' in part (b) of FIG. 34, the power source current similarly increases from the low current to the set current corresponding to the set level of power (the target value).

If the cooking pan 110 is made of a high-conductive and non-magnetic material such as aluminum, in the reach control mode, the current flowing into the induction heating coil 101 gradually increases, so that the current induced in the cooking pan 110 also increases gradually. The magnetic field produced by the current flowing through the induction heating coil 101 and the magnetic field produced by the current flowing through the cooking pan 110 interact, thereby generating a repellent force. The cooking pan 110 can be floated or slipped by the repellent force.

At startup, if the float or the slippage of the pan 110 is caused until the input power of the inverter circuit 102 reaches from the low power to the set level of power (reach control mode), the increasing rate of the input power of the inverter circuit 102 decreases as shown by the solid line B in part (a) of FIG. 34. As shown by the solid line B' in part (b) of FIG. 34, the increasing rate of the power source current of the inverter circuit 102 also decreases.

The power source current change detection section 3116 measures the rate of change of the power source current value according to the detection signal output by the output detection section 103, and outputs the signal of the change rate of the power source current value to the change determination section 3117. If the change rate of the power source current value lies within a first predetermined range and is maintained for at least a predetermined period of time, the change determination section 3117 determines that the cooking pan 110 has moved by the repellent force to output the signal indicating the result of the determination to the control section 3118. When inputting this signal, the control section 3118 stops the operation of the inverter circuit 102 or lowers the output of the inverter circuit 102 so that a movement of the cooking pan 110 does not occur.

Figure 35:
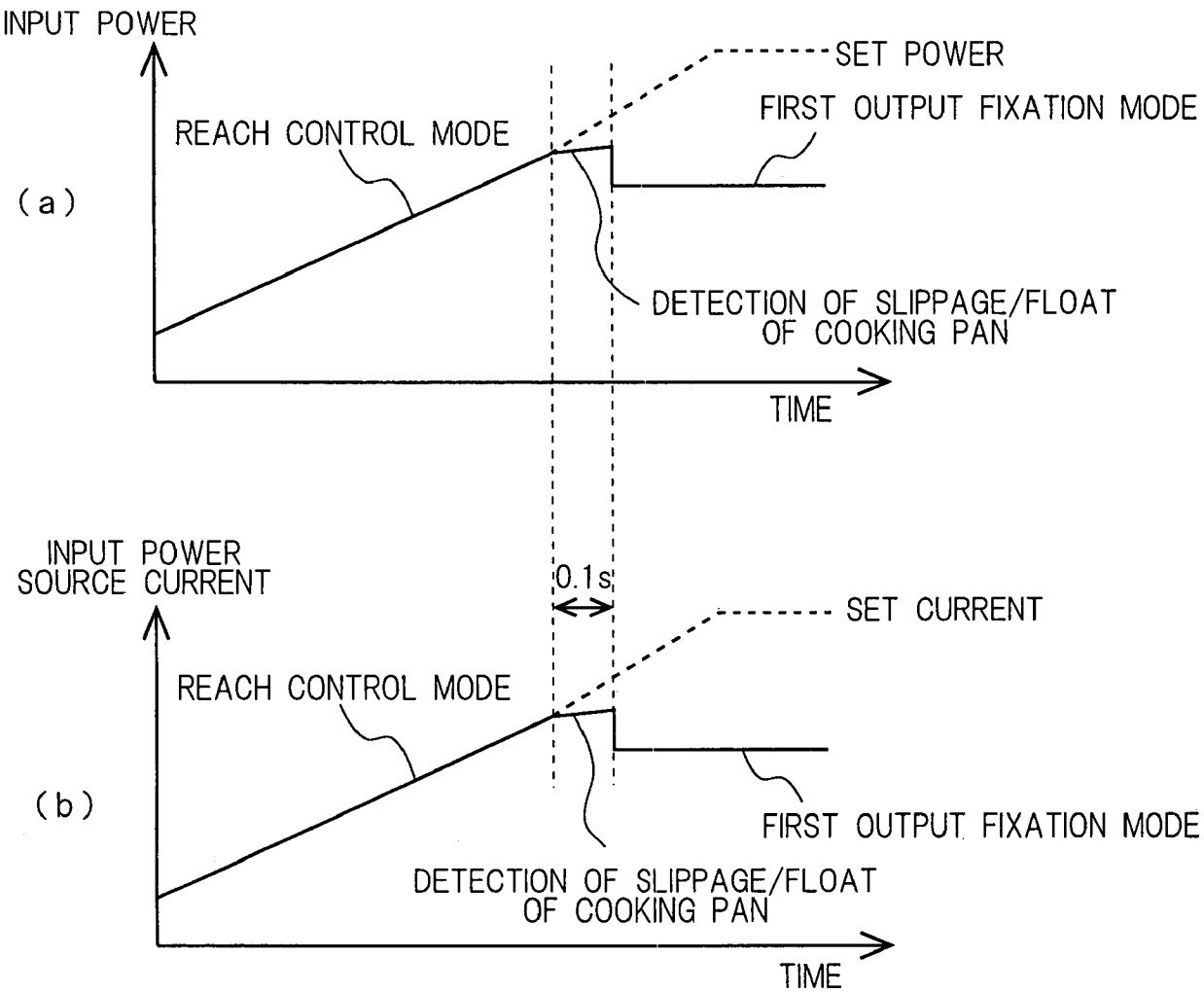
FIG. 35 is a timing chart illustrating the operation of the induction heater in accordance with Embodiment 14 of the present invention.

An example of this control is shown in FIG. 35. As with FIG. 34, FIG. 35 shows changes of the input power and the input current with time in the reach control mode at the start of heating. As shown in FIG. 35, when the cooking pan 110 begins to move (float or slip) by the repellent force of the magnetic field and the gradient of the input current changes, 0.1 second after the change in the gradient of the input current is caused, the change determination section 3117 detects the movement of the cooking pan 110 to output the detection signal. When inputting the detection signal, the control section 3118 maintains the power source current at the value lower than the value when the detection was done.

When the response speed of the power control of the inverter circuit 102 effected by the control section 3118 is fast, if the change of the coupling is caused, the control section 3118 changes the driving conditions immediately following the change of the coupling to increase the input power of the inverter circuit 102. As a result, the output detection section 103 may not detect the change in the power source current resulting from the movement of the pan as mentioned above. Therefore, in the present embodiment, the maximum rate of increase of the input power per unit of time when the control section 3118 exercises power control is set to the value which is in the vicinity of, or which is equal to or less than the limit value at which the output detection section 103 is allowed to detect the change in the power source current.

In the present embodiment, all or some of the change determination section 3117, the control section 3118, and the output detection section 103 can be configured by utilizing the microcomputer (the functions thereof are performed by software). An experiment is carried out with this configuration, where the time required from the time a movement (a slippage or a float) of the object 110 starts to occur until the change determination section 3117 determines that (hereinafter referred to as a "float detection time") can be held to the order of 0.1 second as mentioned above.

By holding the float detection time to the order of 0.1 second, it is possible to make the visual recognition of the slippage and the float of the cooking pan 110 difficult. However, depending on the size and the shape of the cooking pan 110, it sometimes becomes somewhat easy to visually recognize the float and the slippage when the detection is done. For example, in the case of a lightweight frying pan, the center of gravity is situated nearer the handle in relation to the center, so that the part of the bottom of the pan which is opposite the handle can be floated by a slight buoyant force and thereby the pan can tilt.

After startup of the inverter circuit 102, when the change determination section 3117 detects the movement of the cooking pan 110, the output of the inverter 102 is maintained at the output value lower than the output (for example, 2 kW) set by the user (for example, the output is reduced to the output which is about 800 W lower than the set output). Maintaining this low output makes it impossible to carry out the cooking requiring the high heating output. If the user moves the cooking pan 110 during the period of time until the output becomes stable at startup and, according to this action, the change determination section 3117 erroneously detects that the cooking pan 110 has moved, the power consumption is maintained low. In this case, heating cannot be sufficiently performed as mentioned above, and the user cannot carry out cooking as intended.

Figure 36:
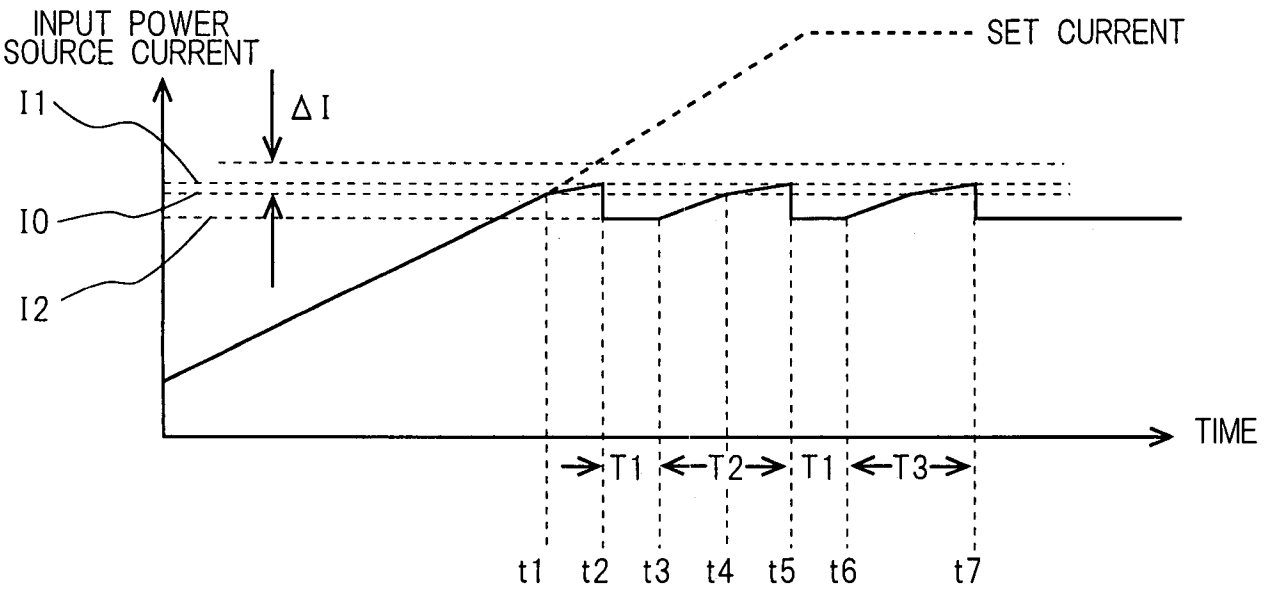
FIG. 36 is a timing chart illustrating the operation of the induction heater in accordance with Embodiment 14 of the present invention.

The control section 3118 of the present embodiment controls the output as shown in FIG. 36. In the process of the set current value (10A) being reached, as shown in FIG. 36, the cooking pan 110 starts to float at time t1. The change determination section 3117 detects a movement of the cooking pan 110 at time t2 for the first time. The control section 3118 measures the output value (in this case, the power source current value) I11 (in this case, 8A) at the moment (time t2) based on the result of the detection made by the output detection section 103. The control section 3118 reduces the heating output to the output value I21 (6A) which is 2A lower than the output value I1 (8A) of the movement detection. The control method after the output is reduced may be the output fixation mode where the control section outputs a constant control value or the stable control mode where the control section exercises control so that the output of the inverter circuit agrees with a lowered target value.

After maintaining the heating output at the value I 21 for a predetermined period of time T1 (for example one second), the control section 3118 cancels the output limiting operation at time t3 to gradually increases the heating output (input current) again. The change determination section 3117 detects a movement of the cooking pan 110 again during the time period between time t4 and time t5. The control section 3118 measures the output value I12 at time t5 when the change determination section 3117 detects the movement thereof for the second time and at the same time, reduces the output to 122. The above-mentioned operation is repeated.

When the cooking pan 110 is left untouched, the coupling between the induction heating coil 101 and the cooking pan 110 remains unchanged. Therefore, the power source current value I11 when the change determination section 3117 detects the movement of the cooking pan 110 for the first time is almost the same as the power source current value I12 when it detects the movement thereof for the second time. The control section 3118 makes the change determination section 3117 detect a movement repeatedly and performs the sampling operation to sample the power source current value each time the movement is detected a predetermined number of times (in this case, three times). If the measured values of the power source current at the movement detection time are almost the same (for example, the measured values lie within a predetermined range (in FIG. 36, ΔI), it is determined that the cooking pan 110 is left untouched in a floating state. The control section 3118 stops the movement detection operation from that time onward (prohibits the cancellation of the output limiting state after it is determined that the object 110 has moved), and continues heating at the current value lower than the power source current value I11 or I12 at which a movement thereof is detected (in this case, at the value I21, I22, or I23 (the limited value after a movement is detected for the third time) (for example, the average value), because these are almost the same).

If the movement detection operation is not canceled as mentioned above, whenever a predetermined period of time (the sum of the time during which the output limiting state after the movement is detected is maintained (in this case, one second), and the movement detection time from when the cooking pan 110 floats after the output limiting state is canceled until the movement thereof is detected (in this case, 0.1 second)) elapses, the cooking pan 110 is subtly floated. For example, when the cooking pan is a frying pan 110, its center of gravity lies nearer the edge of the cooking pan, thereby causing imbalance thereof, so that only part of the cooking pan 110 sometimes floats to perform a rotational movement. The change of the magnetic coupling between the induction heating coil 101 and the cooking pan 110 caused by the rotational movement of the cooking pan 110 is small, so that, in some cases, the movement detection operation mentioned above cannot be performed. For example, when performing a large rotational movement, the cooking pan 110 is slipped from above the induction heating coil 101 to a great extent. When the above-mentioned operation is repeated, in some cases, the cooking pan 110 is expected to rotate whenever it is floated, so that it is desirable that the number of times the movement detection operation is performed be as small as possible. Furthermore, it is also desirable that the time from when the cooking pan 110 is floated until the float thereof is detected be short.

Figure 39:
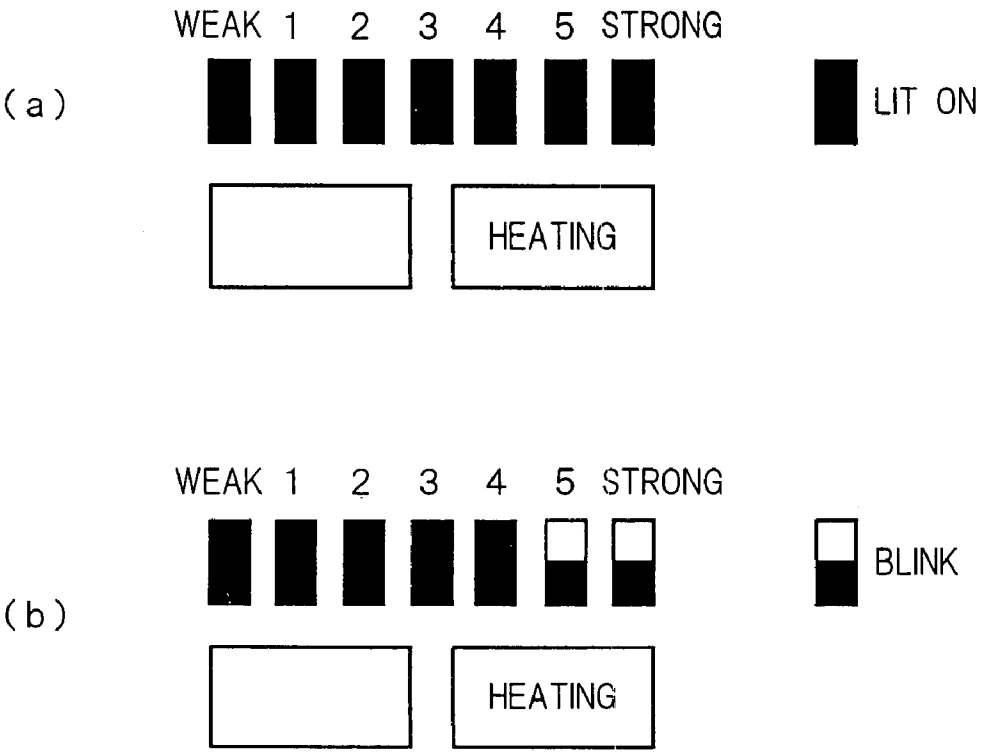
FIG. 39 is a plan view of the principal part of an output display section of the induction heater in accordance with Embodiment 14 of the present invention.

In addition, the operation of the output setting display section 3120 at this moment will be described with reference to FIG. 36 and FIG. 39. When the heating output is set to "strong" (2 kW) by the setting input section 3119, the control section 3118 outputs a signal to the output setting display section 3120, which thereby lights up all the display elements (LEDs) from "weak" to "strong" as shown in part (a) of FIG. 39. As a result, it is indicated that the output setting of "strong" is made.

For example, heating is started in a state where the cooking pan 110 left untouched, as shown in FIG. 36, the output gradually increases and the change determination section 3117 detects that the cooking pan 110 has floated by buoyant force at time t2 (when the heating output is 1800 W). The control section 3118 reduces the heating output by 400 W to 1200 W. On this occasion, the display of the output setting display section 3120 maintains the state shown in part (a) of FIG. 39. Even when the output value is limited, the display of the output setting display section 3120 does not change from the state when the setting was made.

The control section 3118 repeats the movement detection operation for the cooking pan 110 three times. The control section 3118 monitors the state of the repeated operation to determine that the cooking pan 110 has moved by buoyant force, not by the user's operation at time t7 in FIG. 36 (it is assumed that the measured values at the movement detection time are almost the same). Afterwards, the output setting display section 3120 blinks the display elements corresponding to "5," and "strong" (see part (b) of FIG. 39). According to this display, the user can recognize that the heating output can be limited to a level of "4", in other words, 1200 W. This display indicates to the user the fact that the movement detection function has been activated (by the operation to blink part of the elements), the set output value (by the sum of the number of the lighted elements and the number of the blinked elements), and the actual output value forcibly limited by the movement detection function (by the lighted elements). The display method is not limited to that mentioned above, but another method such as informing to that effect by voice will suffice. As a result, a similar effect can be obtained.

In the embodiment, the induction heater indicates by the blink of the display elements or by voice that the cooking pan 110 has moved by buoyant force. Instead of this, after detecting that the cooking pan 110 has been moved not by user's operation but by buoyant force, the induction heater may simply indicate the actual output after the limitation. The indication of the set output value which is different from the actual output or the like is not directly necessary information for cooking activities. This is because such an indication, if anything, can confuse some users.

Figure 37:
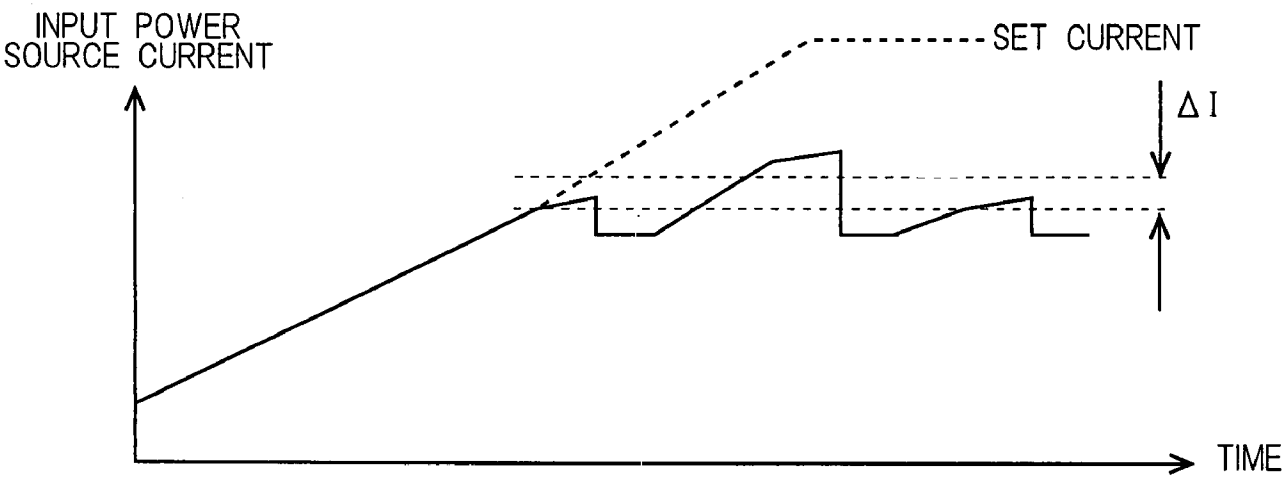
FIG. 37 is a timing chart illustrating the operation of the induction heater in accordance with Embodiment 14 of the present invention.

The control operation of the induction heater when the user moves the cooking pan 110 will be described with reference to FIG. 37. Movements of the cooking pan when the user moves cooking pan 110 are random, so that the values of the power source current when the movement of the cooking pan 110 is detected are random from measurement to measurement. As shown in FIG. 37, some of the current values when the movement of the cooking pan 110 is detected are high and others are low. As mentioned above, by performing the movement detection a plurality of times and comparing the output values at the time of movement detection, it can be determined that the values of the power source current when a movement is detected are random or nearly uniform. As in FIG. 37, in the case where the values of the power source current when a movement is detected are random, the movement detection operation (involving the operation to cancel the output limiting operation and increase the output to a set value again) and the subsequent output limiting operation are repeated. As shown in FIG. 37, when a movement of the cooking pan 110 based on the user's operation is caused, the situation where the output value is unnecessarily limited can be prevented.

It is assumed that the change determination section 3117 determines that the cooking pan 110 has moved by buoyant force and has been left as it is, and the control section 3118 stops the movement detection operation to maintain the output value lower than the set power. The operation in the case where the user moves the cooking pan 110 on this occasion will be described with reference to FIG. 38. The specific condition where such a case occurs will be exemplified. First, the user leaves a light-weight frying pan made of aluminum as it is for the purpose of preheating. The change determination section 3117 detects a movement of the frying pan, and the control section 3118 limits power. Afterward, the user holds the frying pan to start cooking. In the inverter circuit 102 and the induction heating coil 101 in FIG. 32, the heating output is dependent on the degree of magnetic coupling between the cooking pan 110 and the induction heating coil 101. If the user holds the cooking pan 110, thereby causing a float thereof, the power source current gets lower temporarily (point A in FIG. 38).

The change determination section 3117 detects this change of the power source current with time (in this case, the change determination section 3117 detects that the output lowers with the passage of time.), and the control section 3118 cancels the output limiting operation to increase the output gradually to the set level of power.

Figure 38:
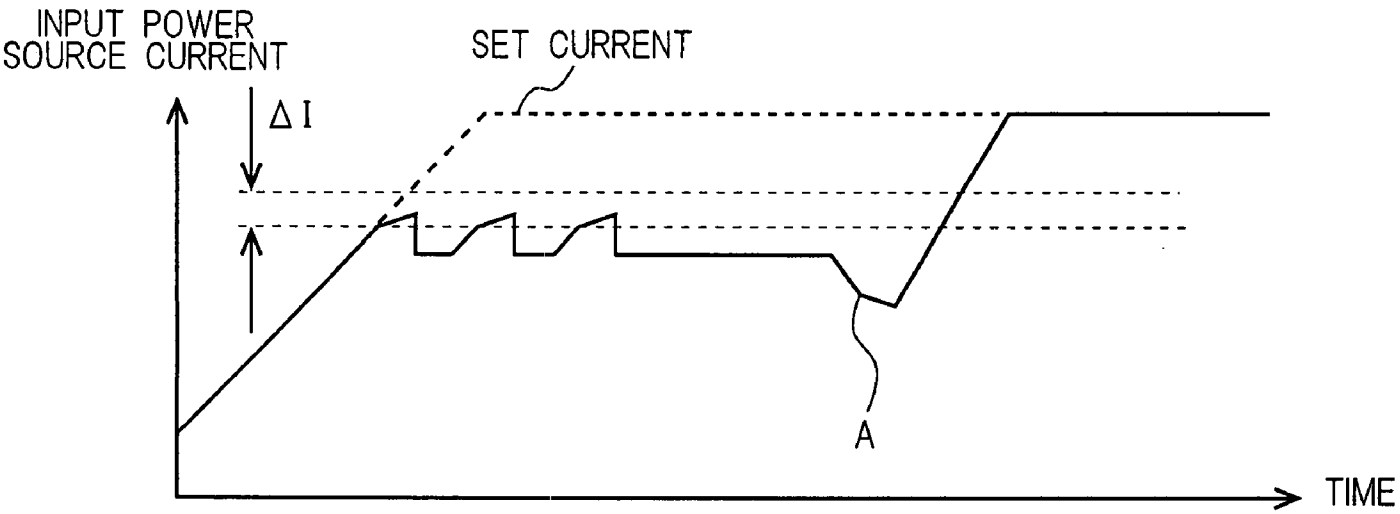
FIG. 38 is a timing chart illustrating the operation of the induction heater in accordance with Embodiment 14 of the present invention.

For example, even in the case the cooking pan 110 floats by buoyant force at the preheating time and thereby the induction heater is placed in the output limiting state, when detecting that the user is actually carrying out cooking holding the cooking pan 110, the control section 3118 cancels the output limiting operation automatically to increase the heating output from the limited output to the set output (the change after point A in FIG. 38). As a result, a user-friendly induction heater can be obtained. The output setting display section 3120 provides a display as shown in part (b) of FIG. 39 when the induction heater is in the output limiting state. When the control section 3118 detects a human-caused movement of the cooking pan 110, the output setting display section 3120 is restored to the display of the original set output shown in part (a) of FIG. 39.

Figure 33:
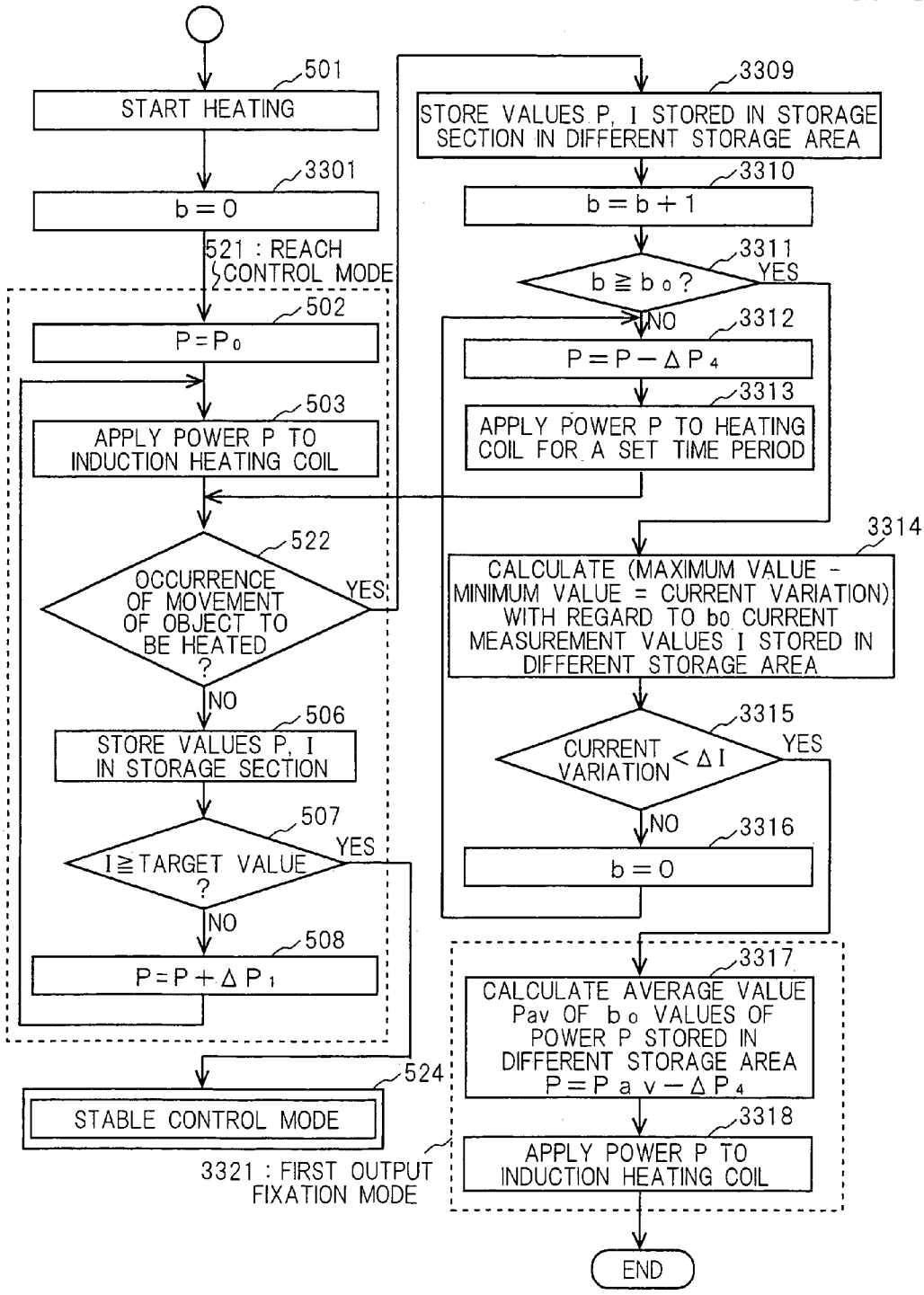
FIG. 33 is a flowchart showing a control method of the induction heater in accordance with Embodiment 14 of the present invention.

FIG. 33 is a flowchart showing a control method of the induction heater in accordance with Embodiment 14. With reference to FIG. 33, the control method of the induction heater in accordance with Embodiment 14 will be described. In FIG. 33, step 501, the reach control mode 521 (steps 502 to 508), and the stable control mode 524 are the same as those in accordance with Embodiment 1 (FIG. 5). However, in Embodiment 14, the control value P and the power source current I at the time are stored in the storage section (step 506). In FIG. 33, the same numerals are applied to the same steps as in FIG. 5.

The control section 3118 inputs the heating start command input through the setting input section 3119 by the user to start heating (step 501). At step 3301, b is set to 0 (initial value). The value b represents the number of times that the movement detection operation is performed. First, the control section 3118 goes into the reach control mode 521. If the power source current detected by the output detection section 103 reaches the target value I set at the setting input section 3119, the control section 3118 shifts from the reach control mode 521 to the stable control mode 524. When the movement detection section detects the object 110 in the course of the reach control mode 521, the control section 3118 shifts from the reach control mode 521 to the processing from step 3309 onward.

After the movement detection section detects the movement of the object 110, at step 3309, the control section 3118 stores the control value P and the power source current I at the time stored in the storage section (as the control value P and the power source current I when a movement is detected for the first time) in a different storage area. The value b is incremented (step 3310). It is checked whether or not b is equal to or greater than a predetermined value b0 (in the present embodiment, 3) (step 3311). If b is equal to or greater than b0, the sequence proceeds to step 3314. If b is less than b0, the predetermined value ΔP4 is subtracted from the control value P (step 3312). Power is applied to the heating coil at the reduced control value P for a set time period (step 3313). The sequence returns to step 522, and the movement detection operation is repeated.

At step 3314, with regard to b0 current measurement values I stored in the different area of the storage section, the equation of current variation at the time of movement detection equals the maximum value among the current measurement values minus the minimum value thereamong is worked out. It is checked whether or not the current variation is smaller than a predetermined threshold value ΔI (step 3315). If the current variation is smaller than the predetermined threshold value ΔI, the control section 3118 determines that the movement of the object has been caused by the action of the magnetic field, thereby shifting to the first output fixation mode 3321. If the current variation is equal to or greater than the predetermined threshold value ΔI (step 3315), the control section 3318 determines that the movement of the object has not been caused by the action of the magnetic field, thereby resetting b to 0 (step 3316). The sequence returns to step 3312, the movement detection operation is resumed. The processing loop from step 3312 to step 3316 is executed repeatedly at regular time intervals until the exit from the processing loop is made.

The first output fixation mode 3321 has steps 3317 and 3318. At step 3321, the average value Pav of b0 control values P stored in the different storage area of the storage section is calculated. The equation of control value P=Pav−P4 (P4 is a correction value) is worked out, the control value P thereby obtained is output (step 3317). The inverter circuit 102 heats the induction heating coil 101 with power P (step 3318).

In another embodiment, when the movement detection section detects a movement of the object in the reach control mode, the control section 3118 shifts to the stable control mode where the value derived based on the output value of the output detection section 103 (the maximum value in the range of the output value at which the object does not move) stored by the storage section at the previous time (the derived value may be, for example, the maximum value itself, or may be the value obtained by subtracting a predetermined correction value from the maximum value) is set as a target output. By performing the processing mentioned above, the effect which is similar to that in Embodiment 14 can be obtained.

In the reach control mode, when the movement detection section detects the movement of the object, the control section 3118 may stop the operation of the inverter.

The induction heater in accordance with the present embodiment comprises the induction heating coil 101 and the inverter circuit 102 which produces a high-frequency magnetic field to heat the cooking pan 110, the control section 3118 which gradually increases the output of the induction heating coil 101 from a low output to a predetermined output, the power source current change detection section 3116, which is a movement detection section for detecting a movement of the cooking pan 110 based on the state of the operation of the high-frequency inverter for the time period during which the output of the induction heating coil 101 increases from the low output to the predetermined output, and the change determination section 3117. The control section 3118 performs the output limiting operation to limit the output of the induction heating coil 101 to the output I21 or output I22 which is lower than the output I11 or output I12 when the movement detection section detects the movement. Afterwards, the control section 3118 cancels the output limiting operation to repeat the movement detection operation (operation to increase the output gradually again to detect a movement and subsequently limit the output) three times. When detecting that the movement detection operation is repeated with approximately the same output changes (detecting that by comparing a plurality of output values or performing the calculation thereamong), the control section 3118 determines that the movement of the object has been caused by the high-frequency magnetic field produced by the induction heating coil 101. Afterwards, the control section 3118 limits the output of the induction heating coil to the output lower than the output when the movement detection section detected the movement. By caring out heating with the limited output, the cooking pan 110 is prevented from continuing to move.

The control section 3118 detects that the cooking pan 110 has floated by the magnetic field of the induction heating coil based on the circumstances in which the repetition of the movement detection operation is made with approximately the same output changes (detects by comparing a plurality of output values or performing the calculation thereamong). As a result, the movement of the object resulting from the magnetic field can be discriminated from the human-caused movement thereof which makes the output changes irregular. When determining that the cooking pan 110 left untouched is moving, the control section 3118 stops the movement detection, so that the object is avoided from moving little by little.

In the present embodiment, the movement detection section detects a movement of the cooking pan 110 a plurality of times (three times), and in each movement detection operation, the power source current which is an output value of the inverter circuit 102 and the induction heating coil 101 is sampled. Based on a plurality of sampled output values (in this case, three output values) at the movement detection time, it is determined whether the movement of the object has been caused by the action of the magnetic field or by the user's operation (in this case, whether these three output values are within a predetermined range or not). By comparing a plurality of output values or performing the calculation thereamong, it can be accurately and easily detected that the repetition of the movement detection operation is made with approximately the same output changes.

The control section 3118 determines the time at which the output is limited after the movement of the cooking pan 110 is detected based on the result of the detection done by the movement detection section. The output value which is the necessary information for the movement detection operation can be obtained by monitoring the input current of the inverter circuit 102 (power source current) or the current of the induction heating coil 101. Since the power source current or the current of the induction heating coil 101 is used for the usual output control exercised by the control section 3118 and so on, the sensor dedicated to the movement detection operation is not necessary. With a simple circuit configuration, an inexpensive induction heater can be realized.

In the present embodiment, when comparing a plurality of (in this case, three) output values obtained through sampling or performing the calculation thereamong to determine that these output values are approximately the same as each other, the control section 3118 determines that the cooking pan 110 is being moved by the high-frequency magnetic field produced by the induction heating coil 101. With the use of the microcomputer, the above-mentioned determination whether or not the output of the induction heating coil 101 should be limited can be easily reached.

In the present embodiment, when detecting that a movement of the cooking pan 110 has been caused by the user's operation after having performed the output limiting operation based on the result of the detection done by the movement detection section, the control section 3118 cancels the movement detection operation and increases the output of the induction heating coil 101 to the predetermined output. As a result, the movement of the cooking pan 110 left untouched can be suppressed as much as possible, and when the human-induced movement of the object associated with the cooking activities is caused, the output limiting operation is automatically canceled. By maintaining the power limitation for preventing the movement of the cooking pan 110, the degradation in cooking performance can be avoided.

For example, in the case where the user moves the cooking pan 110 at the start of cooking such as fry cooking, it is possible to secure the sufficient heating output of the induction heating coil 101. In addition, in this case, the usual movement (the spontaneous movement) of the cooking pan 110 is not much of a problem because the user holds the cooking pan 110.

In the present embodiment, the output setting display section 3120 provides a display corresponding to a predetermined output set by the user. Even after the control section 3118 starts the output limiting operation based on the result of the detection done by the movement detection section, the output setting display section 3120 maintains the display corresponding to the set output. After the control section 3118 determines that the movement of the cooking pan 110 has been caused by the high-frequency magnetic field produced by the induction heating coil 101, the output setting display section 3120 displays the output value lower than the display corresponding to the predetermined output. As a result, the user finds that the output of the inverter circuit 102 (which corresponds to the output of the induction heating coil 101, or power consumption or power source current) set by the user has been reduced. A user-friendly induction heater can be obtained where the output display of the output setting display section 3120 is appropriately provided, which is thereby easy to understand for a user and does not give the user a sense of unease unnecessarily.

In the present embodiment, the induction heater has a configuration where the movement of the object 110 is detected according to the change in the output of the inverter circuit 102 or the induction heating coil 101 with time. By using the microcomputer, the movement of the cooking pan 110 can be detected with a simple configuration.

When the output after the movement is detected is limited to a predetermined value, the predetermined value may be set to 0, in other words, the heating may be stopped. The higher the output limiting value is set, the more promptly the detection of whether or not the movement results from the user's operation can be performed.

In the present embodiment, the control section outputs a constant control value P in the first output fixation mode 3321. In another embodiment, instead of the first output fixation mode 3321, the control mentioned below is exercised. The control section 3118 calculates the average value Iav of b0 power source currents I stored in the different storage area of the storage section to work out the equation of the target output value (target power source current) I=Iav−I4 (I4 is a correction value). The control section 3118 exercises control so that the output of the inverter circuit 102 (power source current) agrees with the target output value I (the stable control mode where the control is exercised with the target output set low).

In the present embodiment, the induction heater has a two-transistor SEPP-inverter configuration. So long as the inverter is a circuit where the input current varies according to the change of the magnetic coupling to the load (object to be heated), the inverter may have any type of configuration or control method. For example, the inverter may be one-transistor voltage resonant inverter. In the present embodiment, by varying the frequency, power is changed. However, the factor which makes the power change is not limited thereto, but is arbitrary. For example, with the frequency kept constant, the conduction ratio between two switching elements may be changed.

In the present embodiment, the power source current value at the time of movement detection is measured a plurality of times, and according to whether or not these values are approximately the same, it is determined whether or not the movements of the cooking pan 110 have been caused by the action of the magnetic field. Instead of this, in the case where the time required for the repetition of the movement detection operation (period) is measured a plurality of times, a plurality of values thereby obtained are compared or the calculation thereamong is performed, and when these values are approximately the same with each other, it may be determined that the movements of the object have been caused by the repelling magnetic field. As a result, a similar effect can be obtained. By measuring the input and output waveshapes (voltage or current) instead of the power source current, the time required for the repetition (period) may be measured.

The control value output by the control section 3118 at the time of movement detection is stored (for example, the change of the resonant frequency is detected by a resonant frequency detection section and the resonant frequency is stored), and if the control values at the time of measurement performed a plurality of times are approximately the same, it may be determined that the movement of the cooking pan 110 has moved by the action of the magnetic field.

The induction heater may be provided with the weight sensor for detecting the weight of the object. For example, the weight of the object detected by the weight sensor at the time of movement detection is stored, and if the values of the weight at the time of measurement performed a plurality of times are approximately the same, it is determined that the cooking pan 110 has moved by the action of the magnetic field.

The sound and vibration caused when the object moves may be detected.

<<Embodiment 15>>

Figure 40:
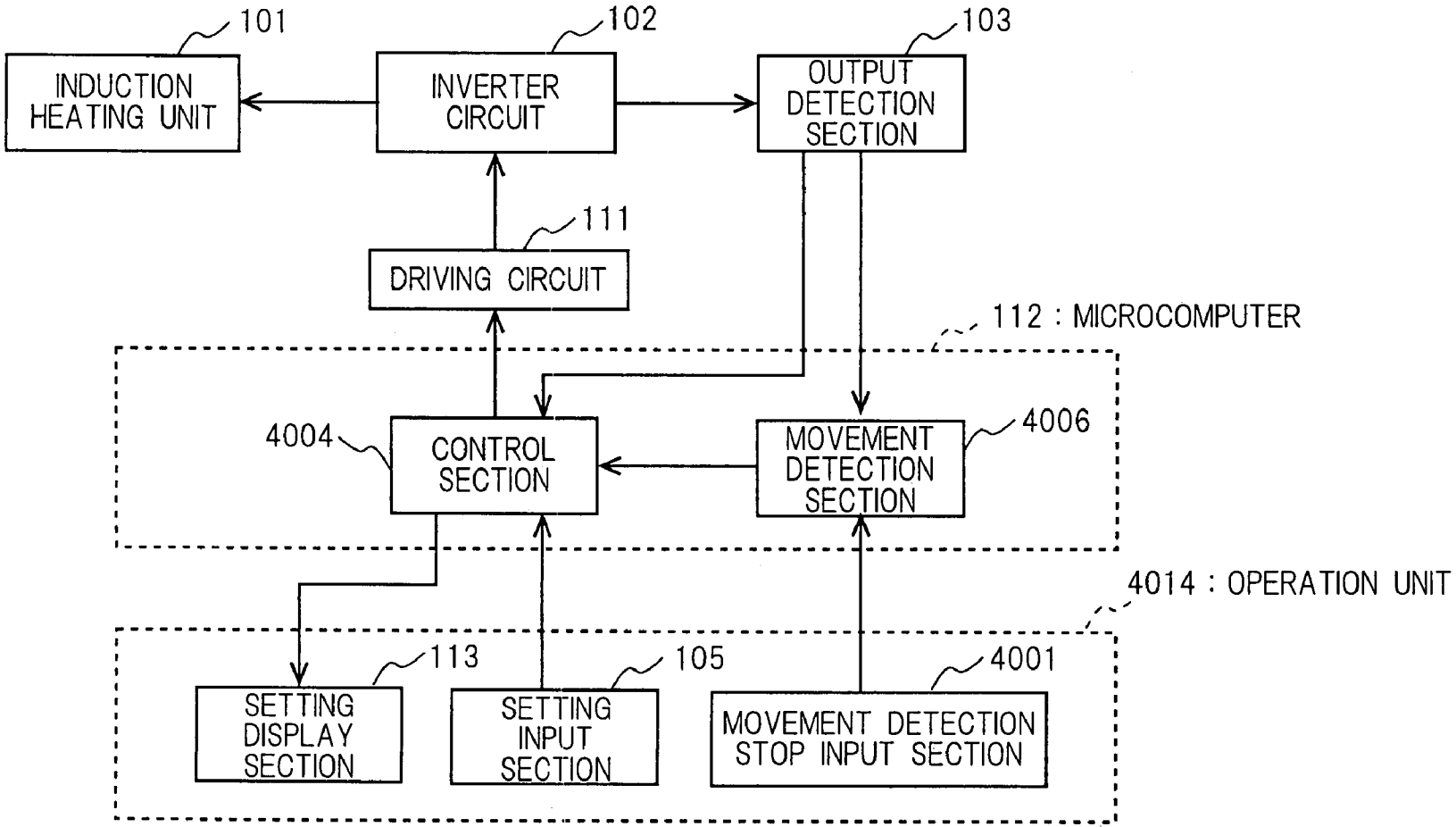
FIG. 40 is a block diagram showing a configuration of an induction heater in accordance with Embodiment 15 of the present invention.
Figure 41:
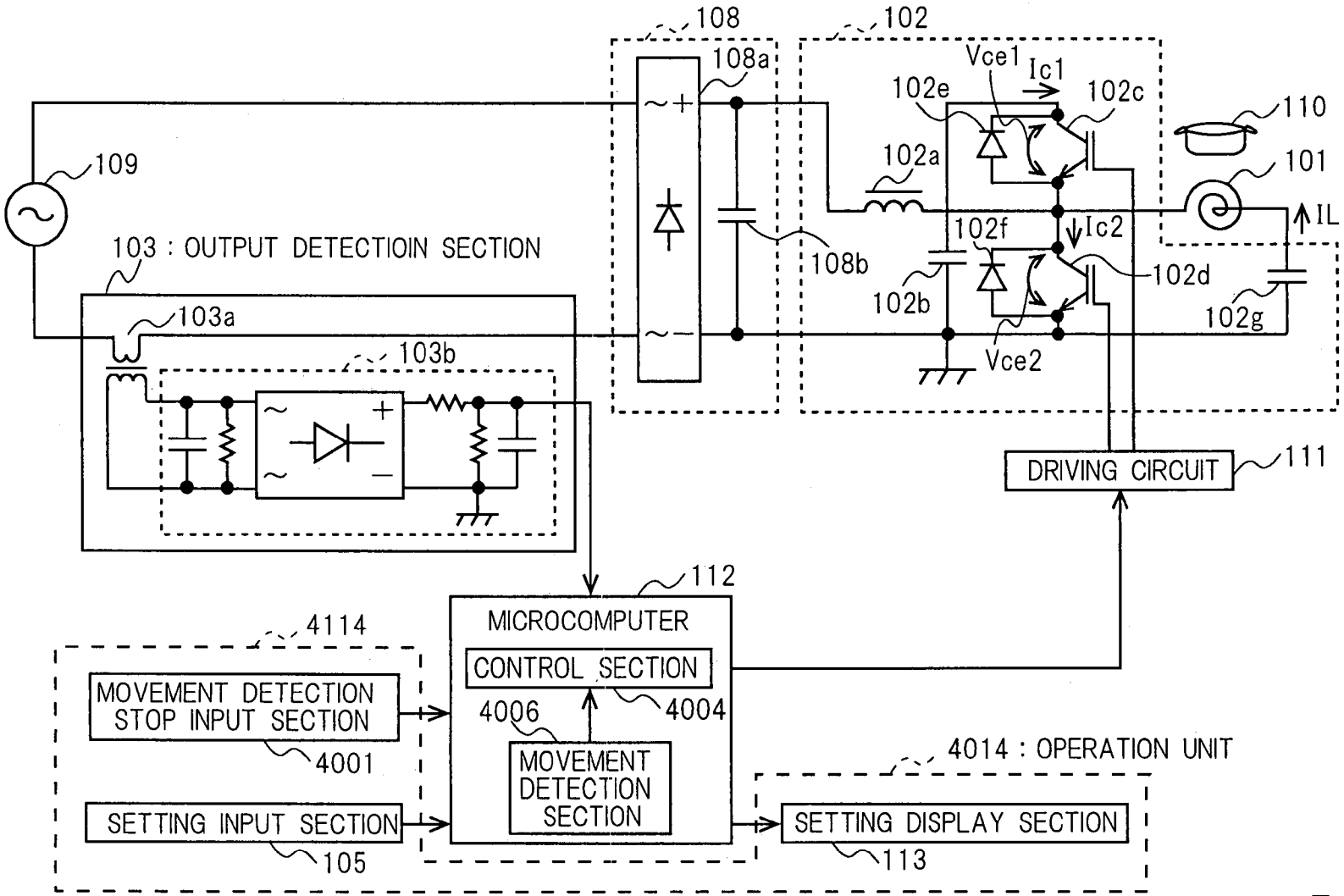
FIG. 41 is a specific circuit diagram of the induction heater in accordance with Embodiment 15 of the present invention.

With reference to FIG. 40 to FIG. 44, an induction heater (induction heating cooker) in accordance with Embodiment 15 of the present invention will be described. FIG. 40 is a schematic block diagram of the induction heater in accordance with Embodiment 15. FIG. 41 shows a circuit block diagram of the induction heater in accordance with Embodiment 15.

In FIG. 40 and FIG. 41, the numeral 109 represents the commercial AC power source, the numeral 101 represents the induction heating coil which produces a high-frequency magnetic field to heat the object to be heated (pan), and the numeral 102 represents the inverter circuit for supplying a high-frequency current to the induction heating coil 101. The numeral 103 represents the output detection section for detecting a power source current of the inverter circuit 102, the numeral 4006 represents a movement detection section for detecting a movement (a slippage or a float) of the object according to the change in the value of the power source current output by the output detection section 103, the numeral 4004 represents a control section for controlling the output of the inverter circuit 102 based on the output of the output detection section 103 and the output of the movement detection section 4006, the numeral 111 represents the driving circuit, and the numeral 4014 represents an operation unit. The operation unit 4014 has a movement detection stop input section 4001 comprising key switches, the setting input section 105 comprising key switches for inputting a heating power level, and the setting display section 113 for displaying the heating power level.

The induction heater in accordance with Embodiment 15 has the same structure as that in accordance with Embodiment 1.

The control section 4004 and the movement detection section 4006 are included in the microcomputer 112. The functions of the control section 4004 and the movement detection section 4006 are performed by software. The detection operation of the movement detection section 4006 is the same as that of the first movement detection section 106 in accordance with Embodiment 1. The control operation of the control section 4004 is basically the same as that of the control section 104 in accordance with Embodiment 1. The same numerals are applied to the same blocks as in Embodiment 1. The descriptions thereof are omitted.

When the movement detection section 4006 does not detect a movement of the object, the control section 4004 exercises control so that the output of the output detection section 103 (the output of the inverter circuit 102) reaches a set level of power (current). When the movement detection section 4006 detects a slippage or a float of the object, the control section 4004 reduces the control value sharply so that the output of the inverter circuit 102 reaches a predetermined low level of power.

The movement detection stop input section 4001 inputs a command to make the movement detection section 4006 stop detecting the movement of the object. By pushing the key switch of the movement detection stop input section 4001, the detection operation of the movement detection section 4006 can be stopped. The movement detection section 4006 does not detect a movement of the object during the stop period.

Figure 42:
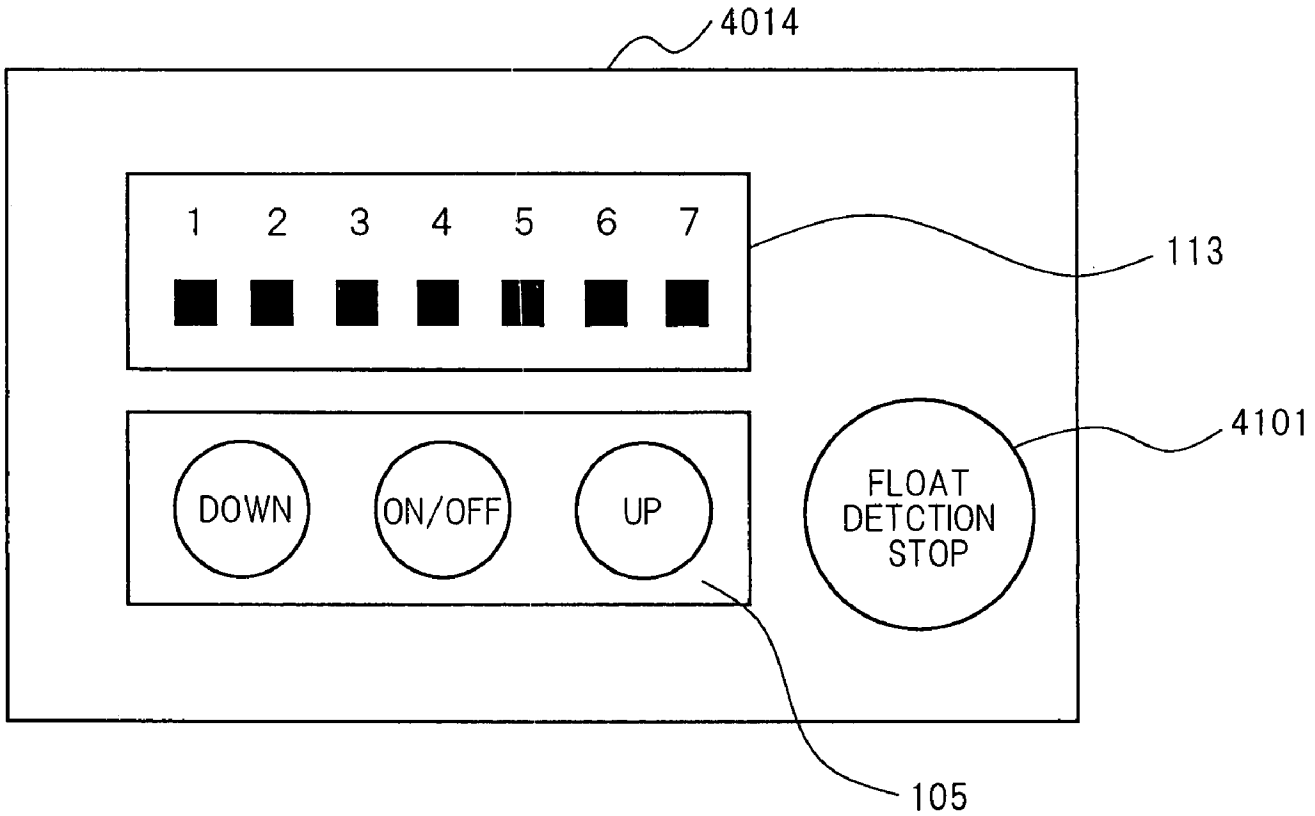
FIG. 42 is a plan view of the principal part of a setting input section of the induction heater in accordance with Embodiment 15 of the present invention.

FIG. 42 is a plan view of the principal part of the operation unit 4014 of the induction heater in accordance with Embodiment 15. The operation unit 4014 has the movement detection stop input section 4001 (float detection stop key switch) in addition to the operation unit (FIG. 4) in accordance with Embodiment 1. The setting display section 113 comprises seven LEDs in one-to-one correspondence with the number markings from one to seven to display the set heating power.

Figure 43:
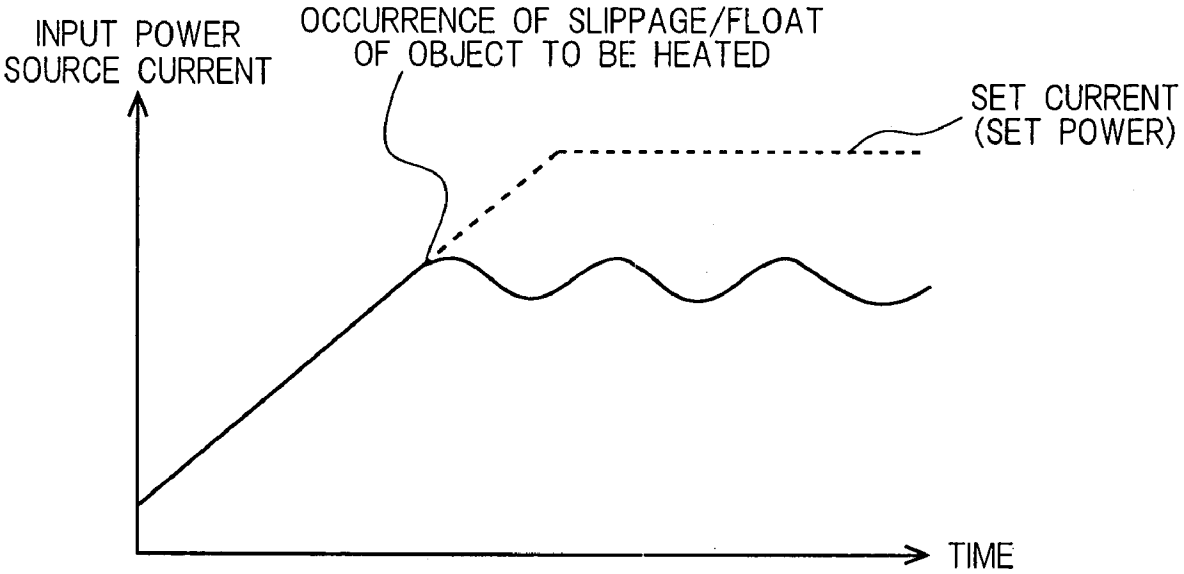
FIG. 43 is a graph illustrating the operation of the induction heater in accordance with Embodiment 15 of the present invention.

FIG. 43 is a view showing a state of the change in the input current of the inverter circuit 102 when the movement detection section 4006 is stopped by a stop command input from the movement detection stop input section 4001. The horizontal axis indicates the time from when output is started, while the vertical axis indicates the input current. As shown in FIG. 43, when a movement of the object is caused, the input current varies according to the change of the magnetic coupling between the object, which is a load, and the induction heating coil 101.

The high-frequency inverter (including the inverter circuit 102 and the induction heating coil 101) of the present embodiment has a characteristic that when it is operated under certain driving conditions (such as a frequency and a driving time ratio), if the magnetic coupling between the object 110 and the induction heating coil 101 is reduced, the input current (current IL) of the induction heating coil 101 is lowered (the detailed description of this phenomenon is provided in the description of prior-art example 2).

The operation of the induction heating cooker in accordance with Embodiment 15 will be described. By operating the key switches of the setting input section 105, the control section 4004 inputs drive signals to two switching elements of the inverter circuit 102 through the driving circuit 111 to make the switching elements perform on-off operation. According to the frequency and the duty of the drive signal, the input current of the inverter circuit 102 (the output power of the inverter circuit 102) varies. The control section 4004 exercises feedback control so that the output power of the inverter circuit 102 agrees with the power set at the setting input section 105. In the case where the movement detection section 4006 operates (which is referred to as a "normal mode"), the movement detection section 4006 detects a movement (a slippage or a float) of the object, whereby the control section 4004 changes the driving frequency and the duty transmitted to the driving circuit 111 to decrease the input current of the inverter circuit 102 sharply or gradually.

In the case where the detection section 4006 stops (which is referred to as a "movement detection stop mode"), even when the object is moving, the control section 4004 changes the frequency and the duty of the drive signal so that the inverter circuit 102 outputs the target level of power. When the user carries out cooking holding the frying pan in his/her hand, by entering the movement detection stop mode, the power which is closer to the target level of power can be obtained.

Figure 44:
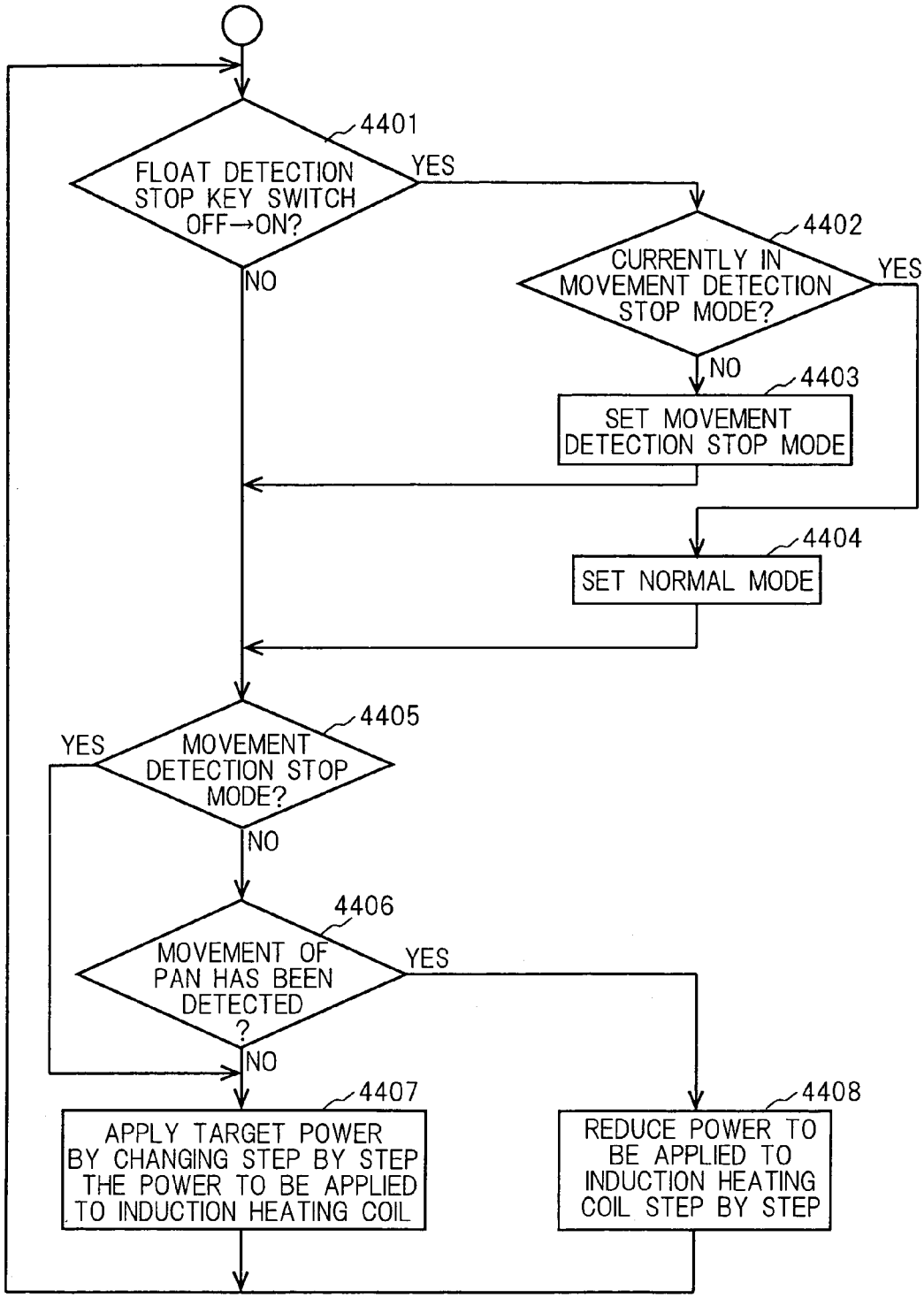
FIG. 44 is a flowchart showing a control method of the induction heater in accordance with Embodiment 15 of the present invention.

FIG. 44 is a flowchart showing a control method of the induction heater in accordance with Embodiment 15. With reference to FIG. 44, the control method of the induction heart in accordance with Embodiment 15 will be described. In Embodiment 15, by pushing the float detection stop key switch, the induction heater toggles between the movement detection stop mode and the normal mode.

At step 4401, it is checked whether or not the float detection stop key switch (movement detection stop input section) 4001 has changed form the OFF state to the ON state (has been pushed). If the float detection stop key switch has been pushed, the sequence proceeds to step 4402. If it has not been pushed, the sequence proceeds to step 4405.

At step 4402, it is checked whether or not the induction heater is currently in the movement detection stop mode. If the induction heater is not currently in the movement detection stop mode, it is placed in the movement detection stop mode (step 4403). If the induction heater is currently in the movement detection stop mode, it is placed in the normal mode (step 4404).

At step 4405, it is checked whether or not the induction heater is in the movement detection stop mode. If the induction heater is in the movement detection stop mode, the sequence proceeds to step 4407 (the movement detection is not performed). If the induction heater is not in the movement detection stop mode, the sequence proceeds to step 4406.

At step 4406, it is checked whether or not a movement of the pan (object to be heated) has been detected. If the movement of the pan (the object to be heated) has been detected, the power to be applied to the induction heating coil 101 is reduced step by step (the power may be sharply reduced) (step 4408). The sequence returns to step 4401. At step 4408, for example, the inverter circuit may be stopped, the control which is similar to that in the first output fixation mode in accordance with Embodiment 0.1 may be exercised, or the control in the stable control mode (control is exercised so that the output of the inverter agrees with a target output) may be exercised with the output of the inverter with which the pan does not move as a target output.

At step 4406, if the movement of the pan (object to be heated) has not been detected, the sequence proceeds to step 4407. At step 4407, the power to be applied to the induction heating coil 101 is changed step by step and the target level of power is applied to the induction heating coil 101. The sequence returns to step 4401.

However, in the present embodiment, the inverter circuit 102 has a two-transistor inverter configuration. So long as the inverter is configured so that the input current varies according to the change of the magnetic coupling to the load (object to be heated), the inverter may have any type of configuration or control method (for example, a one-transistor voltage resonant inverter and so on).

The movement detection stop input section 4001 is not limited to the key switch. For example, the movement detection stop input section 4001 is a voice recognition section. The voice recognition section transmits a command to establish the movement detection stop mode or a command to cancel the movement detection stop mode (a command to establish the normal mode) to the control section 4004 in response to the words issued by the user (for example, "float detection stop ON" or "float detection stop OFF").

For example, the movement detection stop input section 4001 is a proximity sensor. The proximity sensor detects whether or not the user is in front of the induction heater. For the time period for which the proximity sensor detects that the user is in front of the induction heater, the control section 4004 is placed in the movement detection stop mode. If the proximity sensor detects that the user is not in front of the induction heater, the control section 4004 enters the normal mode.

<<Embodiment 16>>

Figure 45:
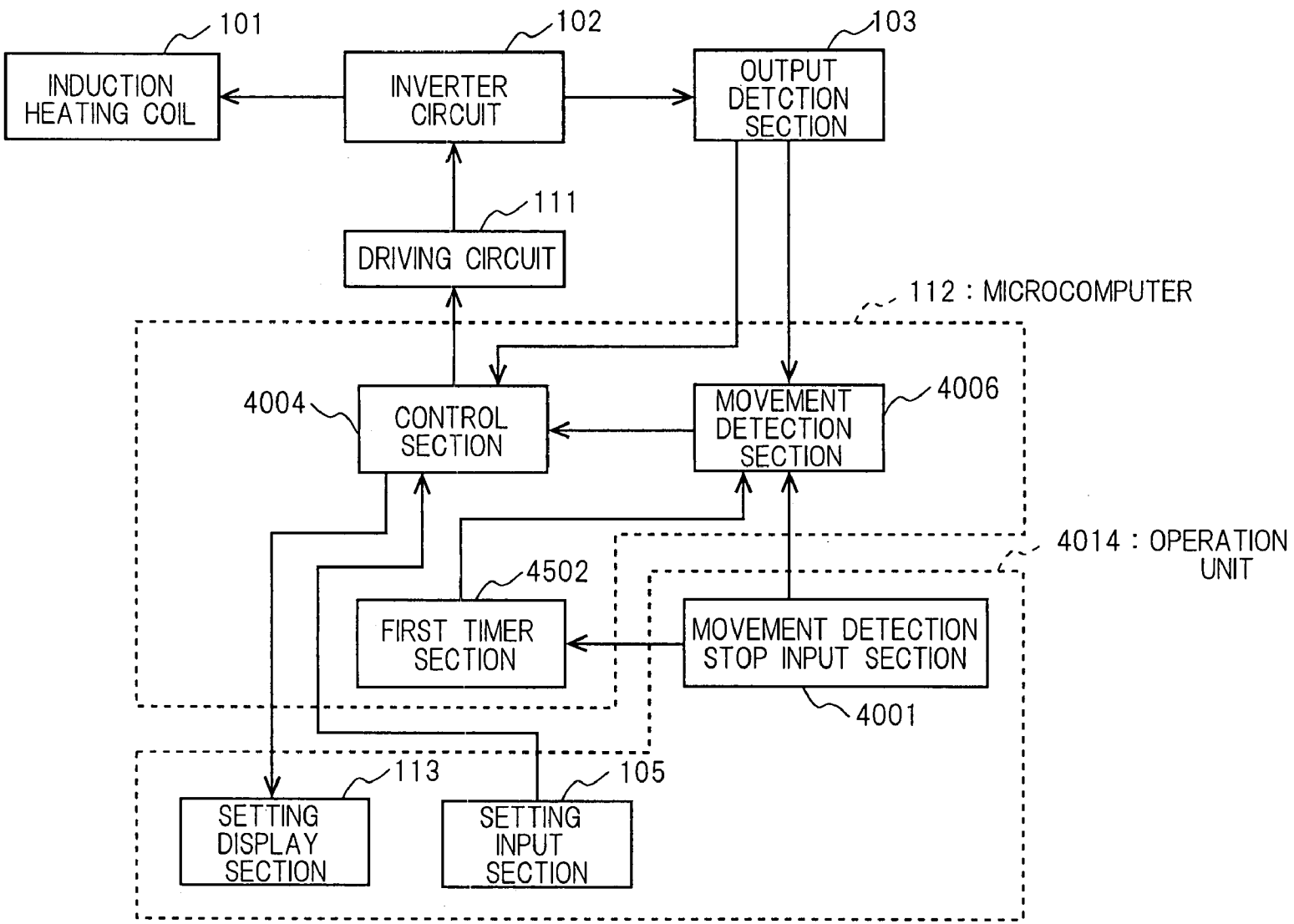
FIG. 45 is a block diagram showing a configuration of an induction heater in accordance with Embodiment 16 of the present invention.
Figure 46:
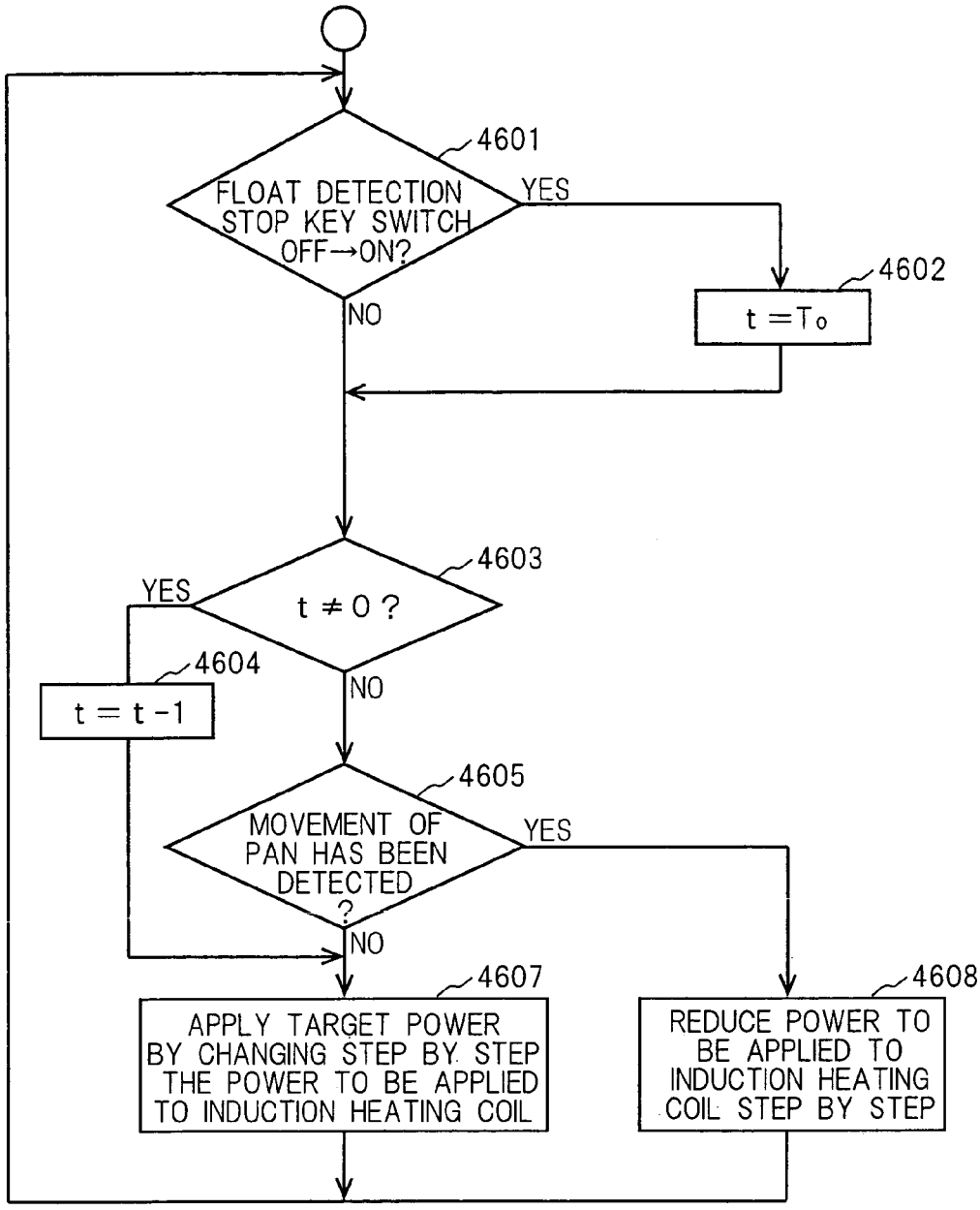
FIG. 46 is a flowchart showing a control method of the induction heater in accordance with Embodiment 16 of the present invention.

With reference to FIG. 45 and FIG. 46, an induction heater (induction heating cooker) in accordance with Embodiment 16 of the present invention will be described. FIG. 45 is a schematic block diagram of the induction heater in accordance with Embodiment 16. The induction heater in accordance with Embodiment 16 has a first timer section 4502 in addition to the configuration in accordance with Embodiment 15 (FIG. 40). The microcomputer 112 has the control section 4004, the movement detection section 4006 and the first timer section 4502. In the embodiment, the first timer section 4502 is operated by software. The induction heater in accordance with Embodiment 16 differs from that in accordance with Embodiment 15 in the control method in the movement detection stop mode. Otherwise, the induction heater in accordance with Embodiment 16 is the same as that in accordance with Embodiment 15.

FIG. 46 is a flowchart showing a control method of the induction heater in accordance with Embodiment 16. With reference to FIG. 46, the control method of the induction heater in accordance with Embodiment 16 will be described. In Embodiment 16, by pushing the float detection stop key switch 4001, the induction heater is placed in the movement detection stop mode for a predetermined period of time T0. When the predetermined period of time elapses (measured by the first timer section 4502), the induction heater returns to the normal mode, the movement detection section 4006 starts the movement detection. The processing loop in FIG. 46 is executed repeatedly at a regular time intervals.

At step 4601, it is checked whether or not the float detection stop key switch (movement detection stop input section) 4001 has changed from the OFF state to the ON state (has been pushed). If the float detection stop key switch 4001 has been pushed, the sequence proceeds to step 4602. If it has not been pushed, the sequence proceeds to step 4603.

At step 4602, T0 is loaded into the first timer section 4502 (t=T0). Next, at step 4403, it is checked whether or not the induction heater is in the movement detection stop mode. If the induction heater is in the movement detection stop mode, the sequence proceeds to step 4407. If it is not in the movement detection stop mode, the sequence proceeds to step 4406.

At step 4406, it is checked whether t is 0 or not. If t is 0 (normal mode), the sequence proceeds to step 4605. If t is not 0 (movement detection stop mode), the sequence proceeds to step 4604.

At step 4604, t is decremented (the first timer section 4502). The sequence proceeds to step 4607.

At step 4605, it is checked whether or not the movement detection section 4006 has detected a movement of the pan (object to be heated). If the movement of the pan (object to be heated) has been detected, power to be applied to the induction heating coil 101 is reduced step by step (or power may be reduced rapidly) (step 4608). The sequence returns to step 4601. At step 4608, for example, the inverter circuit may be stopped, the control which is similar to that in the first output fixation mode in accordance with Embodiment 1 may be exercised, or the control in the stable control mode (where control is exercised so that the output of the inverter agrees with a target output) may be exercised with the output of the inverter with which pan does not move as a target output.

At step 4405, if the movement of the pan (object to be heated) has not been detected, the sequence proceeds to step 4607. At step 4607, the power to be applied to the induction heating coil 101 is changed step by step, and the target level of power is applied to the induction heating coil 101. The sequence returns to step 4601.

Through the movement detection stop input section 4001, the movement detection section 4006 is stopped for a predetermined time period, so that for the predetermined time period, the heating output cannot be reduced even when the user carries out cooking moving the pan. If the predetermined time period elapses, the induction heater returns to the normal mode, so that there is no worry that the user may forget to return it to the normal mode. Since the movement detection of the object is automatically resumed after the lapse of the predetermined time period, the user can carries out cooking safely.

The movement detection stop input section 4001 is not limited to the key switch. For example, the movement detection stop input section 4001 is a voice recognition section. The voice recognition section transmits the command to establish the movement detection stop mode to the control section 4004 in response to the words issued by the user (for example, "float detection stop ON"). The control section 4004 is placed in the movement detection stop mode for the predetermined period of time T0.

The induction heater in accordance with Embodiment 15 and the induction heater in accordance with Embodiment 16 each have the movement detection stop input section. Instead of this, the induction heater may have a movement detection suppression input section. If the movement detection suppression input section inputs a movement detection suppression command, the control section enters a movement detection suppression mode. In the movement detection suppression mode, the movement detection section decreases the detection sensitivity, or the control section weakens the operation to suppress the operation of the inverter circuit (the control section performs the operation closer to the usual operation (in a state where the pan does not move)).

In the movement detection stop mode or the movement detection suppression mode, the detection of the movement of the pan may be stopped or the threshold value of the movement detection may be raised (changed so that the detection is made difficult), the control where the control method of the control section remains as usual or differs little from the usual control method even when the movement of the pan is detected may be performed, or those mentioned above may be combined.

<<Embodiment 17>>

Figure 47:
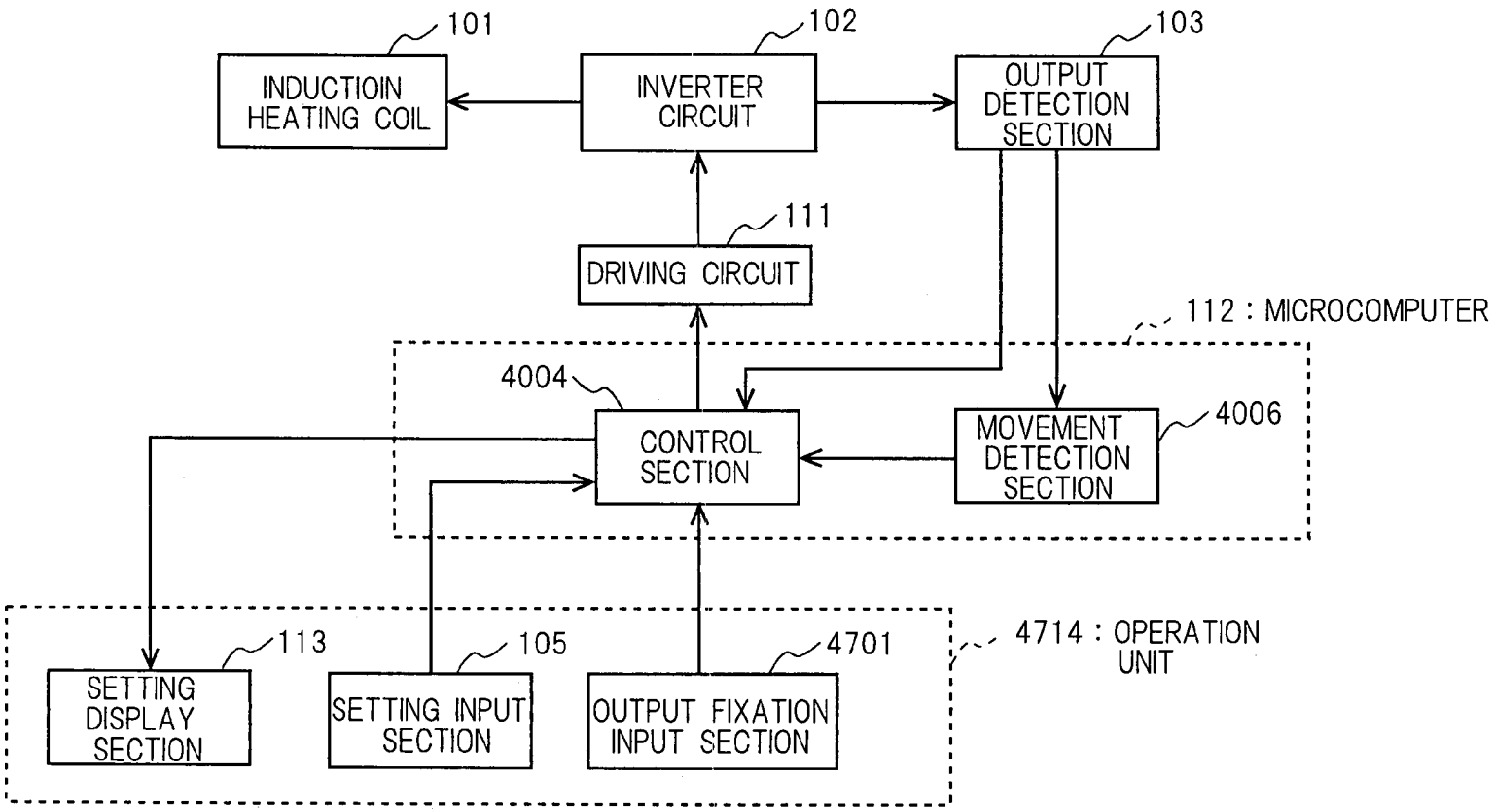
FIG. 47 is a block diagram showing a configuration of an induction heater in accordance with Embodiment 17 of the present invention.
Figure 48:
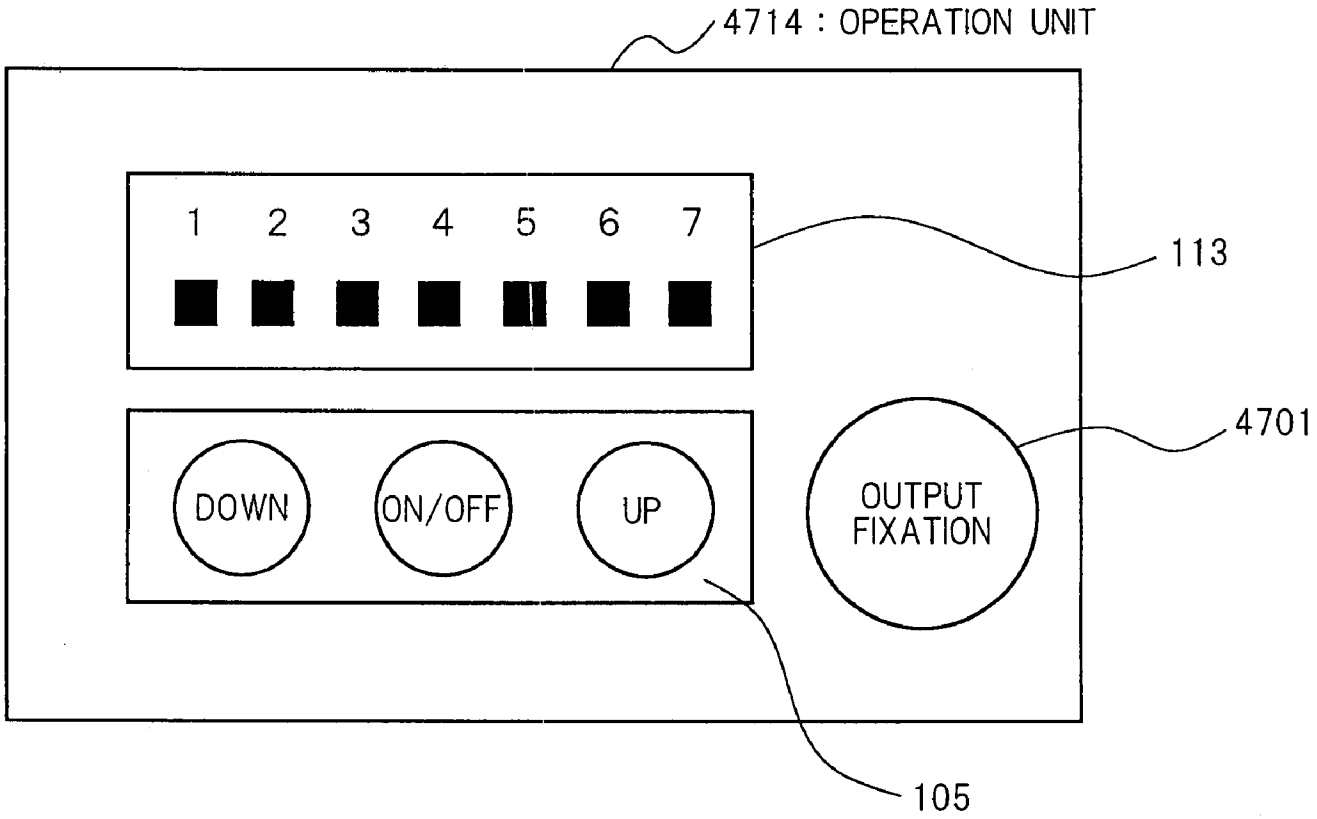
FIG. 48 is a plan view of the principal part of a setting input section of the induction heater in accordance with Embodiment 17 of the present invention.
Figure 49:
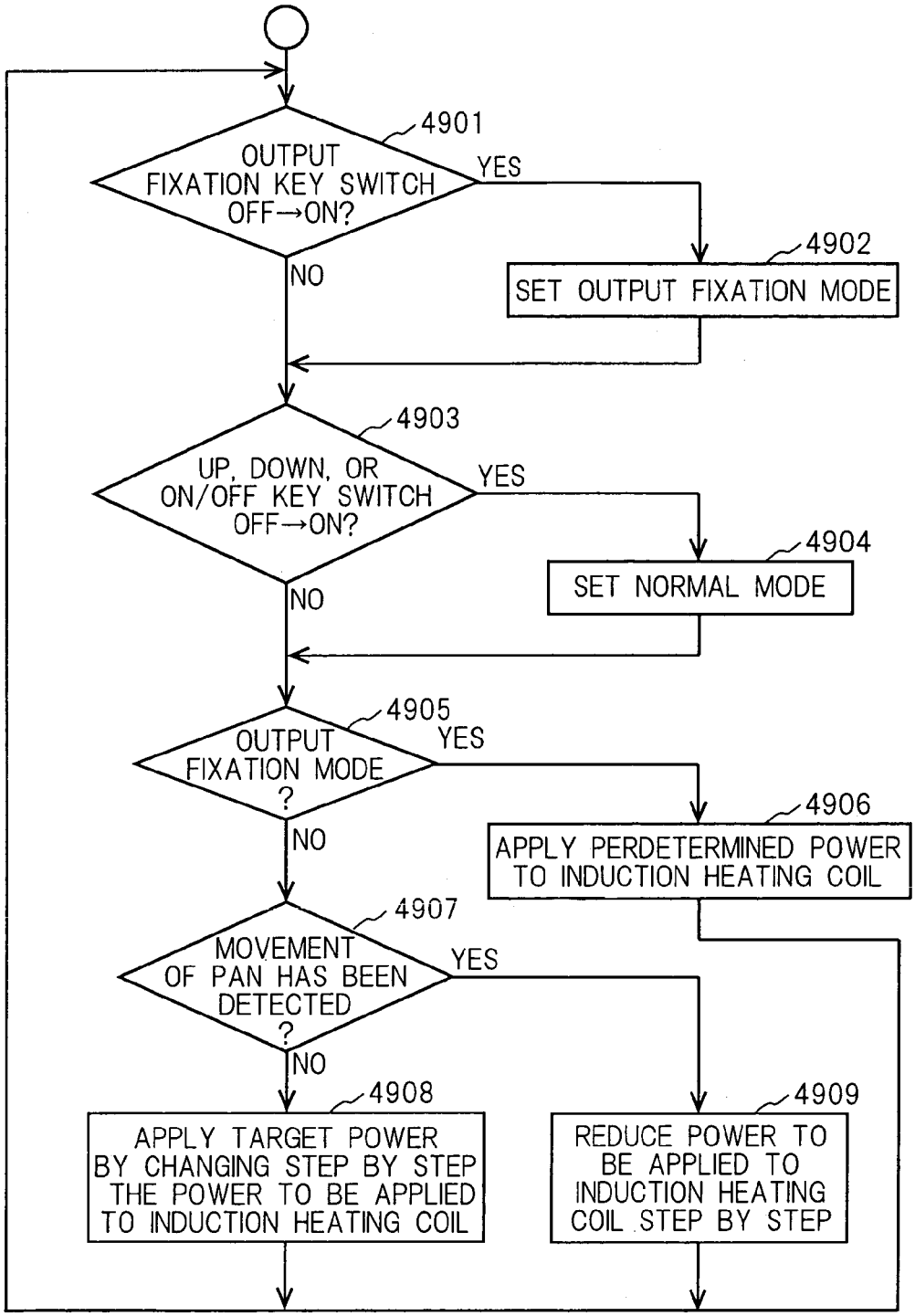
FIG. 49 is a flowchart showing a control method of the induction heater in accordance with Embodiment 17 of the present invention.

With reference to FIG. 47 to FIG. 49, an induction heater (induction heating cooker) in accordance with Embodiment 17 of the present invention will be described. FIG. 47 is a schematic block diagram of the induction heater in accordance with Embodiment 17. FIG. 48 is a plan view of the principal part of an operation unit 4714 of the induction heater in accordance with Embodiment 17. The induction heater in accordance with Embodiment 17 has an output fixation input section (a output fixation key switch) 4701 instead of the movement detection stop input section 4001 in the configuration according to Embodiment 15 (FIG. 40). The induction heater in accordance with Embodiment 17 differs from that in accordance with Embodiment 15 in the control method of the movement detection stop mode. Otherwise, the induction heater in accordance with Embodiment 17 is the same as that in accordance with Embodiment 15.

In the induction heater in accordance with Embodiment 17, by pushing the output fixation key switch 4701, the output fixation mode is established. In the output fixation mode, the control section 4004 fixes the frequency and the duty for driving the inverter circuit 102 at their respective predetermined values. Even when the user carries out cooking moving a frying pan or the like, stable heating power can be obtained.

FIG. 49 is a flowchart showing a control method of the induction heater in accordance with Embodiment 17. With reference to FIG. 49, the control method of the induction heater in accordance with Embodiment 17 will be described. In Embodiment 17, by pushing the output fixation key switch 4701, the induction heater is placed in the output fixation mode. By pushing the UP, DOWN or ON/OFF key switch (FIG. 48), the induction heater is placed in the normal mode.

At step 4901, it is checked whether or not the output fixation key switch (output fixation input section) 4901 has changed from the OFF state to the ON state (has been pushed). If the output fixation key switch has been pushed, the induction heater is placed in the output fixation mode (step 4902). If it has not been pushed, the sequence proceeds to step 4903.

At step 4903, it is checked whether or not the UP, DOWN, or ON/OFF key switch has changed from the OFF state to the ON state (has been pushed). If any one of these switches has been pushed, the induction heater is placed in the normal mode (step 4904). If none of these switches has been pushed, the sequence proceeds to step 4905.

At step 4905, it is checked whether or not the induction heater is currently in the output fixation mode. If it is not currently in the output fixation mode, the sequence proceeds to step 4907. If it is currently in the output fixation mode, the sequence proceeds to step 4906.

At step 4906 (output fixation mode), the control section 4004 outputs a predetermined control value. The inverter circuit 102 applies the predetermined level of power to the induction heating coil 101. The sequence returns to step 4901.

At step 4907, it is checked whether or not the movement detection section 4006 has detected a movement of the pan (object to be heated). If the movement of the pan (object to be heated) has been detected, the power to be applied to the induction heating coil 101 is reduced step by step (the power may be sharply reduced) (step 4909). The sequence returns to step 4901. At step 4909, for example, the inverter circuit may be stopped, the control which is similar to that in the first output fixation mode in accordance with Embodiment 1 may be performed, or the control in the stable control mode (where the control is exercised so that the output of the inverter agrees with a target output) may be performed with the output of the inverter with which the pan does not move as a target output.

At step 4907, if the movement of the pan (object to be heated) has not been detected, the power to be applied to the induction heating coil 101 is changed step by step, whereby a target level of power is applied to the induction heating coil 101 (step 4908). The sequence returns to step 4901.

In the output fixation mode, even in the case where the user carries out cooking moving a light-weight object to be heated such as a frying pan, the output is fixed, whereby as compared with the case where the safety function based on the detection of a movement of the object is activated, the average input power of the inverter circuit 102 rises. The cooking time can be reduced and the usability is improved.

The output fixation input section 4701 is not limited to the key switch. For example, the output fixation input section 4701 is a voice recognition section. The voice recognition section transmits a command to establish the output fixation mode or a command to cancel the output fixation mode (command to establish the normal mode) to the control section 4004 in response to the words issued by the user (for example, "output fixation ON" or "output fixation OFF").

<<EMBODIMENT 18>>

Figure 50:
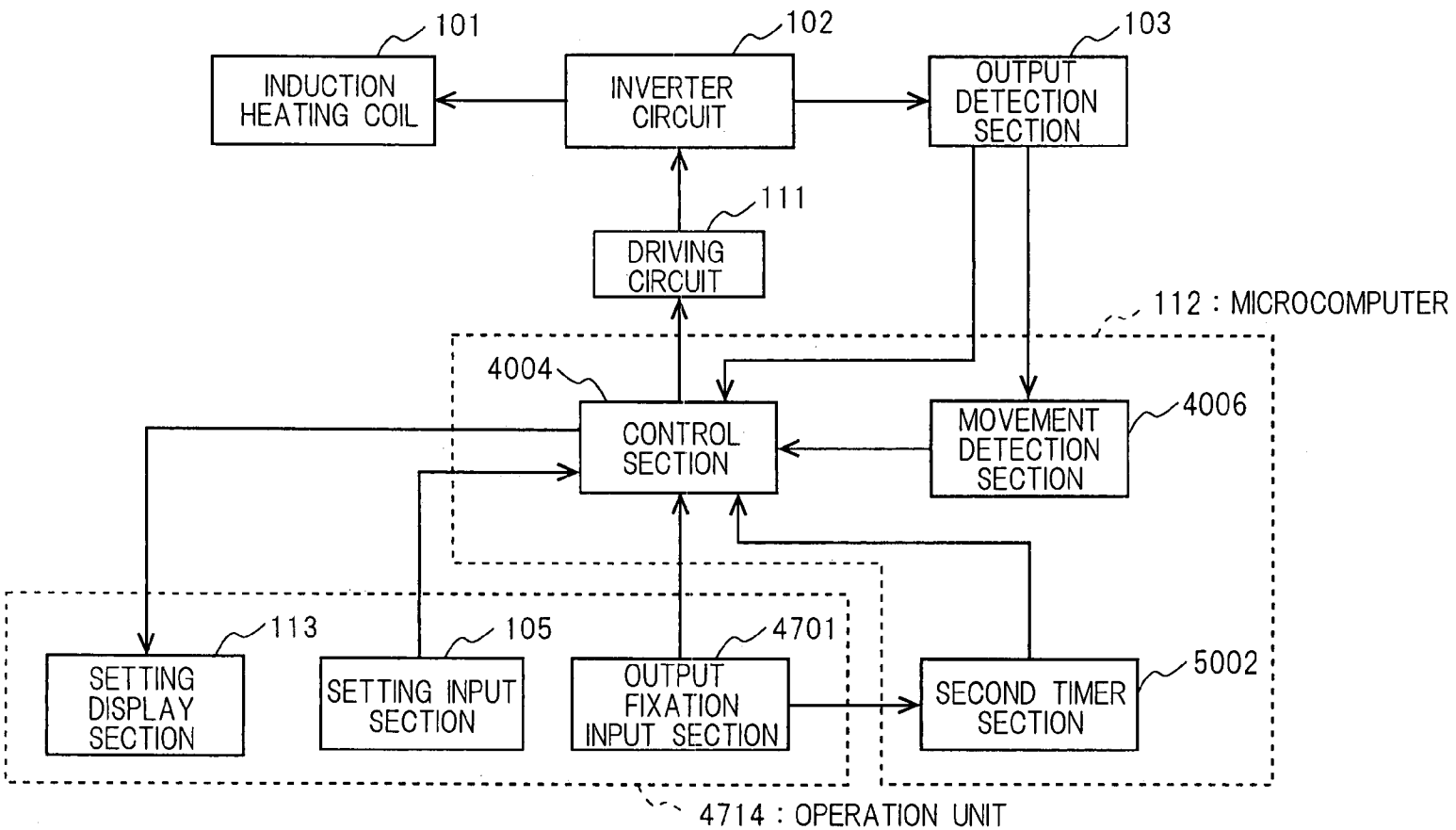
FIG. 50 is a block diagram showing a configuration of an induction heater in accordance with Embodiment 18 of the present invention.
Figure 51:
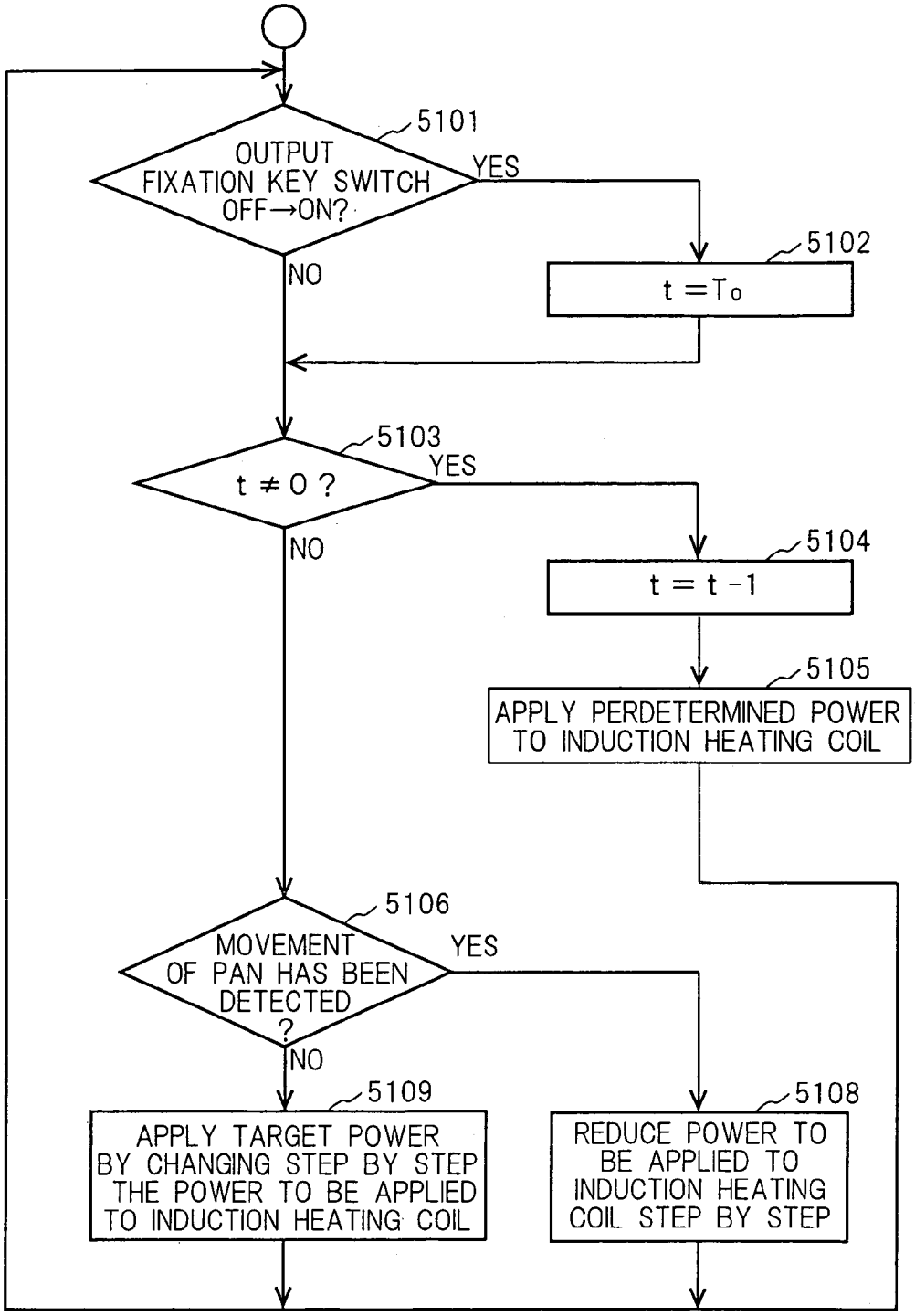
FIG. 51 is a flowchart showing a control method of the induction heater in accordance with Embodiment 18 of the present invention.

With reference to FIG. 50, and FIG. 51, an induction heater (induction heating cooker) in accordance with Embodiment 18 of the present invention will be described. FIG. 50 is a schematic block diagram of the induction heater in accordance with Embodiment 18. The induction heater in accordance with Embodiment 18 has a second timer section 5002 in addition to the configuration in accordance with Embodiment 17 (FIG. 47). The microcomputer 112 has the control section 4004, the movement detection section 4006, and the second timer section 5002. In the present Embodiment, the second timer section 5002 is operated by software. The induction heater in accordance with Embodiment 18 differs from that in accordance with Embodiment 17 in the control method in the movement detection stop mode. Otherwise, the induction heater in accordance with Embodiment 18 is the same as that in accordance with Embodiment 17.

FIG. 51 is a flowchart showing a control method of the induction heater in accordance with Embodiment 18. With reference to FIG. 51, the control method of the induction heater in accordance with Embodiment 18 will be described. In Embodiment 18, by pushing the output fixation input section (output fixation key switch) 4701, the induction heater is placed in the output fixation mode for the predetermined period of time T0. After the lapse of the predetermine time (measured by the second timer section 5002), the induction heater returns to the normal mode, and the movement detection section 4006 starts the movement detection. The processing loop in FIG. 51 is executed repeatedly at regular time intervals.

At step 5101, it is checked whether or not the output fixation key switch (output fixation input section) 4701 has changed from the OFF state to the ON state (has been pushed). If the output fixation key switch 4701 has been pushed, the sequence proceeds to step 5102. If it has not been pushed, the sequence proceeds to step 5103.

At step 5102, T0 is loaded into the second timer section 5002 (t=T0). Next, at step 5103, it is checked whether t is 0 or not (whether the induction heater is in the normal mode or in the output fixation mode). If t is not 0, the sequence proceeds to step 5104 (the output fixation mode). If t is 0, the sequence proceeds to step 5106 (the normal mode).

At step 5104 (output fixation mode), t is decremented (the second timer section 5002). The control section 4004 outputs a predetermined control value. The inverter circuit 102 applies a predetermined level of power to the induction heating coil 101 (step 5105). The sequence returns to step 5101.

At step 5106 (normal mode), it is checked whether or not the movement detection section 4006 has detected a movement of the pan (the object to be heated). If the movement of the pan (object to be heated) has been detected, the power to be applied to the induction heating coil 101 is reduced step by step (the power may be sharply reduced) (step 5108). The sequence returns to step 5101. At step 5108, for example, the inverter circuit may be stopped, the control which is similar to that in the first output fixation mode in accordance with Embodiment 1 may be performed, or the control in the stable control mode (control is performed so that the output of the inverter agrees with a target output) may be performed with the output of the inverter with which the pan does not move as a target output.

At step 5106, if the movement of the pan (object to be heated) has not been detected, the power to be applied to the induction heating coil 101 is changed step by step, whereby a target level of power is applied to the induction heating coil 101 (step 5107). The sequence returns to step 5101.

By fixing the output of the inverter circuit 102 through the output fixation input section 4701 for the predetermined time period, even when the user carries out cooking moving the pan for the predetermined time period, the heating output is not reduced. Since the induction heater returns to the normal mode after the lapse of the predetermined time period, there is no worry that the user may forget to return the induction heater to the normal mode.

The output fixation input section 4701 is not limited to the key switch. For example, the output fixation input section 4701 is a voice recognition section. The voice recognition section transmits the command to establish the output fixation mode to the control section 4004 in response to the words issued by the user (for example, "output fixation ON"). The control section 4004 is placed in the output fixation mode for the predetermined period of time T0.

<<EMBODIMENT 19>>

Figure 52:
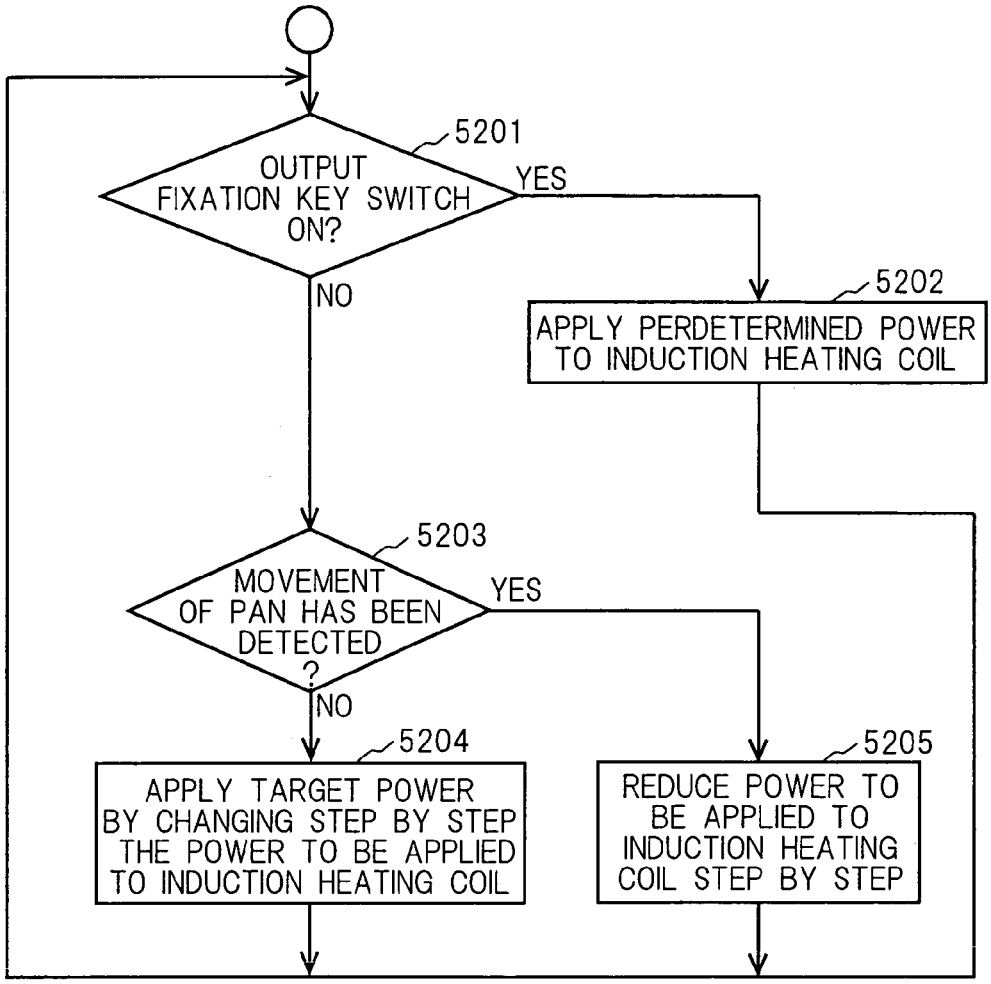
FIG. 52 is a flowchart showing a control method of an induction heater in accordance with Embodiment 19 of the present invention.

With reference to FIG. 52, an induction heater (induction heating cooker) in accordance with Embodiment 19 will be described. The induction heater in accordance with Embodiment 19 has the same configuration as that in accordance with Embodiment 17. In Embodiment 19, only while the output fixation key switch (output fixation input section) 4701 is being pushed, the control section 4004 fixes the output. As soon as the user releases the output fixation key switch, the movement detection section 4006 detects a movement of the object. Therefore, even when the user moves away from the induction heating cooker, the safety thereof is secured. Otherwise, the induction heater in accordance with Embodiment 19 is the same as that in accordance with Embodiment 17.

FIG. 52 is a flowchart showing a control method of the induction heater in accordance with Embodiment 19. With reference to FIG. 52, the control method of the induction heater in accordance with Embodiment 19 will be described. At step 5201, it is checked whether or not the output fixation key switch (output fixation input section) 4701 is ON. If the output fixation key switch 4701 is in a state of being pushed, the sequence proceeds to step 5202. If it is not being pushed, the sequence proceeds to step 5203.

At step 5202 (output fixation mode), the control section 4004 outputs a predetermined output value. The inverter circuit 102 applies a predetermined level of power to the induction heating coil 101. The sequence returns to step 5201.

At step 5203 (normal mode), it is checked whether or not the movement detection section 4006 has detected a movement of the pan (object to be heated). If the movement of the pan (the object to be heated) has been detected, power to be applied to the induction heating coil 101 is reduced step by step (power may be sharply reduced) (step 5205). The sequence returns to step 5201. At step 5205, for example, the inverter circuit may be stopped, the control which is similar to that in the first output fixation mode in accordance with Embodiment 1 may be performed, or the control in the stable control mode (where control is performed so that the output of the inverter agrees with a target output) may be performed with the output of the inverter with which the pan does not move as a target output.

At step 5203, if the movement of the pan (object to be heated) has not been detected, power to be applied to the induction heating coil 101 is changed step by step, whereby a target level of power is applied to the induction heating coil 101 (step 5204). The sequence returns to step 5201.

Only when the user is in front of the induction heater, the induction heater is placed in the output fixation mode, so that a safe induction heater can be obtained. The output fixation key switch 4701 is configured to be foot operable, whereby the user carries out cooking using both hands freely even when the induction heater is placed in the output fixation mode.

The output fixation input section 4701 is not limited to the key switch.

The output fixation input section 4701 in accordance with Embodiment 19 may be replaced with the movement detection stop input section. If the user continues to input the movement detection stop command through the movement detection stop input section (for example, if the user continues to push the key switch which is a movement detection stop input section, or the proximity sensor (movement detection stop input section) continues to detect the presence of the user), for such a time period, the movement detection section stops the detection of the movement of the pan or decreases the detection sensitivity, or even when the pan is moved, the control section performs the operation which is the same as or close to the usual operation.

<<EMBODIMENT 20>>

Figure 53:
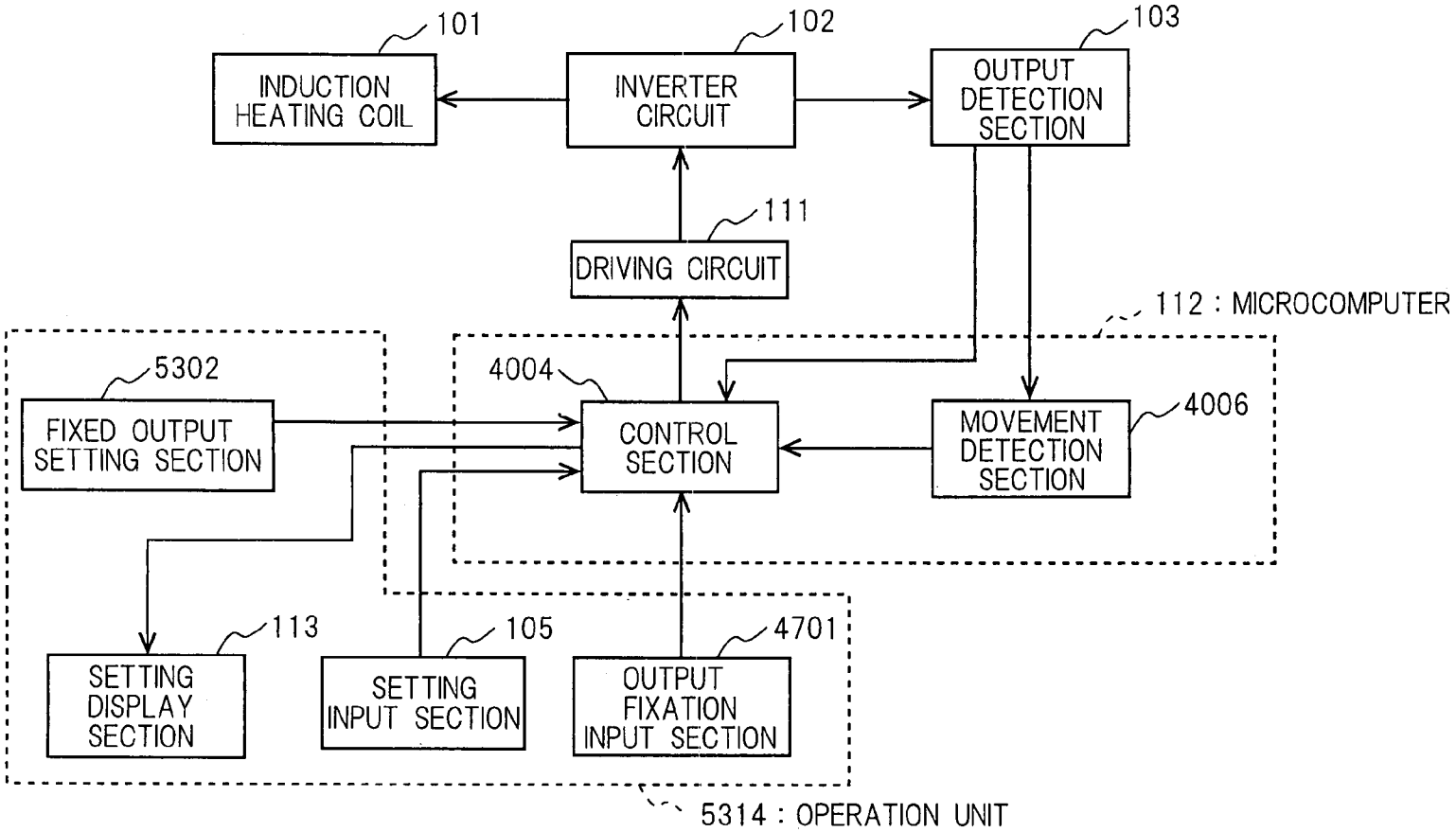
FIG. 53 is a block diagram showing a configuration of an induction heater in accordance with Embodiment 20 of the present invention.
Figure 54:
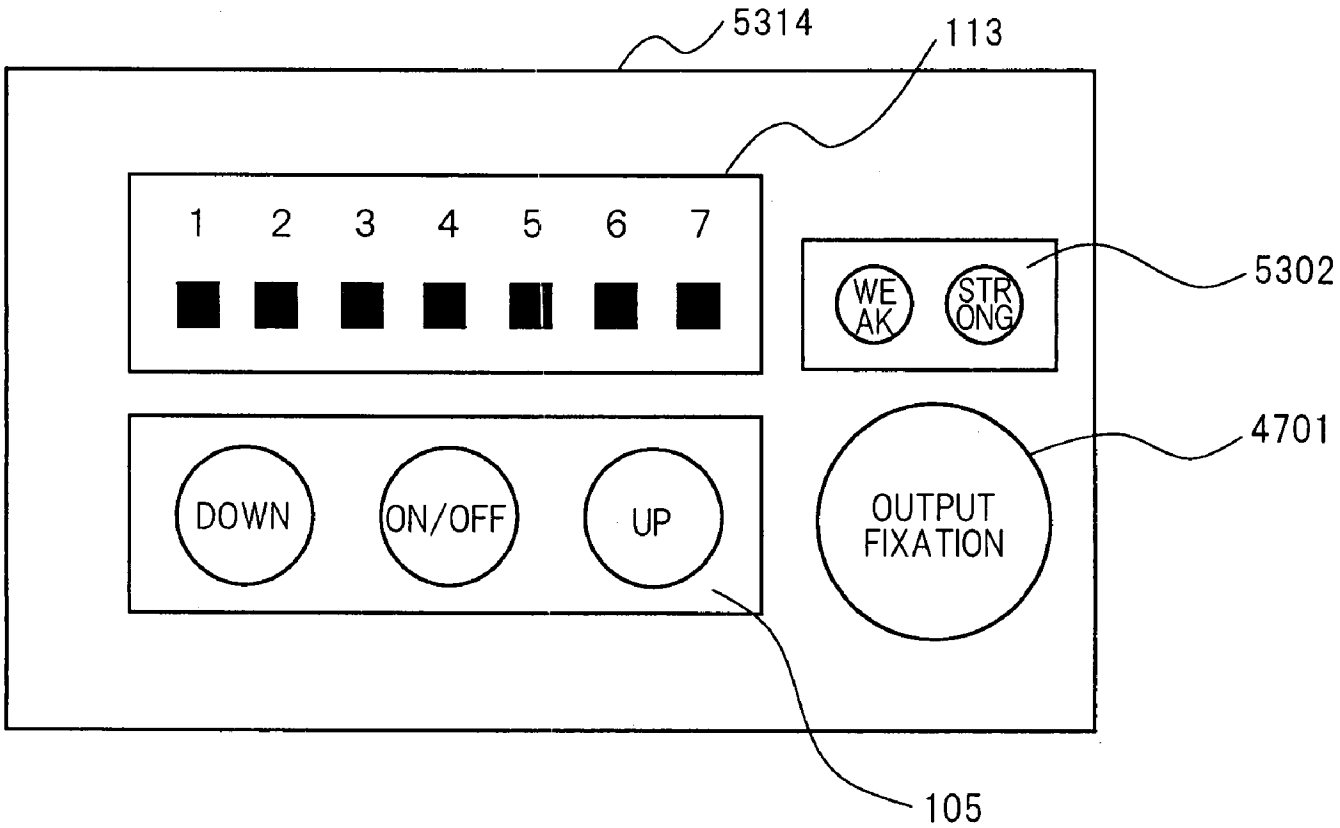
FIG. 54 is a plan view of the principal part of a setting input section of the induction heater in accordance with Embodiment 20 of the present invention.
Figure 55:
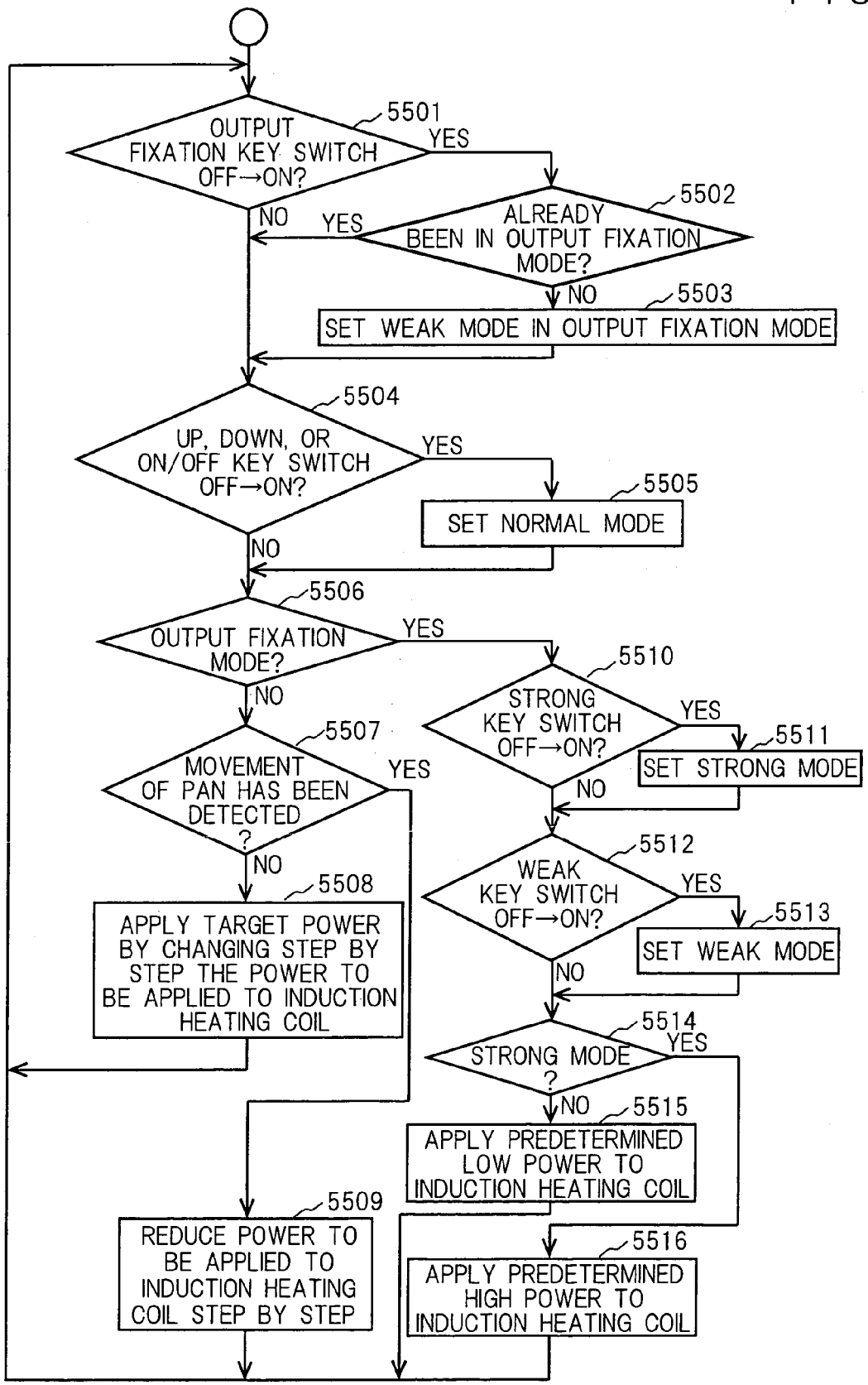
FIG. 55 is a flowchart showing a control method of the induction heater in accordance with Embodiment 20 of the present invention.

With reference to FIG. 53 to FIG. 55, an induction heater (induction heating cooker) in accordance with Embodiment 20 of the present invention will be described FIG. 53 is a schematic block diagram of the induction heater in accordance with Embodiment 20. FIG. 54 is a plan view of the principal part of an operation unit 5314 of the induction heater in accordance with Embodiment 20. The induction heater in accordance with Embodiment 20 (FIG. 53, FIG. 54) has a fixed output setting section 5302 in addition to the configuration in accordance with Embodiment 17 (FIG. 47, FIG. 48). Otherwise, the induction heater in accordance with Embodiment 20 is the same as that in accordance with Embodiment 17.

The fixed output setting section 5302 adjusts the level of the fixed output in the output fixation mode. As shown in FIG. 54, the fixed output setting section 5302 comprises two key switches ("strong" and "weak"). In the output fixation mode, when the "weak" switch is pushed, the control section 4004 decreases the driving frequency and reduces the output of the inverter circuit 102. In the output fixation mode, when the "strong" switch is pushed, the control section 4004 increases the driving frequency and increases the output of the inverter circuit 102. As a result, even in the output fixation mode, the heating power can be adjusted, whereby it becomes easy to carry out cooking.

FIG. 55 is a flowchart showing a control method of the induction heater in accordance with Embodiment 20. With reference to FIG. 55, the control method of the induction heater in accordance with Embodiment 20 will be described. At step 5501, it is checked whether or not the output fixation key switch (the output fixation input section) 4901 has changed from the OFF state to the ON state (has been pushed). If the output fixation key switch has been pushed, the sequence proceeds to step 5502. If the output fixation key switch has not been pushed, the sequence proceeds to step 5504.

At step 5502, it is checked whether or not the induction heater has already been in the output fixation mode. If the induction heater has already been in the output fixation mode, the sequence proceeds to step 5504, whereas if the induction heater has not been in the output fixation mode, the induction heater is placed in the output fixation mode and the "weak" mode (step 5503).

Next, at step 5504, it is checked whether or not the UP, DOWN or ON/OFF key switch has changed from the OFF state to the ON state (has been pushed). If any one of these key switches has been pushed, the normal mode is established (step 5505). If none of these key switches has been pushed, the sequence proceeds to step 5506.

Next, at step 5506, it is checked whether or not the induction heater is currently in the output fixation mode. If the induction heater is not in the output fixation mode, the sequence proceeds to step 5507. If it is currently in the output fixation mode, the sequence proceeds to step 5510.

At step 5510 (output fixation mode), it is checked whether or not the "strong" key switch has changed from the OFF state to the ON state (has been pushed). If the "strong" key switch has been pushed, the "strong" mode is established (step 5511). If it has not been pushed, the sequence proceeds to step 5512.

At step 5512, it is checked whether or not the "weak" key switch has changed from the OFF state to the ON state (has been pushed). If the "weak" key switch has been pushed, the "weak" mode is established (step 5513). If the "weak" key switch has not been pushed, the sequence proceeds to step 5514.

At step 5514, it is checked whether or not the induction heater is in the "strong" mode. If the induction heater is in the "strong" mode, the control section 4004 outputs a predetermined large control value. The inverter circuit 102 applies a predetermined high level of power ("strong" power) to the induction heating coil 101 (step 5516). The sequence returns to step 5501.

At step 5514, if the induction heater is in the "weak" mode, the control section 4004 outputs a predetermined small control value. The inverter circuit 102 applies a predetermined low level of power ("weak" power) to the induction heating coil 101 (step 5515). The sequence returns to step 5501.

At step 5507 (normal mode), it is checked whether or not the movement detection section 4006 has detected a movement of the pan (object to be heated). If it has detected the movement of the pan (object to be heated, the control section 4004 reduces power to be applied to the induction heating coil 101 step by step (power may be sharply reduced) (step 5509). The sequence returns to step 5501.

At step 5507, if the movement of the pan (object to be heated) has not been detected, the control section 4004 changes the power to be applied to the induction heating coil 101 step by step and applies a target level of power to the induction heating coil 101 (step 5508). The sequence returns to step 5501.

At step 5509, for example, the inverter circuit may be stopped, the control which is similar to that in the first output fixation mode in accordance with Embodiment 1 may be performed, or the control in the stable control mode (where control is performed so that the output of the inverter agrees with a target output) may be performed with the output of the inverter with which the pan does not moved as a target output.

In the description, an induction heater which is an induction heating cooker is set forth as an embodiment. The induction heater is not limited thereto.

According to the present invention, an induction heater can be obtained which has a safety function of lowering or stopping the heating power when an object to be heated is moved and allows a user to carry out cooking even when the safety function is activated.

According to the present invention, an induction heater can be obtained which has a safety function of lowering or stopping the heating power when an object to be heated is moved by a high-frequency magnetic field produced by an induction heating coil, the safety function not being activated in any case other than mentioned above so that the situation where cooking activities of a user are hindered by the safety function is prevented.

According to the present invention, the induction heater can be obtained which has a safety function of lowering or stopping the heating power when an object to be heated is moved, wherein the safety function is not activated when a user moves a pan, which is an object to be heated, or even when the safety function is activated, it is possible to heat the object with stability (for example, it is possible carry out the cooking such as fry cooking).

In the present invention, when a user carries out cooking using a light-weight frying pan or carries out cooking moving the frying pan, neither a slippage nor a float of the pan is detected, or the output of an inverter circuit is fixed.

As a result, the average input current can be increased, the cooking time is reduced, and it becomes easy to carry out cooking. By performing the operation to detect a slippage or a float of the pan at regular time intervals, when the slippage or the float of the pan is caused, the slippage or the float thereof is stopped, so that it is possible to carry out cooking safely.

In the present invention, especially in the induction heater which heats an object to be heated having low magnetic permeability and high electrical conductivity, when a movement of the object is caused by buoyant force, the discrimination between a human-caused movement and a naturally caused movement is made, and the power control suitable for each movement is performed and the indication suitable therefor is provided. A user-friendly induction heater can be obtained.

According to the present invention, in the induction heater having a function of detecting a movement of a load and thereby stopping or limiting the heating output, even when cooking is carried out with the use of a load made of non-magnetic and low-resistant metal, the function of detecting a movement of the load (object to be heated) is stopped or suppressed according to the cooking menu. As a result, even when the load is moved by the user's operation, there never, or hardly occurs a reduction or a stop of the heating power. A user-friendly induction heater which makes it possible to carry out cooking moving an object to be heated can be obtained.

Although the present invention has been described with respect to its preferred embodiment in some detail, the presently disclosed content of the preferred embodiment may change in the details of the structure thereof and any change in the combination and sequence of the components may be attained without departing from the scope and spirit of the claimed invention.

INDUSTRIAL APPLICABILITY

The present invention is useful as an induction heater such as an induction heating cooker to be used in ordinary households, offices, restaurants, factories and so on.

The invention claimed is:

1. An induction heater comprising an induction heating coil which produces a high-frequency magnetic field to heat an object to be heated, an inverter circuit which supplies a high-frequency current to said induction heating coil, an output detection section for detecting the magnitude of the output of said inverter circuit, a control section for controlling the output of said inverter circuit in response to the output of said output detection section, a setting input section for setting a target output to be controlled by said control section, a first movement detection section for detecting a movement of said object, and a storage section for storing a control value output by said control section or an output value of said output detection section before said first movement detection section detects the movement of said object, wherein said control section has a reach control mode where the output of said inverter circuit is increased from a low output to said target output gradually, a stable control mode where said inverter circuit is controlled so that the output of said inverter circuit agrees with said target output, and a first output mode where a control value derived from the control value or the output value of said output detection section stored in said storage section is output, or an output value derived from the control value or the output value of said output detection section stored in said storage section is set as a new target output, and said inverter circuit is controlled so that the output of said inverter circuit agrees with the new target output, and when said first movement detection section detects a movement of said object, said control section shifts to said first output mode.

2. An induction heater in accordance with claim 1, wherein, when a predetermined time period elapses in said first output mode, said control section shifts to said reach control mode.

3. An induction heater in accordance with claim 1, wherein, in said first output mode where said control section outputs the control value derived from the control value or the output value of said output detection section stored in said storage section, when the difference between the output value of said output detection section stored in said storage section at the previous time and the output value of said output detection section newly stored therein is within a predetermined range, and a predetermined time period has elapsed since the shift to said first output mode, said control section changes said target output value set by said setting input section into the value derived based on the output value of said output detection section stored in said storage section, or in said first output mode where said control section sets the output value derived from the control value or the output value of said output detection section stored in said storage section as the new target output and controls said inverter circuit so that the output of said inverter circuit agrees with the new target output, when the difference between the control value or the output value of said output detection section stored in said storage section at the previous time, and the control value or the output value of said output detection section newly stored in said storage section is within a predetermined range, and a predetermined time period has elapsed since the shift to said first output mode, said target output value set by said setting input section is changed into the value derived based on the control value or the output value of said output detection section stored in said storage section.

4. An induction heater in accordance with claim 3, having a setting display section for displaying said target output value set by said setting input section, wherein said setting display section displays said target output value set by said setting input section in response to the control value output by said control section or the output value of said output detection section which have been stored in said storage section.

5. An induction heater in accordance with claim 1, having a second movement detection section which determines that said object has slipped to move when said first movement detection section detects movements of said object successively in said first output mode, wherein, when said second movement detection section detects the movement of said object, said control section changes the output of said inverter circuit in said first output mode into a value lower than before in order to stop the slippage of said object.

6. An induction heater in accordance with claim 5, wherein, in lowering the output of said inverter circuit in said first output mode, said control section gradually reduces the output.

7. An induction heater in accordance with claim 1 or 5, wherein when said target output value set by said setting input section exceeds a predetermined value, said control section corrects a threshold value with which said first movement detection section or said second movement detection section determines that said object has moved with a predetermined value.

8. An induction heater in accordance with claim 3, wherein when the value for use in changing said target output value set by said setting input section, which is derived based on the control value output by said control section or the output value of said output detection section which have been stored in said storage section is less than a predetermined value, said control section stops heating.

9. An induction heater in accordance with claim 1, wherein when the difference between the set output value and the output value of said output detection section is within a predetermined range in said stable control mode, said control section fixes a control value as a second output mode for at least a predetermined time period.

10. An induction heater in accordance with claim 1, having a movement state detection section for determining whether said object has been moved by the outside force or the movement thereof has been caused by the repelling magnetic field in said stable control mode, wherein when said movement state detection section determines that the movement thereof has been caused by the repelling magnetic field, the shift to said first output mode is made.

11. An induction heater in accordance with claim 10, wherein, in said stable control mode, according to whether or not the periods of the change in the output value of said output detection section, the control value of said control section, or the weight of said object are within a predetermined range, it is checked whether the movement of said object has been caused by the repelling magnetic field or said object has been moved by the outside force.

12. An induction heater in accordance with claim 1, further having a third movement detection section for detecting a movement in which said object moves away from said induction heating coil based on the fact that said control section has increased the control value continuously so as to increase the output of said inverter circuit in said stable control mode, wherein when said third movement detection section detects the movement of said object, the shift to said first output mode is made so that said movement is stopped.

13. An induction heater in accordance with claim 1 or claim 10, wherein when shifting from said reach control mode or said stable control mode to said first output mode, said control section outputs a correction value obtained by correcting the control value stored in said storage section with a first correction value or a correction value such that the output value obtained by correcting the output value of said output detection section stored in said storage section with a first correction value can be gained, whereas when shifting from said first output mode to said reach control mode, said control section outputs a control value obtained by correcting the control value stored in said storage section with a second correction value or a correction value such that the output value obtained by correcting the output value of said output detection section stored in said storage section with a second correction value can be gained, and said first correction value is set greater than said second correction value.

14. An induction heater in accordance with claim 1 or claim 5, wherein in the case where the set target output value is greater than a predetermined value, said control section does not lower the output even when said first movement detection section or said second movement detection section detects the movement of said object.

15. An induction heater comprising an inverter including an induction heating coil which produces a high-frequency magnetic field to heat an object, a control section for controlling the output of said inverter, and a movement detection section which detects a state of operation of said inverter or a state of said object until the output of said induction heating coil increases gradually from a low output to a predetermined output to detect a movement of said object, wherein when said movement detection section performs the movement detection operation for detecting the movement of said object, said control section performs the output limiting operation for limiting the output of said induction heating coil to a value lower than the value when the movement thereof has been detected or stopping the heating, afterwards, repeats at least once the process of canceling said output limiting operation, increasing the output gradually again, performing said movement detection operation, and performing said output limiting operation, and when detecting that said movement detection operation is repeated with approximately the same output changes, said control section determines that the movement of said object has been caused by the high-frequency magnetic field produced by said induction heating coil, thereby limiting the output of said induction heating coil thereafter to the output lower than the output when said movement detection section has detected the movement of said object to carry out heating.

16. An induction heater in accordance with claim 15, wherein said control section samples the output values of said inverter, the control values output by said control section, or the weight of said object when said movement detection section detected a movement of said object a plurality of times, and based on a plurality of values obtained through the sampling, determines whether or not the movement of said object has been caused by the high-frequency magnetic field produced by said induction heating coil.

17. An induction heater in accordance with claim 16, wherein said control section compares a plurality of values obtained through sampling or performs the calculation thereamong, and when determining that said plurality of values are approximately the same, said control section determines that said object has been moved by the high-frequency magnetic field produced by said induction heating coil.

18. An induction heater in accordance with claim 15, wherein said control section detects the time required for the repetition of said movement detection operation and, according to the change of the time, determines whether or not a movement of said object has been caused by the high-frequency magnetic field produced by said induction heating coil.

19. An induction heater in accordance with claim 18, wherein said control section measures the repetition period of said movement detection operation a plurality of times, compares a plurality of values obtained by measurement or performs the calculation thereamong, and when a plurality of values are approximately the same, said control section determines that said object has been moved by the high-frequency magnetic field produced by said induction heating coil.

20. An induction heater in accordance with claim 15, wherein when detecting that the movement of said object has been caused by the user operation after having performed the output limiting operation based on the result of the detection done by said movement detection section, said control section cancels said output limiting operation to increase the output of said induction heating coil to a predetermined output.

21. An induction heater in accordance with claim 15, having a display section for providing a display corresponding to the output set by a user, wherein even when said control section starts the output limiting operation based on the result of the detection done by said movement detection section, said display section maintains the display corresponding to said set output, whereas after determining that the movement of said object has been caused by the high-frequency magnetic field produced by said induction heating coil, said control section reduces the output to be displayed to the output lower than the displayed output corresponding to said output.

22. An induction heater in accordance with claim 15, wherein according to the change of the output of said inverter, the control value output by said control section or the weight of said object with time, said movement detection section detects a movement of said object resulting from the high-frequency magnetic field produced by said induction heating coil.

23. An induction heater comprising:

an induction heating coil which produces a high-frequency magnetic field to heat an object;

an inverter circuit which supplies a high-frequency current to said induction heating coil;

an input section for making a setting of the heating;

a movement detection section for detecting a movement of said object; and a control section which controls the output of said inverter circuit, and when said movement detection section detects a movement of said object, performs the limiting operation to stop or limit the output of said inverter circuit, wherein according to the settings at said input section, the detection sensitivity of said movement detection section is decreased or the detection thereof is stopped, or said limiting operation of said control section is weakened or is not performed.

24. An induction heater in accordance with claim 23, wherein said input section has a heating output setting section for setting heating output, and according to the heating output set at said heating output setting section, the detection sensitivity of said movement detection section is decreased or the detection thereof is stopped, or said limiting operation of said control section is weakened or is not performed.

25. An induction heater in accordance with claim 24, wherein when the set value of the heating output at said heating output setting section becomes equal to or greater than a predetermined value, the detection sensitivity of said movement detection section is decreased or the detection thereof is stopped, or said limiting operation of said control section is weakened or is not performed.

26. An induction heater in accordance with claim 23, wherein when said movement detection section detects a movement of a load, according to the settings of said input section, selection between the continuation of the heating output and the stop thereof is made.

27. An induction heater in accordance with claim 23, wherein when a setting section which said input section has in addition to said heating output setting section is used, the detection sensitivity of said movement detection section is decreased or the detection thereof is stopped, or said limiting operation of said control section is weakened or is not performed.

28. An induction heater in accordance with claim 23, wherein when a change input section provided independently in said input section is used, the detection sensitivity of said movement detection section is decreased or the detection thereof is stopped, or said limiting operation of said control section is weakened or is not performed.

29. An induction heater in accordance with claim 28, wherein said change input section has a fry cooking selection section for carrying out fry cooking, and when the fry cooking is selected, the detection sensitivity of said movement detection section is decreased or the detection thereof is stopped, or said limiting operation of said control section is weakened or is not performed.

30. An induction heater comprising:

an induction heating coil which produces a high-frequency magnetic field to heat an object to be heated;

an inverter circuit which supplies a high-frequency current to said induction heating coil;

an output detection section for detecting the magnitude of the output of said inverter circuit;

a movement detection section for detecting a movement of said object;

a control section for controlling the output of said inverter circuit in response to the output of said output detection section and the output of said movement detection section; and a movement detection stop input section through which a user inputs a stop command to stop the detection operation of said movement detection section or to make said control section stop controlling the output in response to the output of said movement detection section.

31. An induction heater comprising:

an induction heating coil which produces a high-frequency magnetic field to heat an object to be heated;

an inverter circuit which supplies a high-frequency current to said induction heating coil;

an output detection section for detecting the magnitude of the output of said inverter circuit;

a movement detection section for detecting a movement of said object;

a control section for controlling the output of said inverter circuit in response to the output of said output detection section and the output of said movement detection section;

a movement detection stop input section for inputting a stop command to stop the detection operation of said movement detection section or to make said control section stop controlling the output in response to the output of said movement detection section; and a first timer section which starts timing in association with the input operation to said movement detection stop input section, wherein until a predetermined time period elapses after said first timer section starts timing, said control section performs control regardless of whether said object has moved or not.

32. An induction heater comprising:

an induction heating coil which produces a high-frequency magnetic field to heat an object;

an inverter circuit which supplies a high-frequency current to said induction heating coil;

an output detection section for detecting the magnitude of the output of said inverter circuit;

a movement detection section for detecting a movement of said object;

a control section for controlling the output of said inverter circuit in response to the output of said output detection section and the output of said movement detection section; and an output fixation input section for inputting an output fixation command, wherein when said output fixation command is input, said control section fixes the output of said inverter circuit regardless of whether said object has moved or not.

33. An induction heater in accordance with claim 32, having a second timer section which starts timing in association with the input of said output fixation command to said output fixation input section, wherein when the time measured by said second timer section becomes equal to or longer than a predetermined time period, said control section cancels the fixation of the output of said inverter circuit.

34. An induction heater in accordance with claim 32, wherein said control section fixes the output of said inverter circuit only while said output fixation input section inputs said output fixation command.

35. An induction heater in accordance with claim 32 having an fixed output setting section for adjusting the output of said inverter circuit to be fixed at said output fixation input section.

* * * * *